US011564450B2

(12) United States Patent
Davis et al.

(10) Patent No.: US 11,564,450 B2
(45) Date of Patent: Jan. 31, 2023

(54) SYSTEMS AND METHODS FOR ENHANCING BOOT COMFORT AND STYLE

(71) Applicant: Boot Barn, Inc., Irvine, CA (US)

(72) Inventors: Russell Lane Davis, Rancho Santa Margarita, CA (US); Michael McCarron, Aliso Viejo, CA (US)

(73) Assignee: Boot Bam, Inc., Irvine, CA (US)

( * ) Notice: Subject to any disclaimer, the term of this patent is extended or adjusted under 35 U.S.C. 154(b) by 0 days.

(21) Appl. No.: 16/737,758

(22) Filed: Jan. 8, 2020

(65) Prior Publication Data

US 2020/0253331 A1 Aug. 13, 2020

Related U.S. Application Data

(60) Provisional application No. 62/842,111, filed on May 2, 2019, provisional application No. 62/791,671, filed on Jan. 11, 2019.

(51) Int. Cl.
*A43B 23/02* (2006.01)
*A43B 3/04* (2006.01)
(Continued)

(52) U.S. Cl.
CPC ..... *A43B 23/027* (2013.01); *A43B 3/04* (2013.01); *A43B 23/021* (2013.01); *A43B 23/047* (2013.01); *A43B 23/25* (2013.01)

(58) Field of Classification Search
CPC ..... A43B 11/00; A43B 23/00; A43B 23/0205; A43B 23/021; A43B 23/0235;
(Continued)

(56) References Cited

U.S. PATENT DOCUMENTS 91,547 A * 6/1869 Leathe ..... A43B 23/047 36/51
160,854 A * 3/1875 Tutewiler ..... A43B 23/047 36/51
(Continued)

FOREIGN PATENT DOCUMENTS

CA 2787447 A1 * 8/2011 ..... A43B 23/0235
CN 205267114 6/2016
(Continued)

OTHER PUBLICATIONS

"Blundstone 585—The Leather Lined in Rustic Brown", https://www.blundstone.ca/collections/the-leather-lined/products/585-in-rustin-brown, retrieved on May 12, 2020.
(Continued)

*Primary Examiner* — Sharon M Prange
*Assistant Examiner* — Grace Huang
(74) *Attorney, Agent, or Firm* — Knobbe, Martens, Olson & Bear, LLP

(57) ABSTRACT

Boot shafts can be designed for comfort by providing expansion in the shaft of a boot. Portions of a shaft can be replaced, augmented, or associated with a more deformable and elastically resilient material or materials. When effectively associated or integrated, the elastic material can allow for temporary expansion of the shaft to ease passage of the heel and foot through the shaft and into the shoe box. A long thin resilient feature can provide expansion and ease of passage of a foot down the boot shaft while also potentially minimizing conspicuous departure from conventional stylings. Such features can also be physically obscured with straps (which may rotate, for example). Such features may be curved or angled to visually in fit with and even be camouflaged by surrounding decorative ornamentation on the shaft of such a boot.

13 Claims, 66 Drawing Sheets

(51) Int. Cl.
*A43B 23/04* (2006.01)
*A43B 23/25* (2006.01)

(58) Field of Classification Search
CPC . A43B 23/0245; A43B 23/025; A43B 23/027; A43B 23/045; A43B 23/047; A43B 23/0265; A43B 23/0275; A43B 3/02; A43B 3/04; A43B 13/181; A43B 13/183; A43B 13/41; A43B 13/125; A43B 13/127; A43B 17/06; A43B 7/142; A43B 7/12; A43C 11/002; A43C 11/006; A43C 23/047
USPC .. 36/8.3, 144, 27, 76 R, 8.4, 108, 107, 76 C
See application file for complete search history.

(56) References Cited

U.S. PATENT DOCUMENTS 189,476 A * 4/1877 Libby ..... A43B 23/047 36/51
229,144 A * 6/1880 Kelly ..... A43B 23/047 36/51
229,172 A * 6/1880 Officer ..... A43B 23/047 36/51
290,460 A * 12/1883 Mitchell ..... A43B 23/047 36/51
317,127 A * 5/1885 Hall ..... A43B 23/047 36/51
378,988 A * 3/1888 Warren ..... A43B 23/047 36/51
390,552 A * 10/1888 Benson ..... A43B 3/02 36/58
482,134 A * 9/1892 Newcomb ..... A43B 23/047 36/51
1,465,343 A * 8/1923 Case ..... A43C 11/06 36/51
1,660,203 A * 2/1928 Morgan ..... A43B 23/0295 36/45
2,097,810 A 11/1937 Dawes
2,099,476 A * 11/1937 Glowka ..... A41D 17/00 36/2 R
2,178,885 A * 11/1939 Buff ..... A43C 1/006 36/99
2,329,573 A 9/1943 Ziegliss
3,657,757 A * 4/1972 Vilder ..... A43B 3/04 12/146 C
3,763,579 A * 10/1973 Dexter ..... A43C 11/12 2/265
4,420,893 A 12/1983 Stephan
4,438,573 A 3/1984 McBarron
4,503,566 A * 3/1985 Wheeler ..... A41D 17/00 2/22
4,567,677 A 2/1986 Zona
4,776,109 A 10/1988 Sacre
4,974,344 A 12/1990 Ching
5,060,401 A * 10/1991 Whatley ..... A43B 13/18 36/25 R
5,086,572 A 2/1992 Lee
5,113,599 A 5/1992 Cohen et al.
5,158,767 A 10/1992 Cohen et al.
5,325,614 A 7/1994 Rosen
5,333,397 A 8/1994 Hausch
5,647,150 A * 7/1997 Romanato ..... A43B 7/125 12/142 R
5,711,031 A * 1/1998 Clement ..... A41D 13/012 2/82
5,720,117 A 2/1998 Toschi
5,878,510 A 3/1999 Schoesler
5,925,441 A 7/1999 Blauer et al.
5,933,983 A 8/1999 Jeon
5,987,779 A 11/1999 Litchfield et al.
6,006,447 A 12/1999 Neal et al.
6,006,450 A * 12/1999 Hayes ..... A43B 5/00 36/107
6,006,451 A * 12/1999 Morris ..... A43B 3/00 36/115
D427,755 S 7/2000 Tresser
6,092,310 A 7/2000 Schoesler
6,138,382 A 10/2000 Schoesler
6,178,663 B1 1/2001 Schoesler
6,185,752 B1 * 2/2001 Hendersen ..... A41D 17/00 2/23
D443,129 S 6/2001 Tresser
6,357,051 B1 * 3/2002 Lee ..... A42B 1/201 2/195.1
6,497,057 B1 12/2002 Lee et al.
6,598,319 B2 7/2003 Hardt
6,604,477 B1 * 8/2003 Hozan ..... A43B 7/12 112/475.16
6,760,982 B2 * 7/2004 Chen ..... A43B 9/00 36/51
6,797,352 B2 * 9/2004 Fowler ..... A41D 27/24 428/57
D501,708 S 2/2005 Andrews-Kramer
D502,308 S 3/2005 Teague
6,860,036 B2 * 3/2005 Zhu ..... A43B 7/12 36/45
D504,205 S 4/2005 Andrews-Kramer
D506,306 S 6/2005 Teague
D515,305 S 2/2006 Andrews-Kramer
D515,306 S 2/2006 Andrews-Kramer
D516,284 S 3/2006 Andrews-Kramer
7,055,267 B2 * 6/2006 Wilson ..... A43B 7/08 36/10
D525,016 S 7/2006 Feller
7,082,702 B2 * 8/2006 Cretinon ..... A43B 13/026 36/107
7,117,545 B2 * 10/2006 Hannon ..... A41D 15/005 2/275
7,210,248 B2 5/2007 VanNoy et al.
D551,833 S 10/2007 Feller
7,278,445 B2 10/2007 Marvin et al.
D555,337 S 11/2007 Feller
D555,343 S 11/2007 Bettencourt
D555,344 S 11/2007 Bettencourt
D555,345 S 11/2007 Bettencourt
D555,346 S 11/2007 Bettencourt
D555,348 S 11/2007 Bettencourt
D555,891 S 11/2007 Bettencourt
D556,439 S 12/2007 Zimmerman
D558,962 S 1/2008 Zimmerman
D569,088 S 5/2008 Poetsch
D570,080 S 6/2008 Feller et al.
7,380,353 B2 6/2008 Feller et al.
D572,883 S 7/2008 Smith
7,523,565 B1 4/2009 Chen
D594,217 S 6/2009 Bishoff
7,644,521 B2 1/2010 McCarron
D612,138 S 3/2010 Gaines
7,730,640 B2 * 6/2010 Clark ..... A43B 7/125 36/113
7,752,773 B2 7/2010 McCarron
D622,487 S 8/2010 McCarron et al.
D624,295 S 9/2010 McCarron
D627,144 S 11/2010 Bettencourt
D630,422 S 1/2011 Davis
7,891,116 B1 * 2/2011 Iglikov ..... A43B 23/0205 36/4
7,913,427 B2 3/2011 Edward et al.
D636,158 S 4/2011 McCarron et al.
D641,144 S 7/2011 McCarron et al.
7,980,010 B2 * 7/2011 Davis ..... A43B 23/047 36/138
8,136,266 B2 3/2012 McCarron
8,166,673 B2 5/2012 Sills
8,209,883 B2 7/2012 Lyden
8,316,560 B2 11/2012 Caron et al.
8,359,769 B2 1/2013 Vattes et al.
D675,814 S 2/2013 Marshall
D676,224 S 2/2013 Marshall
D683,529 S 6/2013 Marshall
D685,171 S 7/2013 Marshall

(56) References Cited

U.S. PATENT DOCUMENTS 8,505,214 B2 8/2013 Lee
8,707,583 B2 4/2014 Caron et al.
8,850,717 B2 10/2014 Lin
D722,761 S 2/2015 Monroy
8,950,085 B2 2/2015 Losani
D723,259 S 3/2015 Norwood
D726,398 S 4/2015 Grott et al.
9,021,721 B2 5/2015 McCarron
D731,158 S 6/2015 Backus
D735,453 S 8/2015 Monroy
9,161,590 B2 10/2015 Mazzarolo
9,204,681 B2 12/2015 Norwood et al.
9,254,014 B2 * 2/2016 Weitzman ..... A43B 3/04
9,259,054 B2 * 2/2016 Nishiwaki ..... A43B 23/0255
9,282,871 B2 3/2016 Davis et al.
D756,619 S 5/2016 Monroy
9,347,162 B1 5/2016 Pitts
D763,561 S 8/2016 Norwood
D763,563 S 8/2016 Monroy
9,456,652 B2 10/2016 Davis et al.
9,526,297 B2 12/2016 Davis
9,578,905 B1 2/2017 Sloan
9,578,920 B2 2/2017 Grott et al.
9,629,416 B2 * 4/2017 Rackiewicz ..... A43B 23/0235
9,661,897 B2 * 5/2017 Thompson ..... A43B 3/02
D794,926 S 8/2017 Monroy
D797,422 S 9/2017 Prats
9,756,901 B2 9/2017 Musho et al.
9,814,280 B2 11/2017 Buck, IV et al.
D808,138 S 1/2018 Monroy
10,136,599 B2 11/2018 Tse
10,441,022 B2 10/2019 Sanderson et al.
10,485,292 B2 11/2019 Buck, IV et al.
10,681,958 B2 6/2020 Toschi
10,721,993 B2 7/2020 Rosenblatt et al.
10,791,796 B1 * 10/2020 Baker ..... A43B 3/02
11,013,290 B2 * 5/2021 Villanueva ..... A43B 3/04
2002/0056502 A1 * 5/2002 Bordes ..... B29C 66/7394 156/73.4
2003/0145484 A1 8/2003 Chen
2004/0010939 A1 1/2004 Liu et al.
2004/0134101 A1 * 7/2004 Chen ..... A43B 1/10 36/55
2005/0198858 A1 9/2005 Hsu
2007/0175064 A1 * 8/2007 Culton ..... A43C 11/1493 36/7.1 R
2007/0277291 A1 12/2007 McCarron
2008/0148600 A1 6/2008 Aveni et al.
2008/0307671 A1 * 12/2008 Koffler ..... A43B 7/1455 36/28
2009/0056167 A1 * 3/2009 Sanguinetti ..... A43B 23/24 206/223
2010/0031534 A1 2/2010 Davis et al.
2010/0139125 A1 6/2010 McCarron
2011/0005101 A1 1/2011 Sills
2012/0055042 A1 * 3/2012 Polegato Moretti ... A43B 7/125 36/83
2012/0186106 A1 * 7/2012 Recchi ..... A43B 23/047 36/102
2013/0008050 A1 1/2013 Marc
2013/0067766 A1 3/2013 Chou
2013/0239443 A1 9/2013 Lin
2013/0291293 A1 * 11/2013 Jessiman ..... A43B 7/125 2/459
2013/0318825 A1 12/2013 Caron et al.
2014/0173935 A1 * 6/2014 Sabbioni ..... A43B 1/14 36/87
2014/0345165 A1 * 11/2014 Norwood ..... A43B 23/022 36/109
2015/0296919 A1 * 10/2015 Kingsley-Poole ..... A43B 3/16 36/7.1 R
2015/0335101 A1 11/2015 Monroy et al.
2016/0135542 A9 5/2016 Monroy et al.
2017/0119093 A1 5/2017 Grott et al.
2017/0238649 A1 8/2017 Buck, IV et al.
2018/0049512 A1 * 2/2018 Villanueva ..... A43B 3/04
2018/0206597 A1 * 7/2018 Towey ..... A43B 23/047
2018/0271212 A1 9/2018 Lowell et al.
2019/0133254 A1 * 5/2019 Lovell ..... A43B 5/006
2021/0030107 A1 * 2/2021 Pratt ..... A43C 11/008
2021/0153603 A1 * 5/2021 Kennedy ..... A43B 3/0078

FOREIGN PATENT DOCUMENTS

DE 29506366 U1 * 6/1995 ..... A43B 3/02
DE 29506366 U1 6/1995
DE 202011000847 U1 * 7/2011 ..... A43B 23/0215
EP 0538537 A1 * 4/1993 ..... A43C 11/12
EP 2253237 B1 5/2013
EP 2566363 B1 6/2019
GB 2516042 1/2015
KR 101075172 10/2011
MX 2018010115 A 1/2019
MX 364889 5/2019
WO WO 2019/018804 1/2019
WO WO 2020/146641 A1 7/2020
WO WO-2021050944 A1 * 3/2021

OTHER PUBLICATIONS

Timberland catalog, Timberland Pro, Spring, 2019.
International Search Report and Written Opinion for PCT/US2020/012944, dated May 26, 2020.
International Search Report and Written Opinion for PCT/US2020/012944, dated Jul. 24, 2021.

* cited by examiner

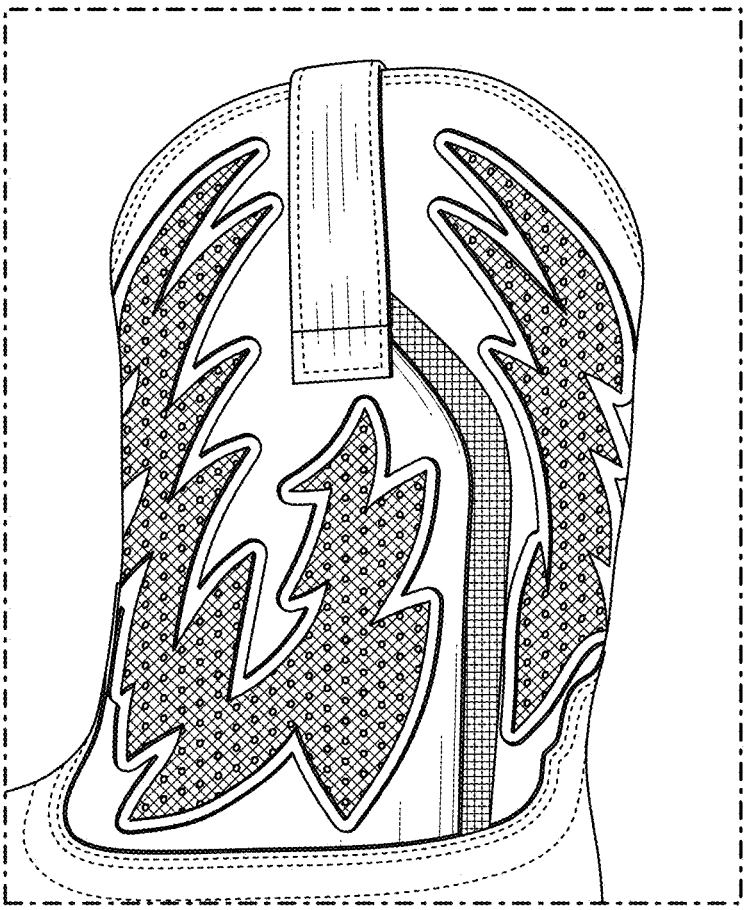
FIG. 18A2

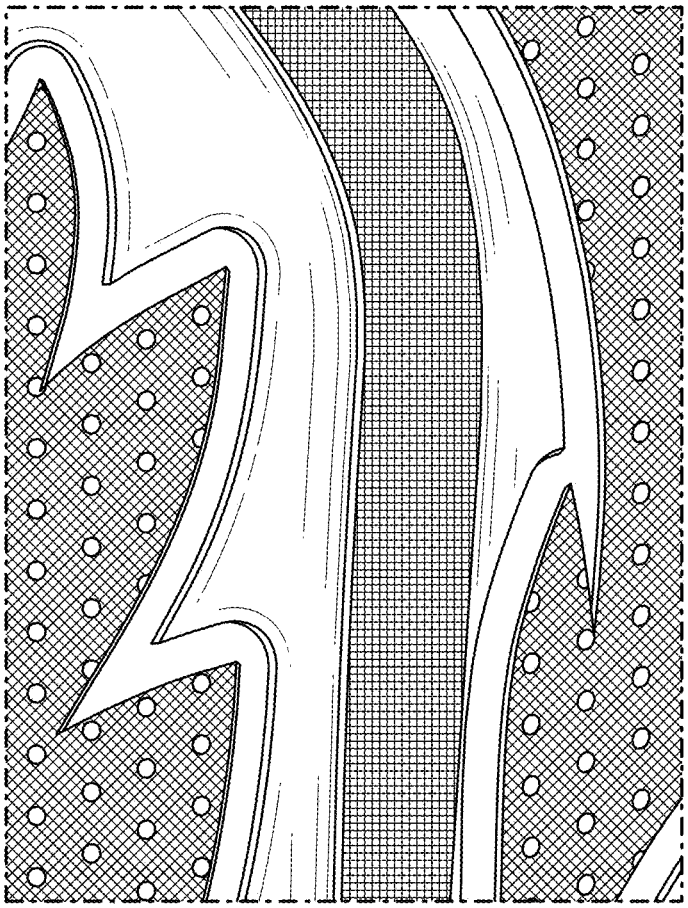
FIG. 18B2

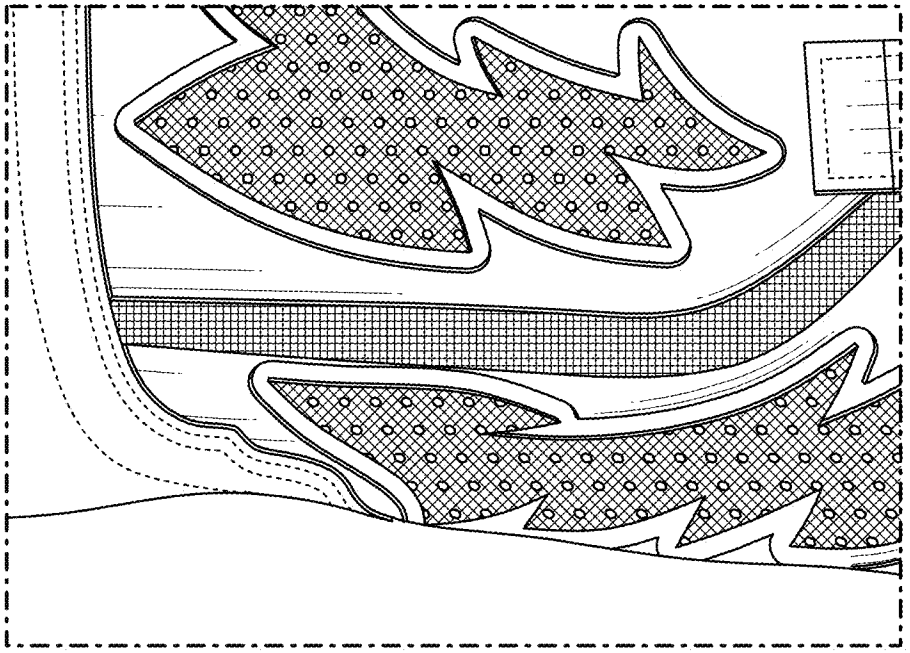
FIG. 18C2

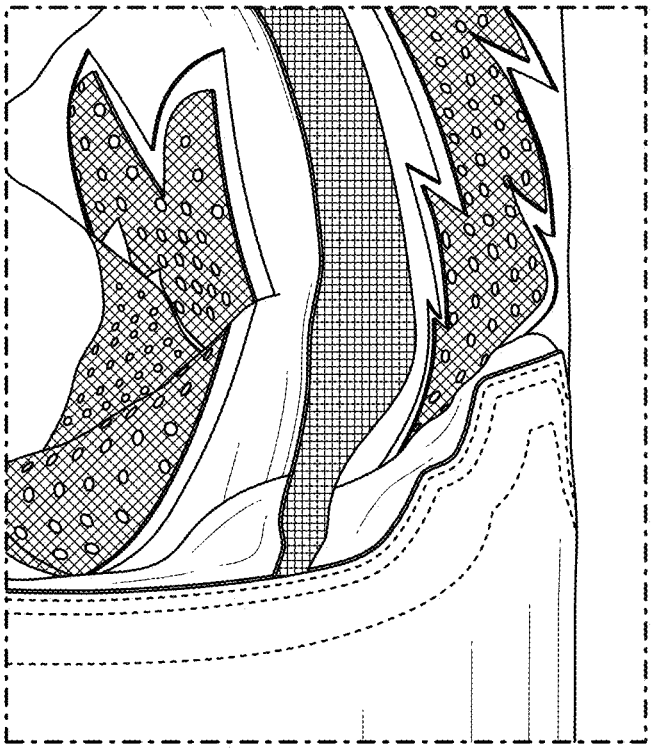
FIG. 18D2

SYSTEMS AND METHODS FOR ENHANCING BOOT COMFORT AND STYLE

REFERENCE TO RELATED APPLICATIONS

Any and all applications for which a foreign or domestic priority claim is identified in the Application Data Sheet as filed with the present application are hereby incorporated by reference under 37 CFR 1.57. This application claims priority to U.S. Provisional Patent Application No. 62/791,671, filed Jan. 11, 2019, titled Systems and Methods for Enhancing Boot Comfort and Style (Atty. Ref. No. BBARN.020PR) and U.S. Provisional Patent Application No. 62/842,111, filed May 2, 2019, titled Systems and Methods for Enhancing Boot Comfort and Style (Atty. Ref. No. BBARN.002PR2). The entire disclosures of each of the foregoing applications are hereby made part of this specification as if set forth fully herein and incorporated by reference for all purposes, for all that each contain.

BACKGROUND

Field

The disclosure relates generally to footwear with both functional and stylistic features, and some that fill both roles.

SUMMARY

Western work boots can have various features addressing comfort, style, and utility, as further described herein.

A boot can comprise, for example: an elongate shaft having an elongate axis configured to extend upward along the leg of a user, the shaft having lateral and medial portions with corresponding features, and two pull tabs secured to each elongate shaft, one on the lateral side and one on the medial side. The shaft can be further configured such that each of the lateral and medial portions is formed from a protective material and from a resilient material. Each of the lateral and medial portions can be formed primarily from protective material and can have at least one elongate opening therein extending generally parallel to the elongate axis of the elongate shaft. Each elongate opening can be spanned by resilient material that is secured to the inside of the elongate shaft using at least two rows of stitching that penetrate the protective material and extend up and down either side of the elongate opening. Each of the elongate openings can be configured to have a wider portion toward the top of the shaft and a narrower portion toward the bottom of the shaft, and each wider portion can be sized to fit behind a pull tab. Each pull tab can be further sized and configured to obscure the wider portion of the elongate opening and the resilient material that spans said opening. Each pull tab can be attached to the protective material adjacent to the elongate opening such that it obscures the wider portion thereof by wrapping around a top edge of the elongate shaft containing the elongate opening. The pull tab can be further configured to attach to the protective material on a single side of the elongate opening, thereby allowing the elongate opening to stretch and facilitate periodic entry and exit of a wearer's foot.

A system for enhancing boot comfort while maintaining style can comprise, for example, a boot having a shaft that rises up from a toe box and heel portion of the boot, the shaft primarily formed from a less resilient protective material decorated with multiple lines forming aesthetic designs, and a more resilient accommodating material integrated into the boot shaft as follows: The shaft can be separated into a forward portion, generally over the toe box. and a back portion, generally over the heel, with an opening between the two portions that extends from a top edge of the shaft downward toward a sole of the boot. The opening between the two portions can be very narrow, such that the two portions touch or are less than one centimeter apart, along more than half of its length. The opening between the two portions can be shaped and sized to complement the multiple lines decorating the protective material, such that the opening can be difficult to distinguish from such lines and not appear from a distance to be a functional opening in the protective material. The opening can further be spanned by the more resilient accommodating material, which can be secured to both front and back edges of the opening from within the shaft such that the resilient accommodating material is fully or mostly obscured by the less resilient protective material.

The system can further comprise a second opening, such that a pair of such openings can be formed on medial and lateral sides of the boot shaft, each having generally the same shape and construction, and each spanned in the same manner by more resilient accommodating material such that the two openings can be approximately symmetrical and can accommodate foot entry simultaneously from each side of the boot shaft.

The system can further be such that the less resilient protective material is leather.

The system can further comprise additional openings in the less resilient protective material of the boot shaft, such that the openings can be spanned by perforated or other material that can be configured to allow air to continually pass through said additional openings while maintaining the general shape and integrity of the boot shaft.

The system can be further configured such that the opening between the two portions and the resilient material that spans the opening are colored to further complement the multiple lines decorating the protective material and can obscure the functional difference between the opening and the decorative lines, thereby providing a stylistic camouflage for the opening.

The system can be further configured such that the opening has a wider portion at the top of the shaft. The wider portion can be configured to expand to a greater extent due to the greater width of resilient material spanning it. The wider portion can be physically obscured by a pull strap formed from the protective material. The pull strap can loops over the top edge of the shaft and can be secured thereto. The pull strap and wider portion can be configured to permit greater expansion of the opening as a wearer's heel passes through the shaft when a wearer dons or doffs the boot.

A work boot having comfort features can comprise: a rugged sole, a reinforced toe box, and a protective leather boot shaft that can extend upward from the top of the rugged sole to at least three times the height of the toe box. The shaft can have lateral and medial vertical slits that can terminate at the top of the shaft. Each slit can be fully spanned on the inside of the shaft by a resilient material that can be secured to the shaft such that the resilient material can be stretched during foot entry or exit but can resiliently return to its resting shape when not being stretched. Each slit can be obscured by at least one obscurement feature.

The work boot can comprise an obscurement feature that comprises a strap at the top of each vertical slit that obscures the top of the slit and folds across a top rim of the shaft. The strap can be secured to the boot shaft with a rotating securement feature such that the strap can be pulled and rotated by a user to exert generally upward force on the boot when a wearer pulls it on to their foot, which can cause a wearer's heel to pass down through the shaft to rest on an inner portion of the sole.

A method of providing and disguising comfort features in a western-style boot can comprise providing at least two of the following:

a) An elongate opening in the shaft of the boot that extends down from the top of the shaft. The elongate opening can be spanned by a resilient material that can be configured to allow the boot shaft to expand to accommodate entry or exit of a foot through the shaft and to return to a non-expanded state after entry or exit. The elongate opening can be sized, shaped, and/or positioned to blend into design lines visible on the outside of the shaft;

b) An additional elongate opening in the shaft of the boot that can extend from the top of the shaft. The additional elongate opening can be spanned by a resilient material that can be configured to allow the boot shaft to expand to accommodate entry or exit of a foot and return to a non-expanded state after entry or exit;

c) At least one pull strap that can be sized and configured to cover at least a portion of one or more of the elongate openings at the top of said opening where the opening can terminate at the top of the shaft;

d) At least one color and shape feature that can be incorporated into at least one of the elongate openings and can be configured to match other decorative color and shape features to camouflage the elongate opening;

e) At least one color feature that can be incorporated into the resilient material such that the resilient material can have a similar color to other decorative features and blends in therewith, even where an elongate opening is wide enough to reveal the underlying resilient material;

f) At least one opening in the material forming the shaft of the boot that does not extend from the top of the shaft and that can be spanned by a resilient material that can be configured to allow at least a portion of the boot shaft to expand to accommodate entry or exit of a foot and return to a non-expanded state after entry or exit; and g) At least one opening in the material forming the shaft of the boot that does not extend from the top of the shaft. The opening can be spanned by an air-permeable material that can be configured to allow air circulation such as an escape of air heated by a wearer's leg and ingress of outside air during use of the boot.

A method of providing and disguising comfort features in a boot can comprise providing an opening in a shaft of the boot that can extend from the top of the boot shaft at least half-way down towards a shoe box of the boot. The opening can be spanned by a resilient material that can be configured to allow the boot shaft to expand in response to pressure to accommodate entry or exit of a foot through the boot shaft and to return to a non-expanded state after said entry or exit. The opening can comprise an upper vertical portion and a lower curved portion, wherein the two portions are connected to one another and wherein a transition from the upper vertical portion to the lower curved portion includes a turn of approximately 90 degree in the shape of the opening. The opening can be further shaped and positioned to blend into design lines visible on the outside of the shaft of the boot.

The method can further comprise a pull tab at the top of the boot shaft that can include an inner and an outer portion which can extend down inside and outside of the boot shaft respectively. The pull tab can be positioned and sized to hang over and hide the top vertical portion of the opening and the approximately 90 degree turn in the transition of the opening. The inner and outer portions of the pull tab can be securely attached to the boot shaft below the approximately 90 degree turn in the transition of the opening. The pull tab can be pivotably attached to the boot shaft, which can allow a wearer of the boot to pull on the pull tab in a direction other than generally parallel to the upper vertical portion of the opening.

A boot can comprise an elongate resilient feature configured to provide greater stretch near a donning point where a heel can press against the back of a boot shaft. The elongate resilient feature can include an intermediate material configured to provide a manufacturing template for relative positioning between materials of the boot shaft.

The boot can further comprise at least one pull tab that can wrap around and extend over a top rim of the boot shaft and can be positioned to obscure and generally enclose a top portion of the resilient feature.

The boot can be configured such that the resilient feature can span an opening in the outward-facing portion of the boot shaft, and a corresponding resilient feature can be positioned within a lining of the boot shaft, such that it can span a corresponding opening in the lining of the boot shaft. The pull tab can obscure both of these resilient features near the top rim of the boot shaft.

The boot can be configured such that the pull tab can be leather and can be configured to rotate forward and back around an axis of rotation formed by a rivet that passes through the pull tab and the shaft of the boot. The boot can further comprise a dual shank system comprising a generally straight and elongate shank and a separate closed U-shaped shank located in a cushion midsole of the boot.

A western boot can comprise: a sole; above and connected to the sole, a shoebox that can be formed primarily from a durable material; and a shaft rising from the shoebox to a shaft top that can be open to receive a wearer's foot, the shaft can also be formed primarily from a durable material and incorporating resilient features such that:

a shaft front portion can generally face forward, a shaft back portion can generally face backward, elongate medial and lateral openings in the durable material of the shaft can form two openings in a rim at the shaft top, each extending vertically down from the shaft top, separating the shaft front portion from the shaft back portion, and two portions of resilient material that can form resilient features, one medial and one lateral, such that each can span one of the medial and lateral openings to resiliently connect the shaft front and back portions, where the resilient features can be shaped and configured to provide a widest separation at a specific vertical level that can ease the tightest transition point for foot entry.

The western boot can be configured such that the specific vertical level can comprise a donning point, the donning point occurring in the shaft back portion where a user's heel contacts the shaft interior during foot entry, while the same foot is simultaneously contacting the interior of the shaft front portion with a top foot surface at a doffing point where the shoe box transitions to the shaft. The western boot can be configured such that the resilient features can each comprise two angled linear portions that converge at the vertical level of the donning point and can each comprise a lower linear portion thereof that can terminate near the doffing point.

The western boot can comprise a lateral space between the front and back shaft portions that can be greatest at the vertical level of the doffing point even when the shaft is in a relaxed position prior to or after foot entry or exit.

The western boot can be configured such that the elongate medial and lateral openings each terminate above an upper limit of the shoe box at a waterproof line, thereby maintaining a waterproof aspect of the boot.

The western boot can be configured such that the two portions of resilient material can be formed from waterproof elastic, thereby enhancing waterproof performance of the boot.

The western boot can further comprise a moldable material formed on the resilient material such that the moldable material can protrude from a surface of the resilient material to establish an edge configured to seat against a corresponding edge in the durable material, thereby positioning the resilient material with respect to the medial or lateral opening prior to seam stitching and improving manufacturing consistency.

The western boot can be configured such that the moldable material can be formed from KRYPTANE polyurethane (KPU) and the resilient material can be elastic.

The western boot can be configured such that the moldable material can provide an overlapping layer positioned between the durable and resilient materials at seam lines extending along the edges of both the front and back shaft portions bordering the elongate openings.

The western boot can be configured such that the moldable material can span the entire width of both medial and lateral elongate openings at a lower end of these openings and can thereby enhance strength, resilience, and waterproof properties of the boot.

The western boot can further comprise a boot lining formed inside the shaft, such that the lining can have elongate lining openings that can run parallel to and generally match the size and shape of the elongate medial and lateral openings in the durable material of the shaft. The elongate lining openings can also be spanned by resilient material such that two layers of resilient material can act together, one on the medial side of the shaft and one on the lateral side of the shaft, which can allow temporary widening of the shaft and lining openings during foot entry and exit.

The western boot can further comprise medial and lateral pull tabs formed from durable material that can be secured to the shaft and configured to wrap around the rim at the shaft top, which can thereby obscure the opening in the rim.

The western boot can further comprise medial and lateral pivot fasteners that secure the pull tabs to the shaft while allowing the pull tabs to pivot slightly frontward and backward along the boot rim.

The western boot can further comprise a dual shank system that can comprise a generally straight and elongate shank and a separate closed U-shaped shank, the closed U-shaped shank can be located in a cushion midsole of the boot such that at least a portion thereof can be externally visible.

A method of manufacturing a boot having resilient features can comprise: providing durable and resilient materials for a boot shaft; cutting out rear and front portions of durable material for the boot shaft; cutting out medial and lateral resilient materials for the boot shaft; molding a moldable material onto each of the medial and lateral resilient materials using a mold template such that the moldable material can protrude from a surface of the resilient material and can establish an edge configured to seat against a corresponding edge in the durable material; using the edge of the moldable material to position the resilient material with respect to the medial or lateral opening prior to seam stitching; and stitching a seam along the edge of the durable material while the moldable material can help to hold the position of the resilient material with respect to the durable material.

The method can further comprise: molding the moldable material such that it can form a flatter, less protruding portion along the full edge of the resilient portion and can provide a flatter ledge portion configured to receive the edges of the durable material; positioning durable material on the ledge portion; and sewing a robust seam through the durable material and through the moldable material and through the resilient material, which can further secure all three materials together along a seam at the edge of the medial and lateral openings.

BRIEF DESCRIPTION OF THE DRAWINGS

FIG. 18A2 is a line drawing of a photographic image of the boot of FIG. 18A.

FIG. 18B2 is a line drawing of a photographic image of the boot portion described with reference to FIG. 18B.

FIG. 18C2 is a line drawing of a photographic image of the bottom area of the resilient panel described with reference to FIG. 18C.

FIG. 18D2 is a line drawing of a photographic image of the area of the boot described in FIG. 18D.

DETAILED DESCRIPTION

General Considerations Regarding Boots and Boot Shafts

Figure 1:
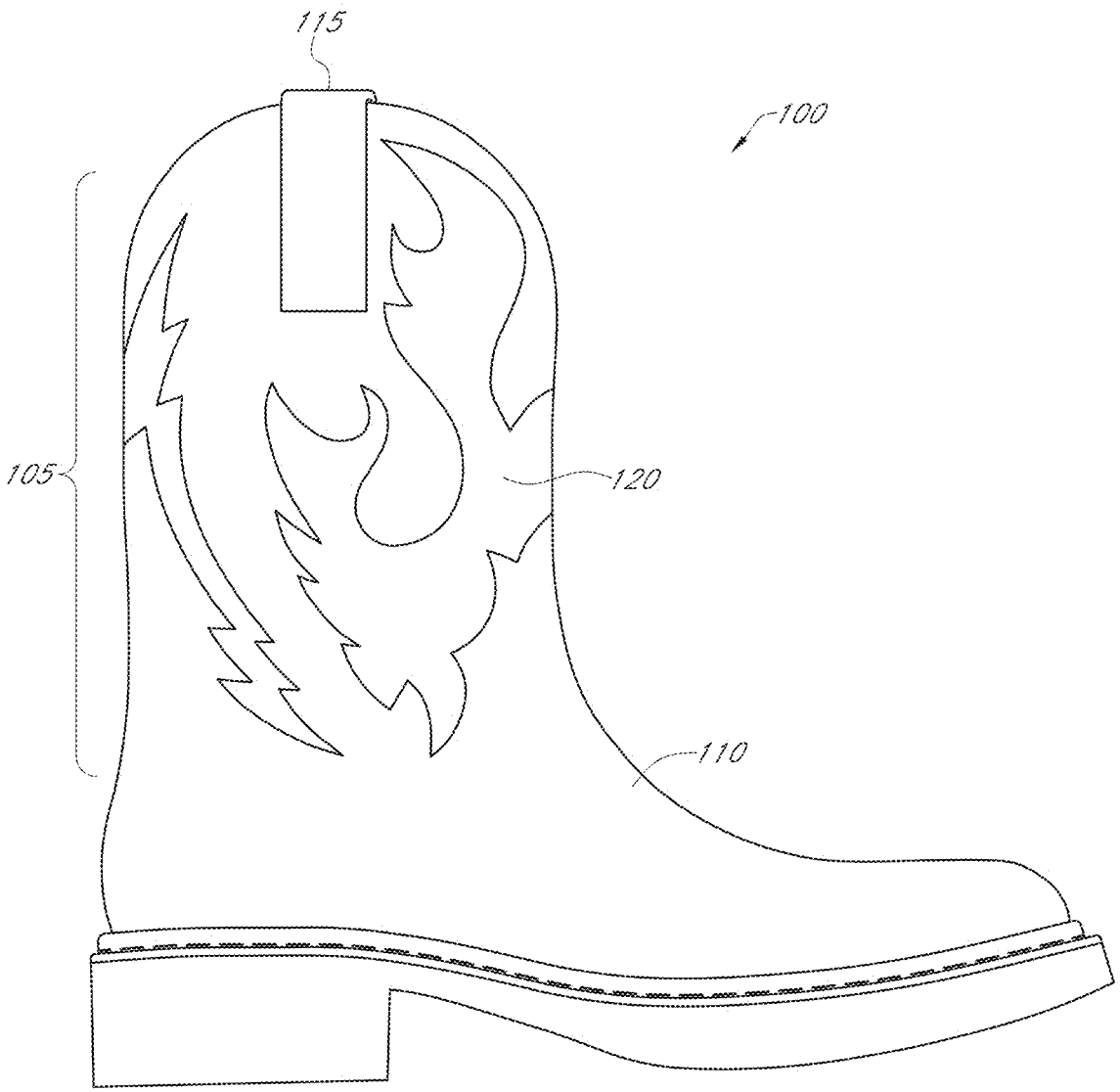
FIG. 1 shows a boot having various features.

Footwear that covers and extends upward from a wearer's ankle can be generally classified as a boot. FIG. 1 shows one example of a boot 100. An elongate portion of the boot that extends upward from the wearer's ankle and that encloses the wearer's ankles and at least a portion of the wearer's shin and calf is frequently known as the shaft 105 of the boot 100, while the portion of the boot 100 that contains the wearer's foot during use is often referred to as the shoe box 110 or toe box (with its upper portion referred to as the vamp).

Some boots include features for opening and/or closing the boot shaft in order to let the wearer's foot pass into and out of the boot. Other boots include a pull-on design and have a continuous closed circumference of the shaft 105. For these boots, the wearer simply slips the foot through the boot shaft 105 and into the shoe box 110 in order to put the boot 100 on, or vice versa to remove the foot from the boot. The closed-circumference shaft can be very useful and protective, but it can also cause difficulty and discomfort because of the constraints it may place on a wearer's foot when inserting the foot into or extracting the foot from the boot. This discomfort may be heightened if a wearer's ankle is not flexible or is swollen from work or exertion.

Mechanisms such as buttons, buckles, zippers, laces, etc. can be provided to loosen and tighten the shaft 105 of the boot 100, alternately allowing passage of the wearer's foot when pulling the boot 100 on or off and securing the shaft 105 of the boot around the wearer's leg during use so that the wearer's foot does not inadvertently slip out of the shoe box 110. Such hardware can cause unwanted risks or provide unwanted additional weight to the boot.

Some pull-on boots include pull straps 115 that provide the wearer with a place to grip the boot 100 and to apply upward pressure on the boot 100 in a direction perpendicular to a plane defined generally by the sole of boot 100, while at the same time applying downward pressure into the boot shaft 105 with the foot and leg that the wearer wants to insert into the boot 100. A pull strap 115 may comprise a small strap, made of leather, canvas, or another sturdy material, and having two ends that extend over a top edge of the boot shaft 105, with approximately one-half of the pull strap's 115 length extending down inside the boot shaft 105 and a second approximately one-half of the pull strap's 115 length extending down outside the boot shaft 105, where both ends of the pull strap 115 are attached with a sturdy connection to the boot shaft 105. Frequently, the pull strap 115 is attached to the boot shaft 105 only horizontally across the two ends of the pull strap 115, such as with one or more lines of stitching, while the vertical edges of the boot strap 115 are not attached to the boot shaft 105. This design can allow for fingers to be inserted inside the loops of leather formed by this feature, for example.

Pull-on style boots may be preferred by wearers for their simpler design, lack of external mechanisms that can break and/or catch onto objects in the wearer's environment, and for stylistic reasons. Western-style boots with tall and medium height shafts can also be used as work boots, especially if they have reinforced toe boxes, thicker soles, and other useful workplace protections and supports. Pull-on work boots can include cowboy boots and Wellington boots, for example. For simplicity of description in this disclosure, "pull-on style boots" will frequently be referred to as "cowboy boots". Among other characteristic features, cowboy boots may include decorative embroidery or applique or other decoration 120, sometimes called quarter stitching, especially on the shaft 105 and vamp of the boot 100. However, it is to be understood that the term "cowboy boot", as used in this disclosure is not meant to exclude other types of pull-on boots. Furthermore, the systems and methods disclosed herein may also be employed on boots or other footwear that include mechanisms or contrivances for loosening and tightening the boot shaft 105.

Figure 2A:
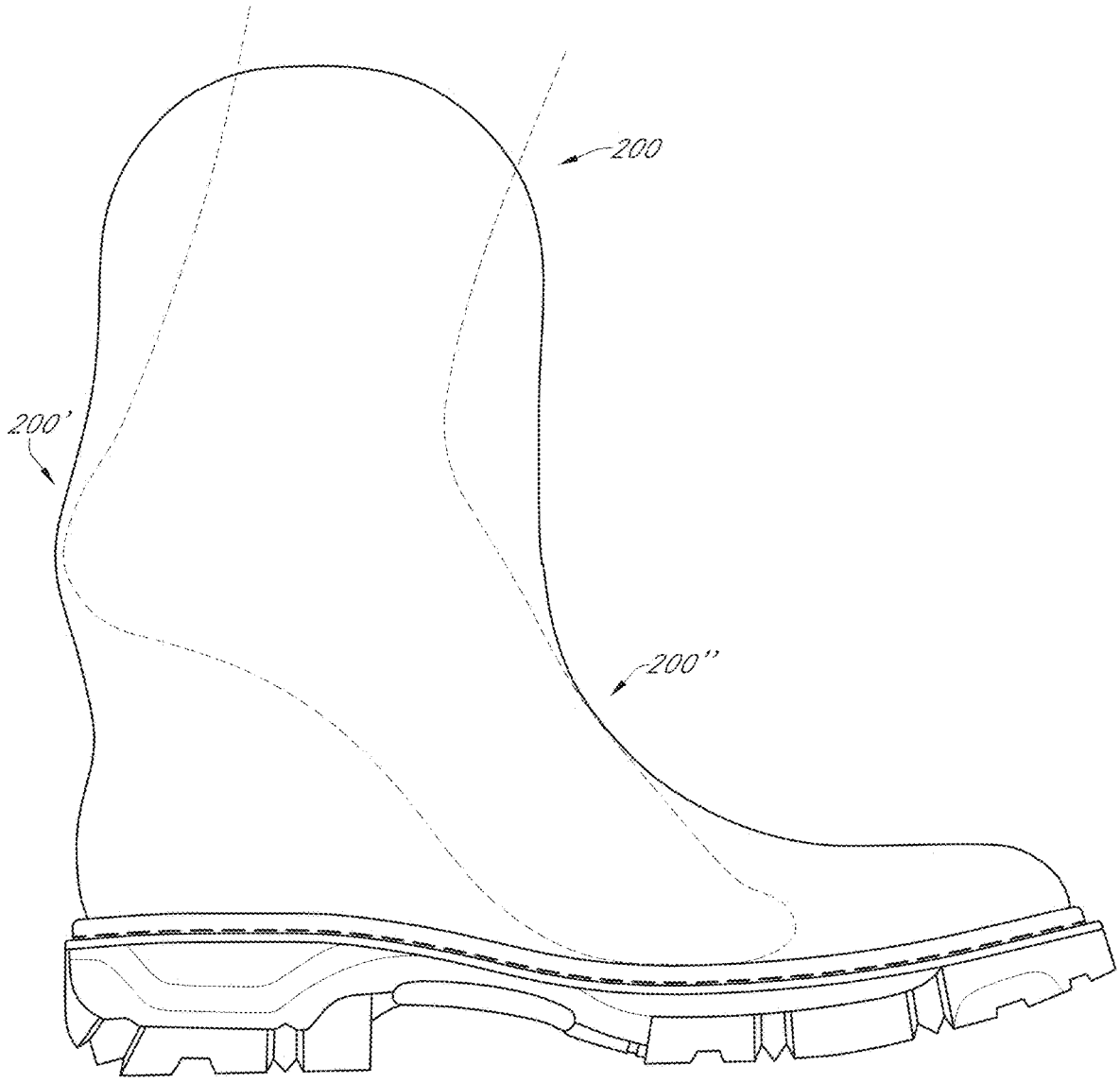
FIG. 2A shows a schematic cross-sectional view of a wearer's foot passing into a boot through the shaft of a boot.

FIG. 2A shows a cross-sectional schematic view of a wearer's foot passing through the shaft 105 of the boot 100, as well as the general locations of some pressure points 200, 200', 200" where the boot 100 can exert pressure on the wearer's foot and shin, and vice versa. In FIG. 2A, the boot 100 is shown as deforming to some extent at pressure points 200, 200', 200". However, cowboy boots for horseback riding, work, or other rugged environments, as well as boots styled to aesthetically resemble such boots (at least on the surface), are often made of leather or other durable, tough, protective, and non-elastic materials that can withstand a high level of wear-and-tear and can protect the feet and lower legs of the wearer. Boots made of such durable, tough materials may therefore not allow for much deformation and resilience at the pressure points 200, 200', 200" in the boot shaft 105, making it harder for the wearer's foot to pass through the shaft 105.

Figure 2B:
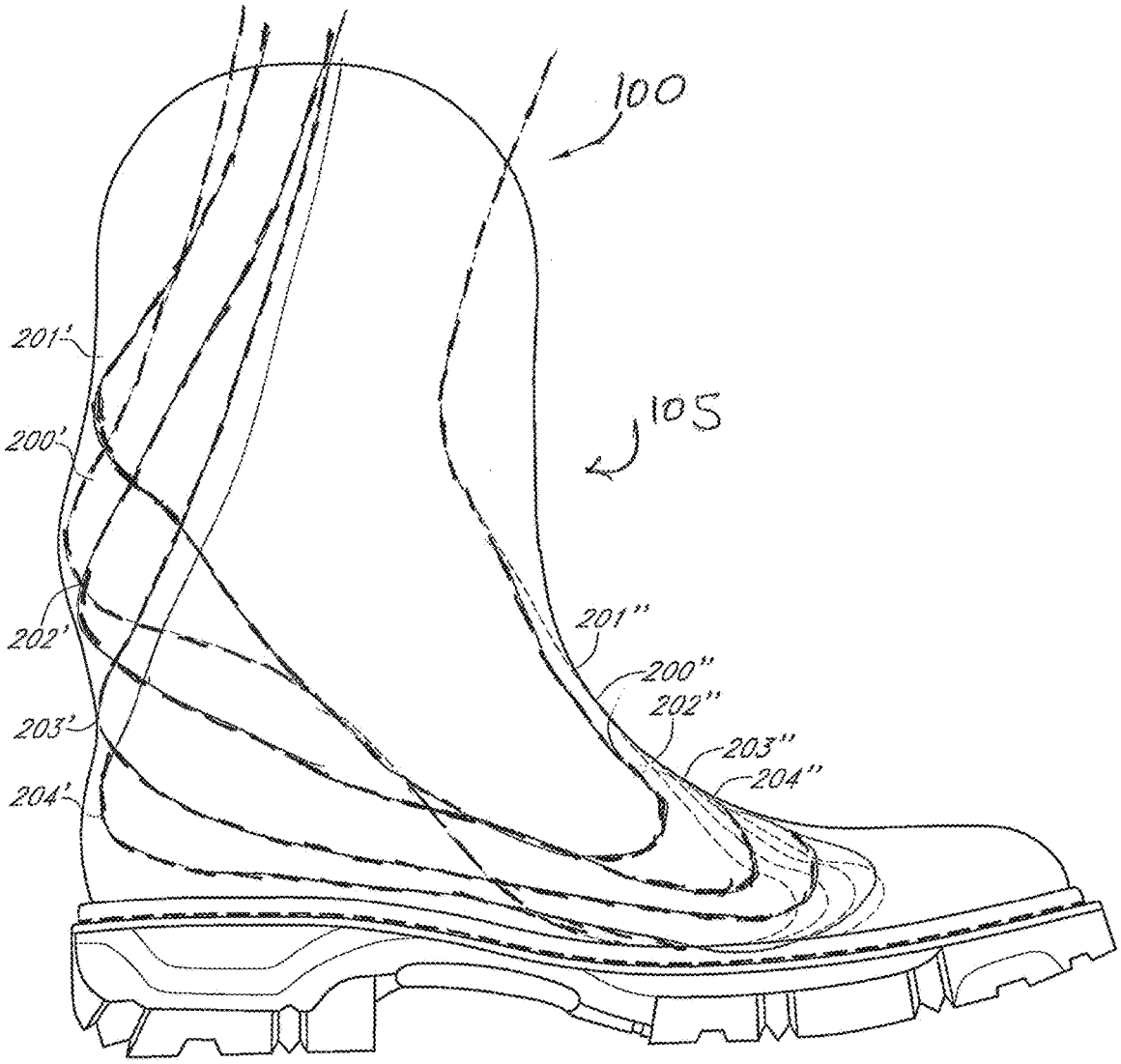
FIG. 2B shows a schematic view of a foot entering a boot, with several contact points noted in the front and back as the foot descends.

FIG. 2B shows a schematic view of a foot moving into or out of the boot 100, with several other possible contact points 200", 201", 202", 203", 204", 200', 201', 202', 203', 204' noted at the front and rear of the boot shaft 105 as the foot moves into or out of the boot 100, showing that resiliency in the boot shaft 105 can be advantageous a different locations along the boot shaft.

In order to allow for the passage of the wearer's foot, and especially the heel of the wearer's foot, into and out of the boot 100, the shaft 105 of cowboy boots 100 can be designed to be wide enough to allow for this passage. A wider shaft 105, meaning a shaft with a larger circumferential opening or passageway, can allow for an easier passage of the foot into and out of the boot 100. However, a wider shaft 105 may also fail to keep the wearer's foot securely in place within the shoe box 110 during use, allowing the heel of the wearer's foot to move up and down within the enlarged space. This movement can be uncomfortable, unsafe, and/or can lead to the formation of blisters on the wearer's foot. Additionally, a wider boot shaft 105 may make the wearer less agile and can provide an opening at the top of the boot 100 for environmental items and/or liquids to fall into the boot 100, both of which could be dangerous and/or uncomfortable in a rugged environment. Furthermore, a wearer who chooses to wear their cowboy boot tucked inside the leg of their pants may find that a boot 100 with a wider shaft 105 makes fitting the top of the boot into the pants leg harder to accomplish and/or less visually attractive. For these and for other safety and/or aesthetic reasons, a pull-on boot 100 having a shaft 105 with a slimmer circumferential profile may be preferred.

To resolve the issues of comfort, style, and utility described above, the circumference of the shaft 105 can be allowed to both expand (allowing passage of the wearer's foot while putting on and taking off the boot 100) and then to contract back to a narrower profile for wearing and use of the boot 100. Various such resilient or elastic approaches are described herein.

Options for Shaft Expansion

One way to provide expansion in the shaft of a boot 100 while maintaining a simple, clean, and continuous circumference of the boot shaft 105 can be to replace, augment, or associate one or more portions of the durable, protective material that makes up the shaft 105 of the boot 100 with a more deformable and elastically resilient material or materials. When effectively associated or integrated, the elastic material can allow for temporary expansion of the shaft 105 to ease passage of the heel and foot through the shaft 105 and into the shoe box 110. Once the foot is through the shaft 105, the elastic material can then contract once again to allow the circumference of the shaft 105 to return to a narrower shape around the leg and ankle of a user after the foot and heel have passed through. Furthermore, elastic material inserted into the boot shaft 105 can provide the boot shaft 105 with a slim or smooth profile and reduce a need for extra hardware that could catch onto anything in the wearer's environment.

Boots and their shafts can be constructed using different materials. Many western and work-style boots use leather for its strength and longevity. Although leather is typically not as resilient as more rubberized or elastic materials, leather can be cut and sewn strategically together with more elastic materials to create convenient opening features in the leather. As discussed above, these features can be designed to remain open temporarily to expose elastic portions thereof and then close to return to an unopened state. This can provide stylistic benefits and avoid potential drawbacks from the way such comfort features may be viewed from an aesthetic perspective.

Figure 3:
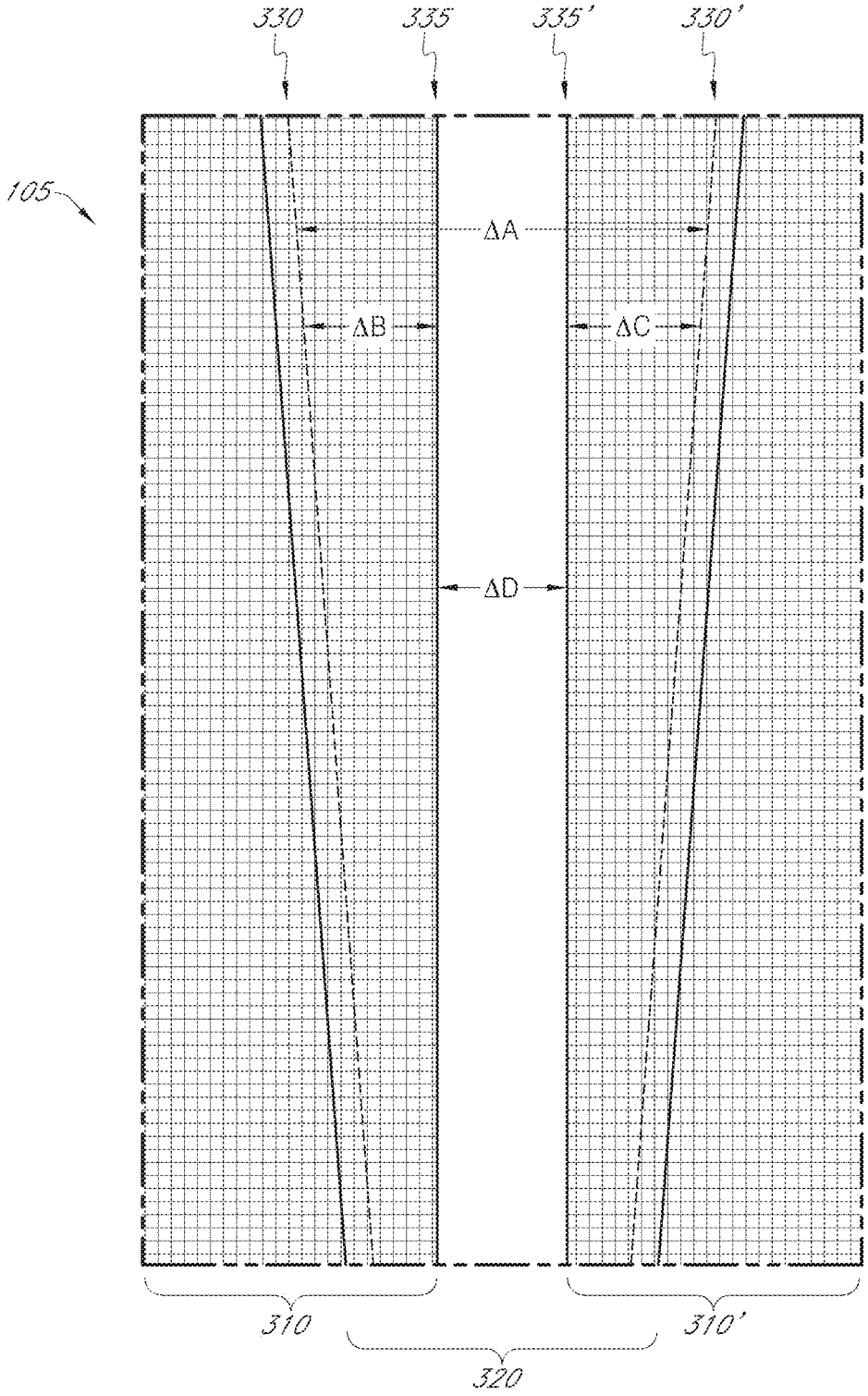
FIG. 3 is a schematic diagram illustrating features and parameters related to boot shaft expansion.

FIG. 3 is a schematic diagram which provides a framework for terminology and concepts that will be discussed throughout this disclosure. FIG. 3 can represent an exterior portion of a boot shaft 105 in which a panel 320 of a deformable and elastically resilient material is located behind an opening between two sections of more durable, stretch-resistant (e.g., leather) boot material 310, 310' in the boot shaft 105. The panel 320 can fill the role of a resilient feature that can be incorporated into the shaft in different ways. Various different types of fabrics can fill this role. "Adaptive Shaft Engineering" (or "ASE") can be used as a trademark to refer to some or all of the methods and structures described herein to incorporate resilient features into footwear (e.g., boots) in useful ways to benefit users and manufacturers. For example, structures and techniques are disclosed for improving comfort, strength, and manufacturing and/or assembly processes. As a shaft adapts, it can do so dynamically and/or resiliently using the materials that are shaped and/or integrated as described herein.

A boot maker may wish to provide more expansion in the boot shaft, especially around the top of the boot shaft, than can be provided by a long thin resilient feature. In some embodiments, a resilient feature is cut to be wide at a top portion of the boot shaft and narrower toward the bottom, which may be a more visible portion of the boot shaft when the boot wearer wears a pair of pants or a long skirt over the boot shaft. Such a tapered approach is schematically represented in FIG. 3.

The resilient feature 320 is frequently attached to the non-resilient portions 310, 310' of the shaft 105 with lines of stitching 330, 330' that penetrate the shaft 105, and/or staples, glue, or other robust means for attaching. In FIG. 3, ΔA can represent a distance between two lines of stitching 330, 330' that secure the resilient panel 320 to the durable material 310, 310' of the boot shaft 105. The extent to which the resilient panel 320 can stretch and allow for expansion of the boot shaft 105 is dependent, at least in part, on the width illustrated as ΔA, as well as the properties of the resilient panel 320. One way to maximize elastic stretch and circumferential expansion/contraction of a boot shaft 105, therefore, can be to maximize ΔA.

However, although inserting a resilient panel 320 of an elastic material into a boot shaft 105 can allow for circumferential expansion and contraction of the boot shaft 105, the use of such resilient features 320 is not always stylistically compatible with the popular image of a cowboy boot or other pull-on style work boot 100. In much the same way that an elastic waistband used on denim jeans or other pants may lower the stylistic prestige of the pants, a large or very conspicuous resilient panel in a cowboy boot 100 may, to some wearers, lower the stylistic prestige of the boot 100 or be viewed as a gusset style more suitable to be worn only by females.

Thus, in some embodiments, Western, work, or Wellington-style boots 100 may maximize boot comfort by maximizing expansion available in the shaft 105 of the boot using a resilient panel 320 to fill or replace the material from an elongate opening in the boot shaft 105, while also maintaining desired style by minimizing and/or camouflaging a visible amount of the resilient panel 320 in the shaft of the boot.

Referring once again to FIG. 3, the resilient feature 320 is shown as being attached to the adjacent parts 310, 310' of the boot shaft 105 with stitching lines 330, 330' that are set back (e.g., by distances ΔB and ΔC) from a medial edge 335, 335' of the durable material 310, 310' (e.g., leather or another less stretchy material). ΔB and ΔC represent the widths of edges or flap portions of the durable material 310, 310' of the boot shaft 105 that extend medially over the resilient panel 320 past the stitching lines 320, 320' and toward a vertical center line of the resilient panel 320 (not shown), thereby covering portions of the resilient panel 320. The ΔB and ΔC portions of the adjacent parts can therefore serve to camouflage or obscure a portion of the resilient panel 320. ΔD labels a width of the resilient panel 320 that is not hidden by the flaps of the durable material (which arises because, in this schematic illustration, $\Delta B+\Delta C<\Delta A$. One way to improve style of a boot 100, therefore, can be to minimize ΔD, thereby hiding or minimizing the externally visible portion of any resilient panel 320. In this schematic figure, ΔA ΔB+ΔC+ΔD (at a given height along the vertical axis). Thus, a gap ΔD can be minimized by reducing ΔA and/or by increasing ΔB and/or ΔC. However, as ΔB and ΔC increase, the tendency of the material that forms these flaps may tend to curl or flap outwardly and/or catch on extraneous objects. Thus, hiding a resilient panel behind very large leather flaps that extend from either side can have design and functional drawbacks. These drawbacks can be addressed by overlapping ΔB and ΔC such that one flap tends to contain or restrain the other flap, but this partial solution does not resolve any tendency of the outer, restraining flap to extend or flap outward. An alternative way to obscure a resilient panel is to add an additional leather feature that is secured to either 310 or 310', or to another portion of the durable material, and extends over any gap ΔD. Such features are disclosed and discussed further herein.

Effectiveness of a resilient panel 320 can be enhanced by configuring it to extend farther lengthwise along the vertical axis. Thus, even if an elongate panel 320 is thin (minimizing the ΔA and/or ΔD factors, for example), the panel 320 may extend far enough vertically down the boot shaft 105, starting at the top, that it can provide some room for expansion at some or all of the pressure points 200, 200', 200" shown in FIG. 2 as the wearer's foot moves down or back up the boot shaft 105. Furthermore, since pressure point 200', which may receive maximum pressure from the wearer's heel as the foot passes through the boot shaft 105, is located toward the back of the boot shaft 105, locating at least a part of the resilient feature 320, toward the back of the boot shaft 105, and curving the resilient feature 320 to mimic the curve of the wearer's heel (or increasing the width ΔA of such a resilient feature at the vertical level corresponding to the place a heel will strike when an inserted foot is most fully constrained) can increase the ability of the resilient feature 320, even if thin, to provide expansion of the boot shaft 105 at a highly relevant and effective location.

Accordingly, the present disclosure contemplates various combinations of widths and distances ΔA, ΔB, ΔC, and ΔD, in addition to varying lengths, shapes, and materials for the roles illustrated by 310, 320, and 330 of FIG. 3. These parameters can be configured to address the general problems and constraints illustrated by FIG. 2. In particular, it can be helpful to increase ΔA at some vertical levels where maximum stretch is warranted, while minimizing ΔA at some vertical levels where less stretch may be desired, all the while balancing the obscuring/style benefits of ΔB and ΔC (at various vertical levels) with the potential drawback of having flaps extend too far from their stitching lines 330 and 330'. These competing considerations can be balanced and optimized in different ways illustrated below.

A long thin resilient feature 320, which may sometimes be visible as merely a slit of resilient material, can provide expansion and ease of passage of a foot down the boot shaft while also potentially minimizing conspicuous departure from conventional stylings, especially in Western-style boots. In some embodiments, long, thin resilient features 320 may be curved or angled to visually integrate with and even be obscured, disguised, and/or camouflaged into surrounding decorative ornamentation on the shaft of such a boot.

Additionally, in some embodiments, the visibility of long thin resilient features 320 can be further minimized by installing the resilient feature in the boot shaft such that flaps of the boot shaft material cover the resilient feature from one or both sides. Using the framework of FIG. 3, this would occur when the value of ΔD approaches 0. When the flaps come from both sides of the resilient feature, they can sometimes be preferred to meet over a centerline of the resilient feature when the resilient feature is in a non-expanded configuration. Then, when the resilient feature is in an expanded configuration (such as when the wearer's foot is passing through the boot shaft), the two flaps can be pulled apart from one another, causing a temporary visibility of the resilient feature as ΔD temporarily increases.

The use of flaps is especially suitable for narrow resilient features. because, to provide coverage of the resilient feature while still allowing the resilient feature to expand, the resilient feature and each flap are sewn together, or otherwise joined, at one outer edge of the resilient feature. The distance from the outer edges to the midpoint of the resilient feature is covered by the flaps, which are each attached to the resilient material on only one side. If that distance is large, the flap will be large, which may allow the flap to extend outwardly from the normal circumference of the boot shaft. Thus, some embodiments of a boot 100 provide a balance that maximizes ΔA toward the top of a shaft to improve foot comfort and access, while minimizing ΔD at lower portions of the boot shaft to improve style, all the while also balancing a desire to maintain a reasonably small ΔB and ΔC to avoid the drawbacks of material flapping outward.

Figure 4:
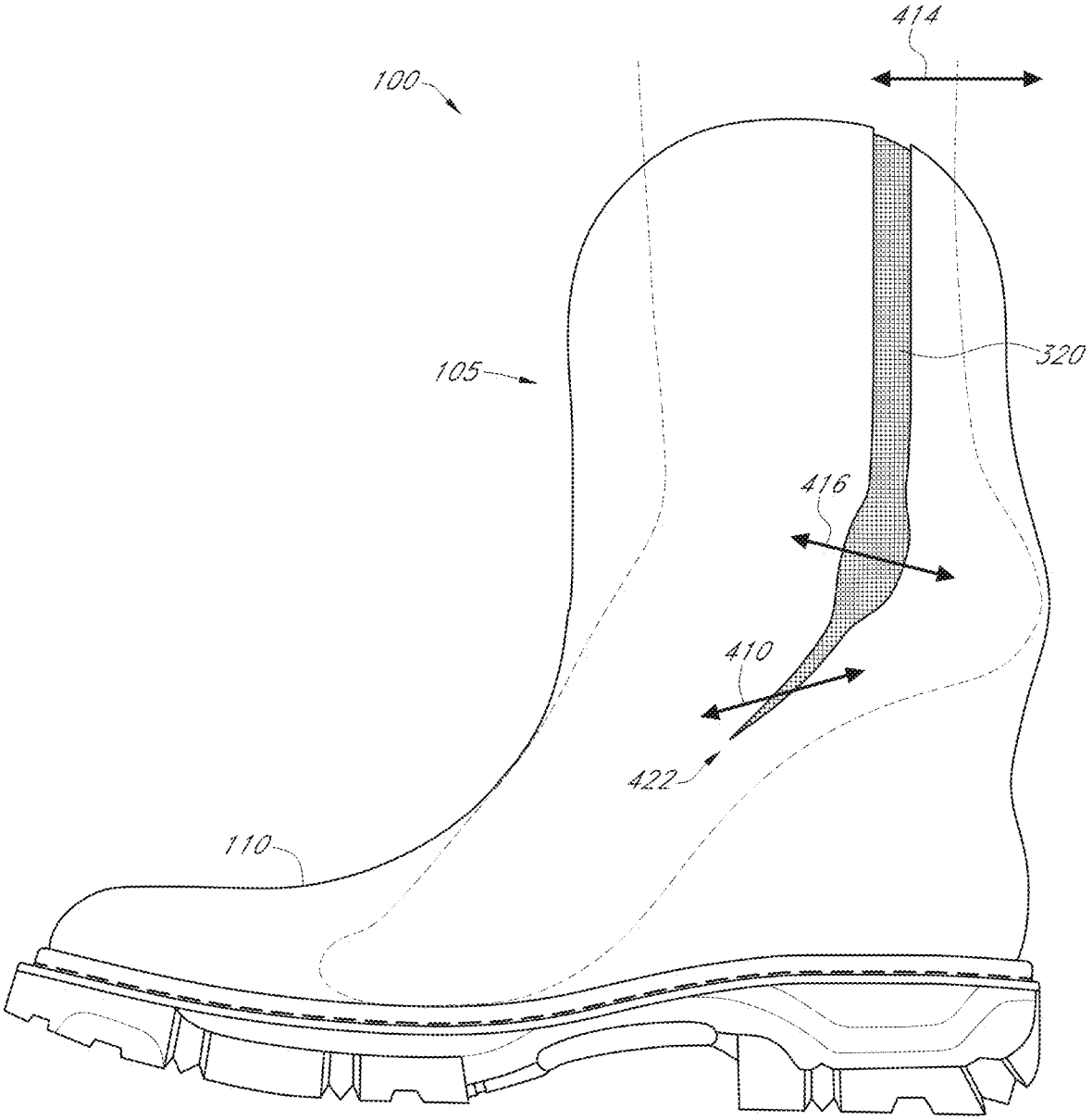
FIG. 4 is a schematic diagram illustrating how a foot penetrating a boot through the shaft can be aligned with features of a resilient portion thereof.

FIG. 4 shows one example of a boot 100 where the resilient feature 320 extends in a curved and tapered shape from the top of the boot shaft 105 town toward the shoe box 110, generally tracing or reflecting the curve of the wearer's heel as it is inserted into the boot. Various types of fabrics are commercially available that can file the role of the resilient feature, depending in part on the preferences of the boot manufacturer. For example, some fabrics are woven, having a perpendicular warp and a weft that may limit the amount of stretch provided by the fabric. Such woven fabrics may provide stretch along the warp and weft, especially if the fabric is woven at least partially of fibers that are stretchy. Typically, woven materials provide their greatest amount of stretch along an axis that is diagonal to the warp and weft and is known as the bias. Other fabrics are knitted and are produced from a long thread that is looped through itself to form a sheet. Knits form a stretchy material because the loops can change shape under force, even if the fibers themselves are not elastic. They can be stretchy in one axis (often called 2-way stretch) or in both axes (often called 4-way stretch). Woven, knitted, and other fabrics, depending on how they are manufactured, can provide different types of stretch along different axes and can further provide other properties, including being breathable and/or water resistant.

A stretch axis of the resilient material 320 can be aligned in various ways as further discussed herein. In some embodiments, a boot maker may choose to orient the axis of the resilient material that can stretch to the greatest extent to be parallel with an axis 410 generally perpendicular to the place at which a heel contacts the back of the boot shaft and is most likely to push within the shaft upon insertion of the foot. A maximum stretch axis 414 of the resilient material can also or alternatively be oriented along an axis that is perpendicular to the elongate axis of a boot shaft 105.

As shown in FIG. 4, an opening for a resilient feature 320 need not extend in a straight line and can have different widths at different heights along the shaft. Thus, this figure illustrates some of the options and parameters discussed more generally with respect to FIG. 3. The resilient feature 320 can expand locally (see axis 416) near where a user's heel exerts pressure on the inside back wall of the shaft (in opposition to the top of a user's foot that may be exerting pressure on the inside of the shoe box 110). Alternatively or additionally, the resilient feature can allow the shaft 105 to widen along its length. If an elongate feature is provided along both left and right sides of a boot shaft 105 (such that the feature shown in this view is mirrored on the far side of the shaft), the front of the shaft 105 can tend to pivot forward and begin to rotate generally about the points 422 at the lower extremity of each resilient feature 320. Thus, in some embodiments and under some user conditions, a portion of the resilient feature 320 toward the top of the shaft 105 can expand to a greater degree. This can be facilitated not only by the pressure exerted by the back of a user's heel, but also by grasping the top of the boot and pulling back on the back of the shaft or by pulling forward on the front of the shaft. These grasping forces can be combined to pull in an opposite direction from the pressure exerted by the heel, thus tending to open the top of the boot shaft while a foot pushes downward and inward, with the resilient feature 320 adding to the comfort of a user's foot during this activity.

Integration of Resilient Features with Design Elements

Figure 5:
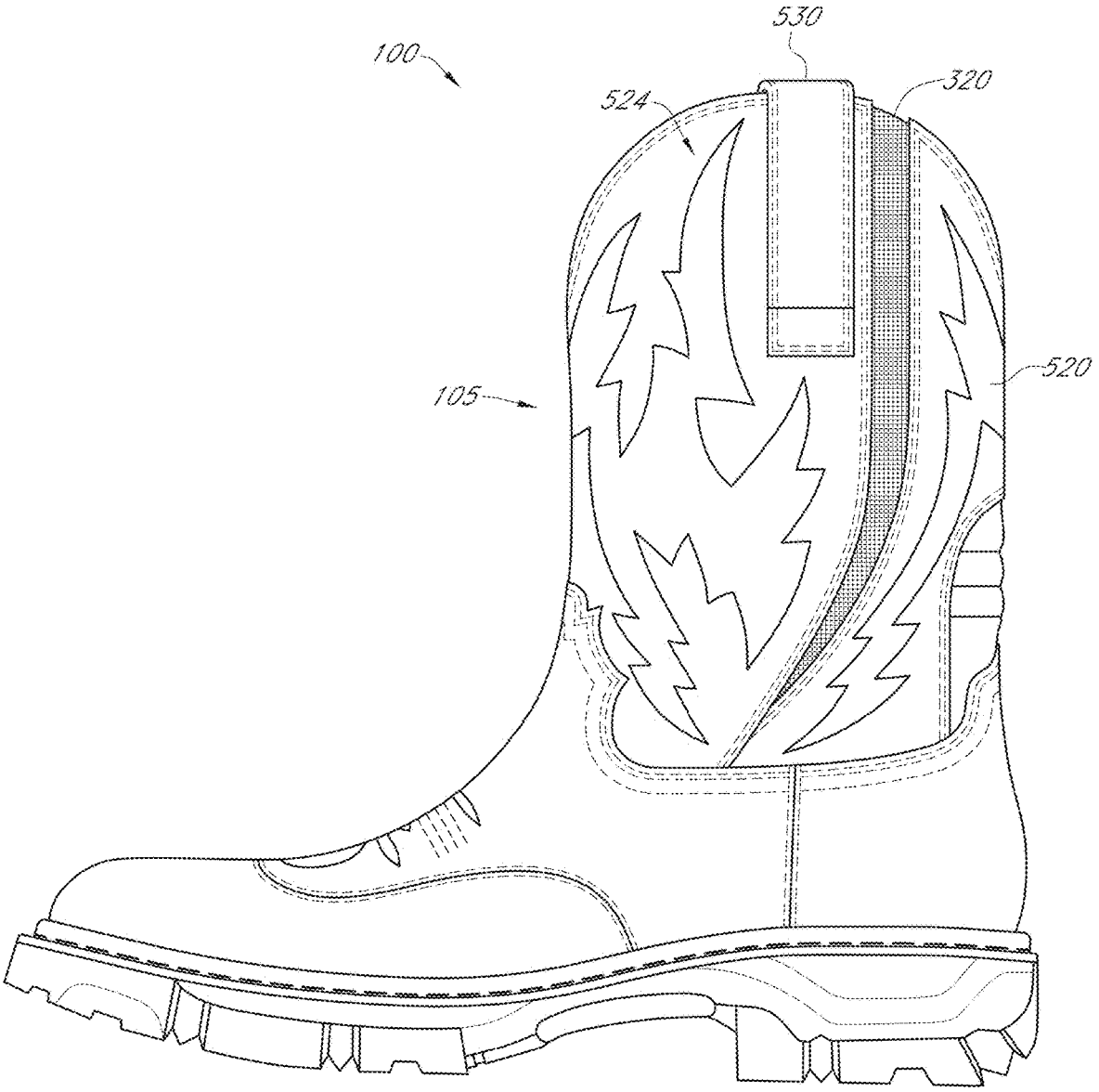
FIG. 5 shows an example of a cowboy boot with a curved and tapered resilient feature.

FIG. 5 shows an example of a cowboy boot 100 with a resilient feature 320 similar to the one illustrated in FIG. 4. In this example, the curve of the resilient feature 320 is somewhat camouflaged and/or integrated into the overall design and construction of the boot shaft. For example, two rows of top stitching generally outline the leather portions of the boot shaft, including on either side of the resilient portion 320. A jagged design 520 curves behind the resilient portion and generally follows its contour. Similarly, a correlated jagged design 524 located on the front of the shaft 105 fits within and along the resilient portion 320 and frames a pull tab 530. The vertical lines of the pull tab 530, which are a familiar feature in cowboy boots, can also help to integrate the vertical lines of the upper portion of the resilient portion 320.

Figure 6:
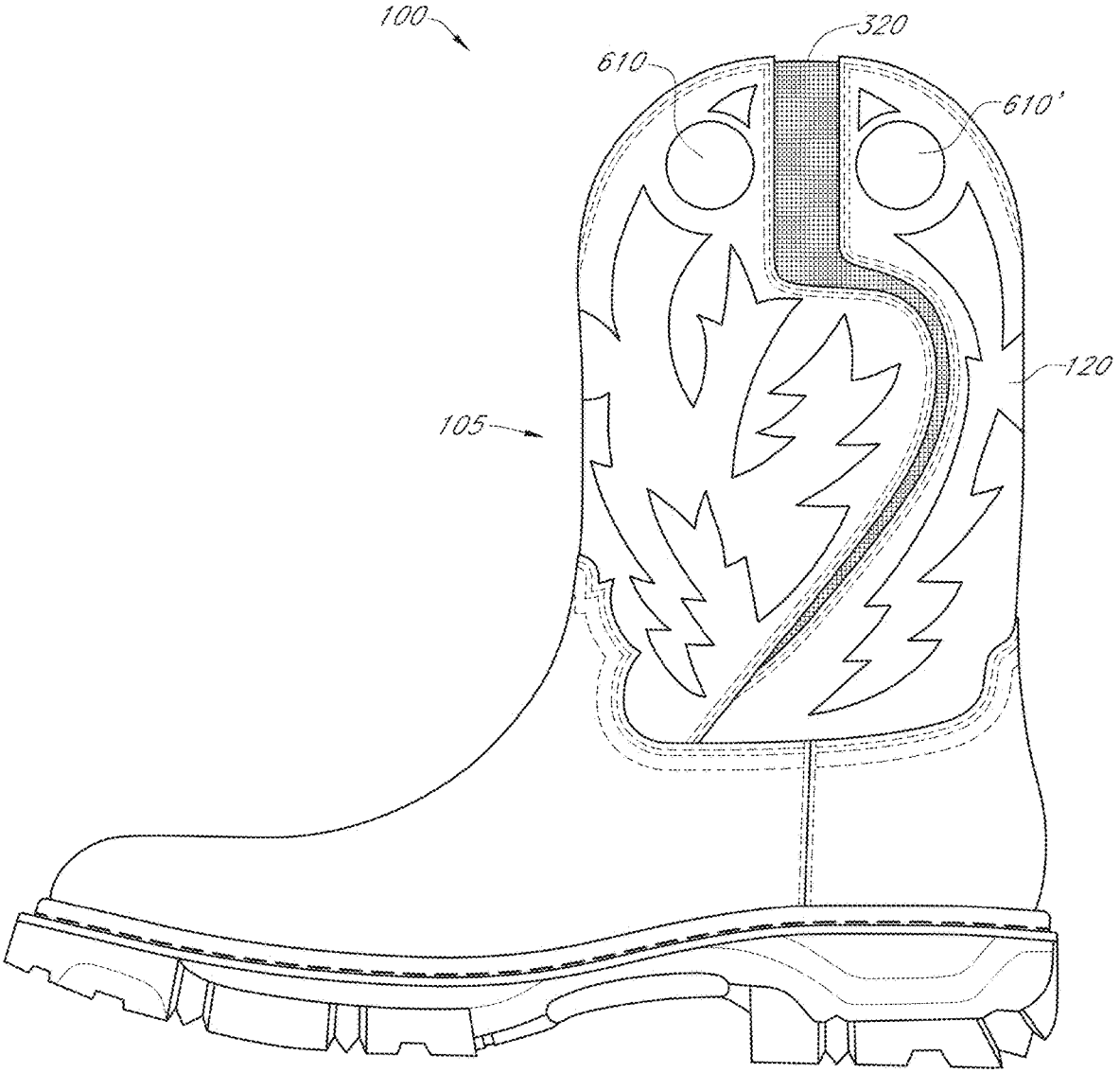
FIG. 6 shows an example of a cowboy boot with a resilient feature having straight and curved portions with various widths.

FIG. 6 shows another example of a cowboy boot 100 with a resilient feature 320. In this example, the exposed width of the resilient feature 320 ΔD (see FIG. 3) is large at the top of the boot shaft 105 where an upper vertical portion of the resilient feature 320 is straight and thick. Partway down the boot shaft 105, the path of the resilient feature 320 bends to make a generally 90° turn toward the rear of the boot shaft 105, which serves as a transition to a curved lower portion of the resilient feature 320 where its width ΔD decreases significantly for the remainder of the resilient feature 320. In some embodiments, this thinner portion of the resilient feature may have an exposed ΔD measurement of one centimeter or less. Continuing along the length of the resilient feature 320, it then swoops again downward and integrates or dovetails with the decorative stylings of the quarter stitching 120. The resilient feature 320 terminates in a seam where the (often leather) front and back portions 310, 310' of the shaft 105 merge before being covered by another panel of material enclosing the shoe box of the boot 100. In the example seen in FIG. 6, the approximately 90° turn is located approximately ⅓ of the way down from the top of the shaft 105 and the resilient feature 320. Thus, the narrower exposed portion of the resilient feature in this example extends for more than half its length. In some embodiments, a generally 90° turn may be located at a different point along the length of the resilient feature 320. In some embodiments, the turn is greater than or less than 90°, and in some embodiments, the more extreme curve may curve in a different direction other than toward the rear of the boot shaft 105, or may be formed in a different shape. Because many boot shafts are intended to be worn inside the draped material of a wearer's pant leg, a top portion (e.g., the wider area at the top of the resilient feature 320) may be intended for a more functional purpose such as foot entry and a less style-specific purpose. Thus, a resilient feature can taper generally toward the bottom of a boot shaft for both stylistic and functional reasons.

Figure 7:
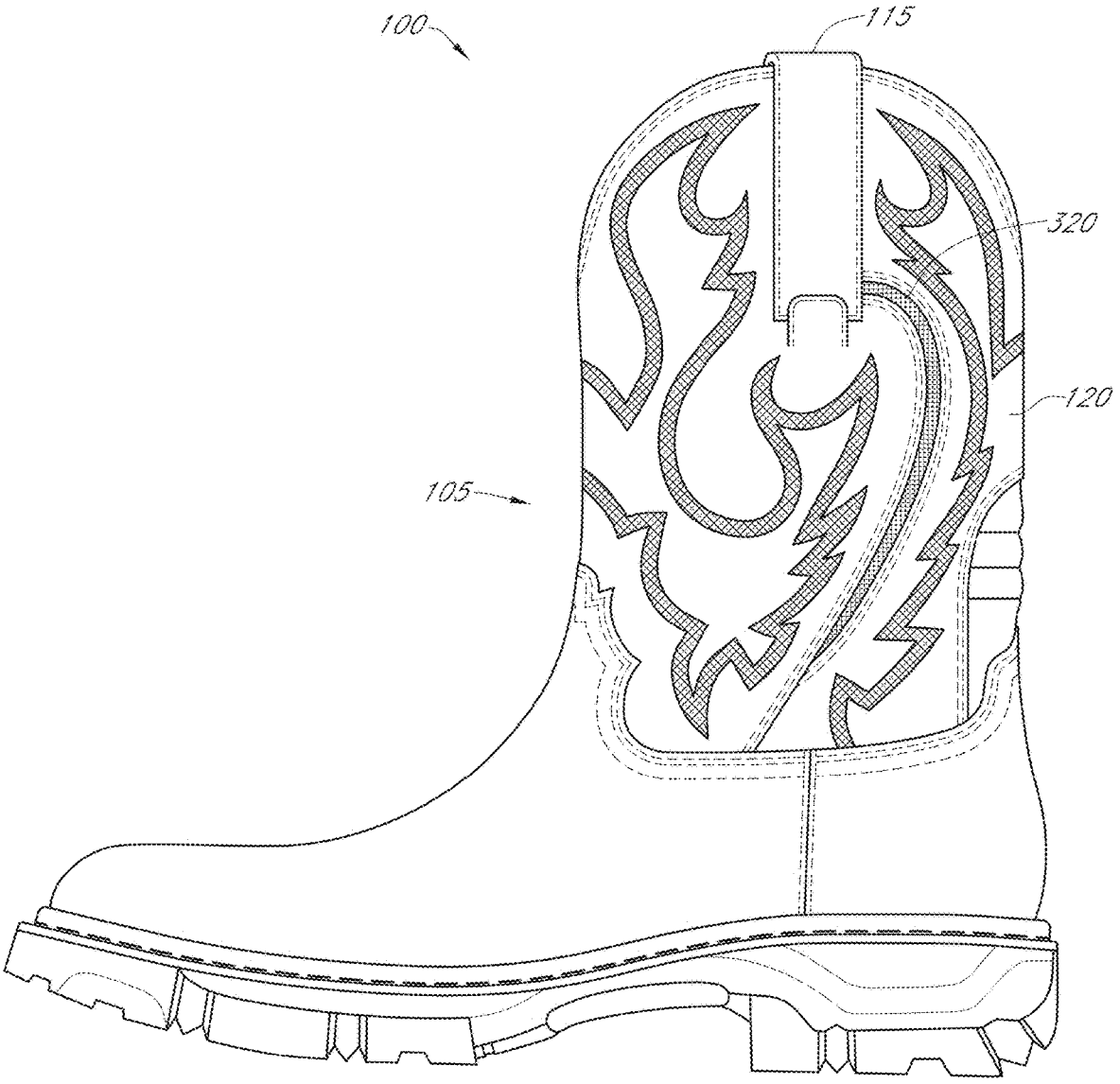
FIG. 7 shows a first example of a cowboy boot having a pull strap configured to obscure a top portion of a resilient feature.

FIG. 7 shows another example of a cowboy boot 100 with a resilient feature 320 that is shaped like the resilient feature 320 in FIG. 6. However, here, the wider top portion of the resilient feature 320 is covered and hidden by the pull tab 115. Due to the generally 90° turn of the resilient feature 320, the lower ends of the pull tab can be firmly attached, inside and outside the boot shaft 105, without impeding the stretching function of the resilient feature 320. That is, generally speaking, no stitching line or other securing means that attach the pull strap 115 to the boot shaft 105 are sewn over the exposed portion ΔD (see FIG. 3) of the resilient feature 320, which would limit the extent of its ability to stretch. Indeed, here, the functional stretch of a portion of the resilient feature 320 corresponding to ΔA in FIG. 3 is not greatly impeded because the portion ΔD has a very similar width to that of ΔA (because the top stitching is similar to that shown in FIG. 6—near to the edge). Nevertheless, the resilient material 320 which might to some consumers possibly be viewed as diminishing the boot's style (because of its greater width toward the top of the shaft 105) is obscured behind and shielded by the pull tab 115, which extends vertically down and is secured below the generally 90° turn of the resilient feature. Although only about ⅓ of the resilient feature 320 has been hidden, the remaining part is so thin and curved that it appears to be an integrated part of the quarter stitching 120 decoration and not a conspicuous intrusion of a resilient feature 320 into the styling of the cowboy boot. Thus, using the framework of FIG. 3, the drawbacks of wide flaps ΔB and ΔC are avoided, while their obscuring or stylistic function is accomplished by the pull tab 115. The pull tab 115 does not gape or flap open because it bends neatly around the top of the shaft 105 and is secured on the outside and inside of each side of the shaft 105.

FIG. 7 also illustrates how the decorative stitching or other stylistic elements of a boot shaft 105 can be sized or otherwise configured to correspond visually to an exposed length of a resilient portion 320. Here, the decorative motive generally includes lines that are of similar thickness to the exposed width of the resilient portion 320. In some embodiments, not only the width, but also the color, texture, or other visual appearance of decorative lines can be configured to correspond with a visual aspect of a resilient portion 320. In this way, a resilient portion can blend in with the decorative surroundings, even though it can also have a functional role in some embodiments, such as, for example, providing an ability for the boot shaft to stretch, an ability for air to flow into and out of the boot shaft, an ability to protect the interior of the boot shaft from the intrusion of water or other liquids, and/or an ability to protect the temperature of the boot shaft interior.

Figure 8:
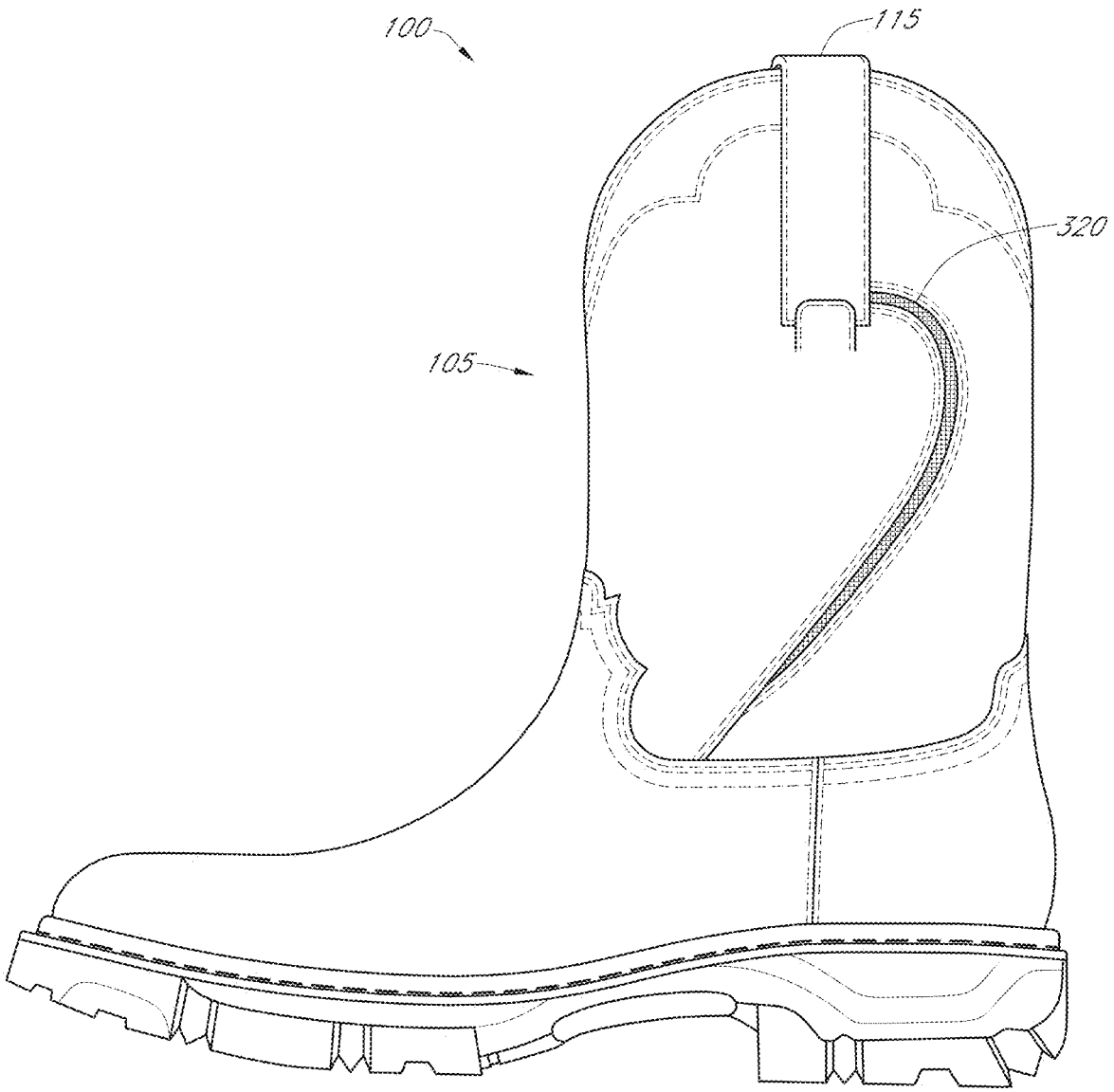
FIG. 8 shows a second example of a cowboy boot having a pull strap configured to obscure a top portion of a resilient feature.

FIG. 8 shows an example of how well a resilient feature 320 shaped like the resilient feature 320 of FIGS. 6 and 7 can be integrated into the design of a boot shaft 105, even when decorative stitching is less prominent and detailed. Here again, a thicker, straighter portion of resilient feature 320 is camouflaged or obscured with a pull strap 115, and only a thinner, curved portion of the resilient feature 320 is exposed as it extends in an elegant curve, which is mirrored in the stitching above, toward the shoe box of the boot 100.

Rotatable Pull Tab

Figure 9:
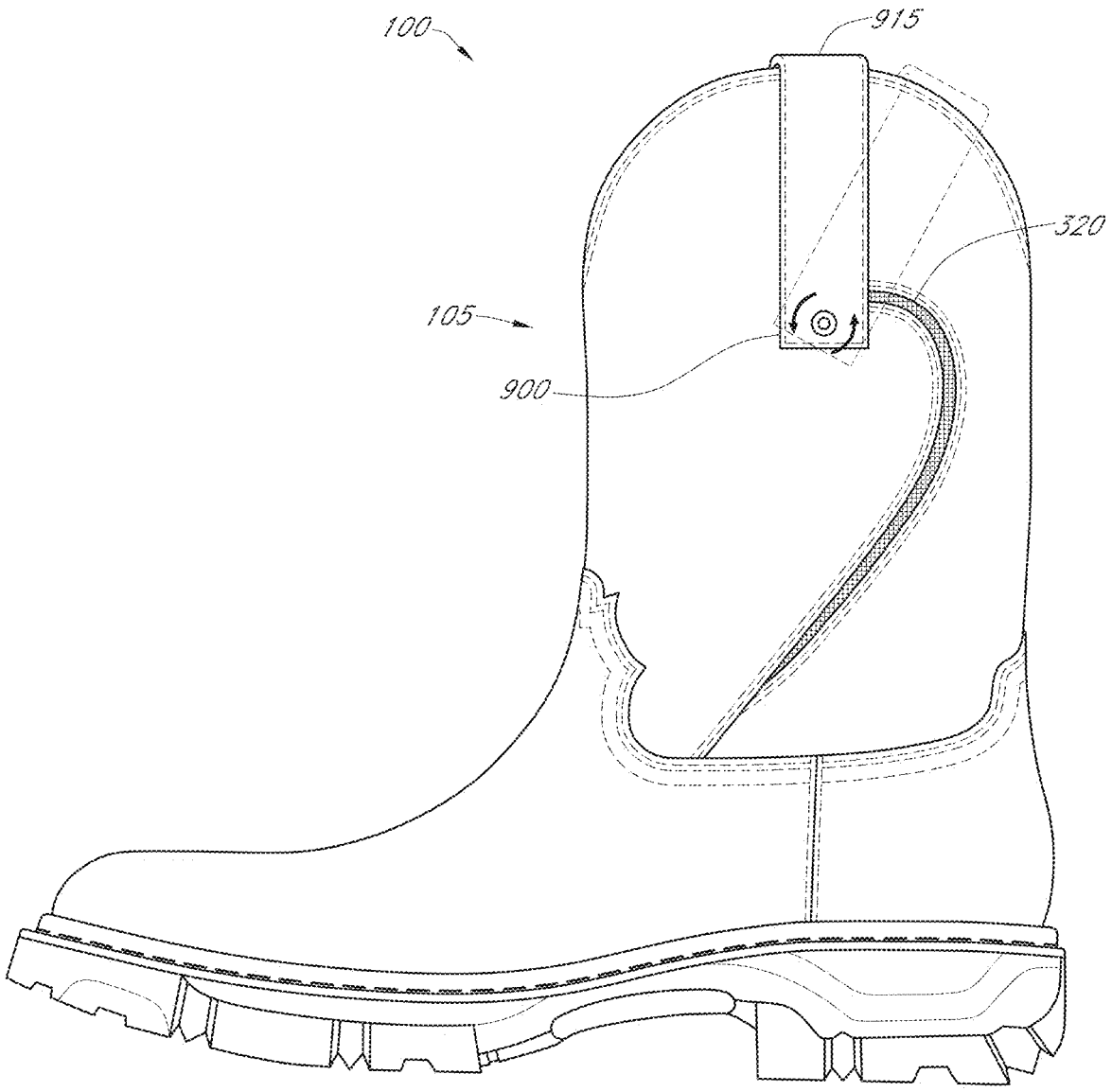
FIG. 9 shows how a pull strap can pivotably attach to a boot shaft.

FIG. 9 shows how two ends of a pull strap 915 can be attached to the boot shaft 105 with a securing mechanism 900, such as a rivet, that allows the pull strap 915 to be rotated about the securing mechanism 900 while still being firmly attached to the boot shaft 105 and while still avoiding interference with the resilient feature 320. This rotation can be very useful and ergonomic for a user, in addition to providing resilience and strength. For example, if a user grasps the pull strap 915 before a foot has been inserted, the user's foot may initially extend, toes-first, down the shaft. In this case, a user's shoulders and arms will often be shifted forward with respect to the boot such that the pull tab 915 will tend to rotate forward during this phase. However as the user pulls on the boot and the user's foot slides deeper inside, the user's toes will tend to slide deeper into the toe box 110, allowing the user's leg to enter a greater alignment with the shaft 105. When this happens, a user's shoulders and arms will tend to pull more up and back on the pull tab 915.

Throughout this process, the ability of the pull tab 915 to rotate freely can allow the user to exert force in the direction needed without losing a firm grasp on the boot itself (through the pull tab 915). Another feature of the boot illustrated here is the rounded top edge of the boot shaft 105. This rounded edge generally outlines a semi-circle roughly centered on the securing mechanism 900. The pull tab 915 is free to rotate about the mechanism 900 while the top of the pull tab 915 freely slides along the boot shaft's rounded top edge. In the example shown in FIG. 9, the boot shaft 105 has a rounded top and the securing mechanism 900 can allow the pull strap to rotate nearly 180° about the securing mechanism 900. Thus, a rotating pull tab 915 can allow for a more fluid and consistent pulling motion while the boot is oriented differently as different portions of a user's foot pass through the shaft and around the corner into the toe box 110. At the same time, the resilient portion 320 can expand as needed under the force of the foot being inserted into the shaft. These two features together can provide an improved user experience and enhance the ergonomic utility of boots, while remaining within stylistic constraints.

Figure 10:
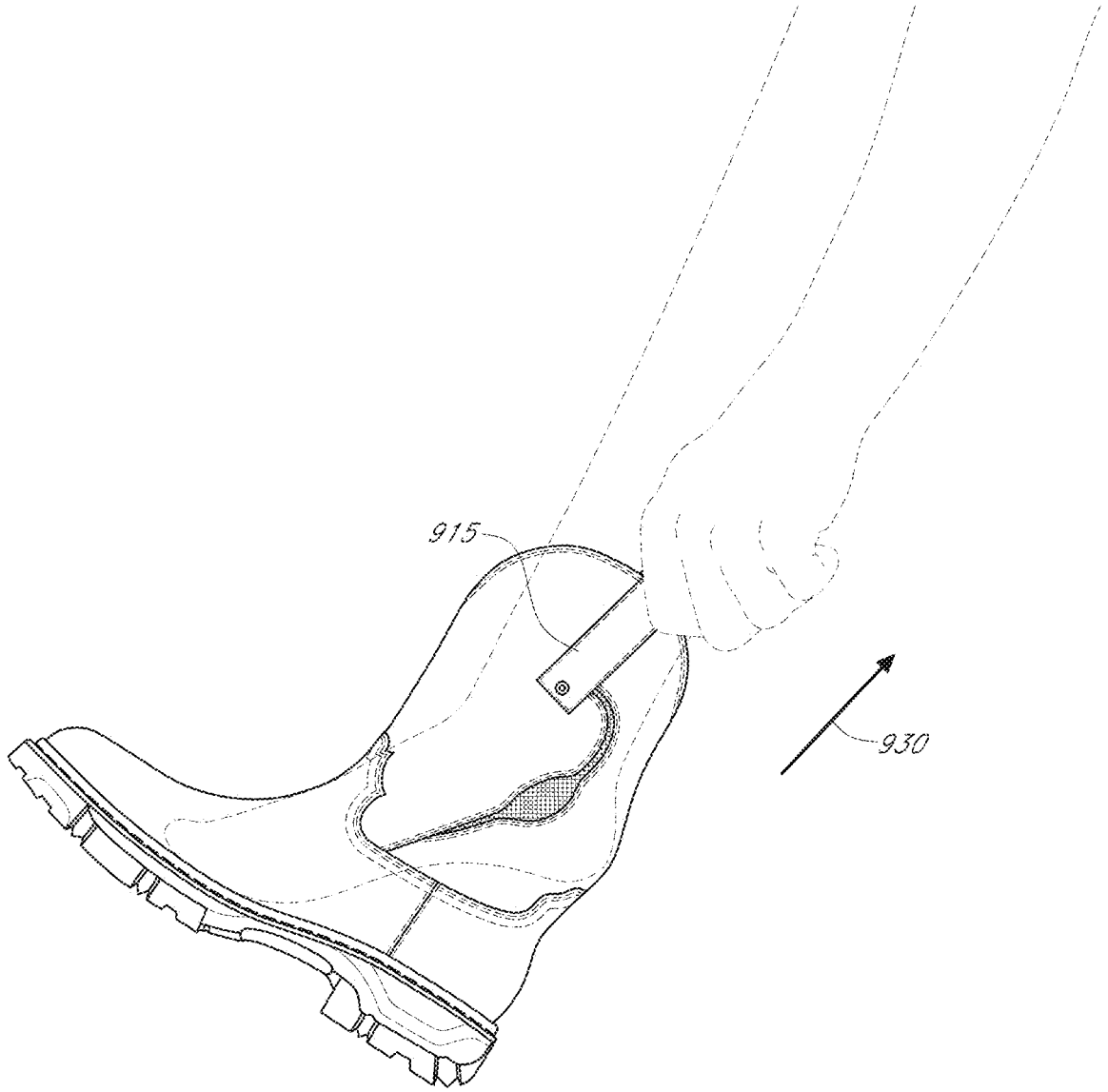
FIG. 10 schematically illustrates a person pulling on a cowboy boot with a pivoting pull strap.

FIG. 10 shows a simplified sketch of a person pulling on a boot using a rotating pull tab 915 as described with respect to FIG. 9. A stylized depiction of the person's foot within the boot includes a heel deforming the back of the shaft, thereby exerting a force that tends to expand the resilient portion 320 in the direction of the heel's protrusion. The person's hand can pull generally upward and backward on pull tab 915 in the direction of the arrow 930.

Figure 11:
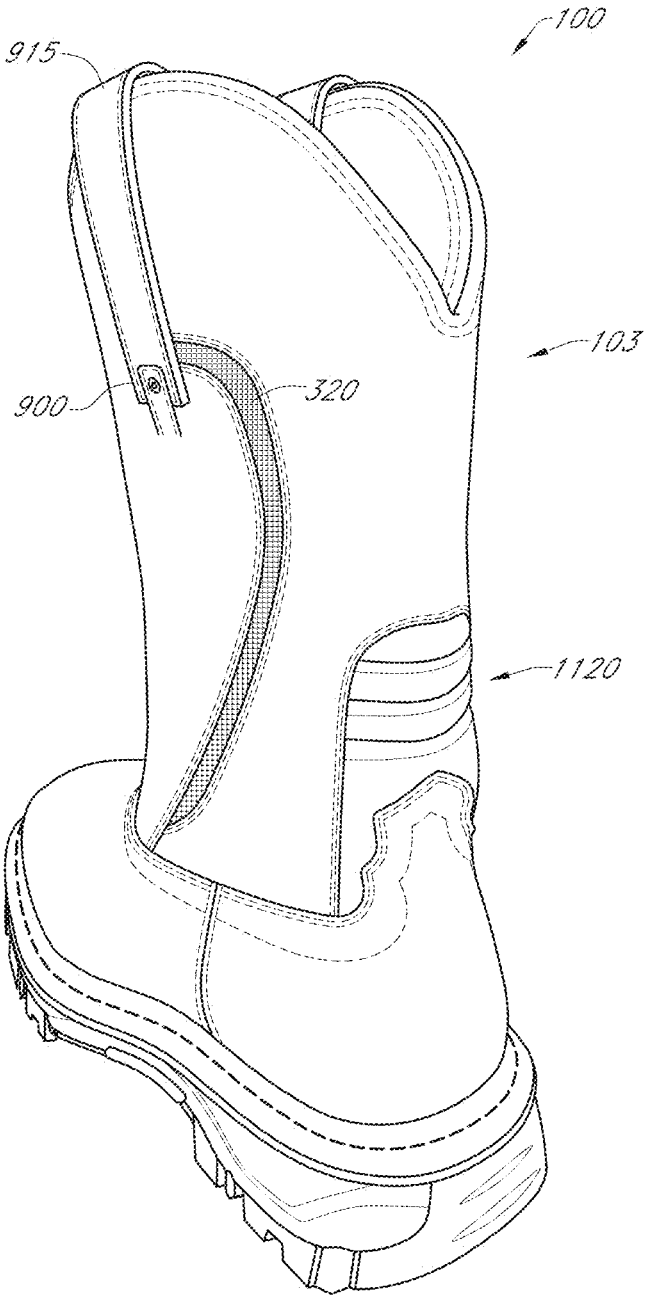
FIG. 11 shows a rear perspective view of a cowboy boot with a resilient feature and pull strap.

FIG. 11 shows a back view of a boot with a rotating pull tab 915, a resilient portion 320, and a shaft 105. The pull tab 915 can rotate about a securing mechanism 900. In this embodiment, the securing mechanism 900 fastens a lower and thinner strap portion that protrudes from the leather and extends over a lower portion of the pull tab 915. This configuration can add strength and enhance style. Also visible are rear features 1120 that can include, for example, folds and/or horizontal stripes. The rear features can be formed from a different material than that provided for the remainder of the shaft 105. These features can provide additional strength and protection for a work boot. They can provide flexibility and resilience. They can also provide stylistic and functional enhancements. A material can include built-in folds or contours that tend to provide the strength, comfort, resilience, and or style characteristics desired.

As also shown in FIG. 11, a boot 100 can have a rounded top edge on each lateral side that dips down to meet at two points, one at the front of the boot shaft 105 and one at the rear of the boot shaft 105. Such a top edge shape, which can be known as a scallop, can provide an aesthetic feature of the boot 100. A scallop top edge can also provide an opening between the two lateral sides that extends lower down the boot shaft than the upper edge, thereby effectively shortening the distance a wearer's foot must travel through the boot shaft before it reaches its destination in the shoe box. Accordingly, a boot 100 with a scalloped upper edge can be useful for boot wearers whose calves have a large diameter. Having a scalloped upper edge of the boot shaft can therefore give a boot the convenience of a boot with a shorter shaft height, while at the same time providing the appearance and even some of the protection of a taller shaft height. In some embodiments, a boot 100 may have scallops that extend lower down the boot shaft than what is shown in FIG. 11. In other embodiments, a boot 100 may have scallops that extend less far down the boot shaft than what is shown in FIG. 11. Still other embodiments of boots 100 can include boot shafts 105 having a flat top edge of the boot shaft 105, with no scallop shaping.

Figure 12:
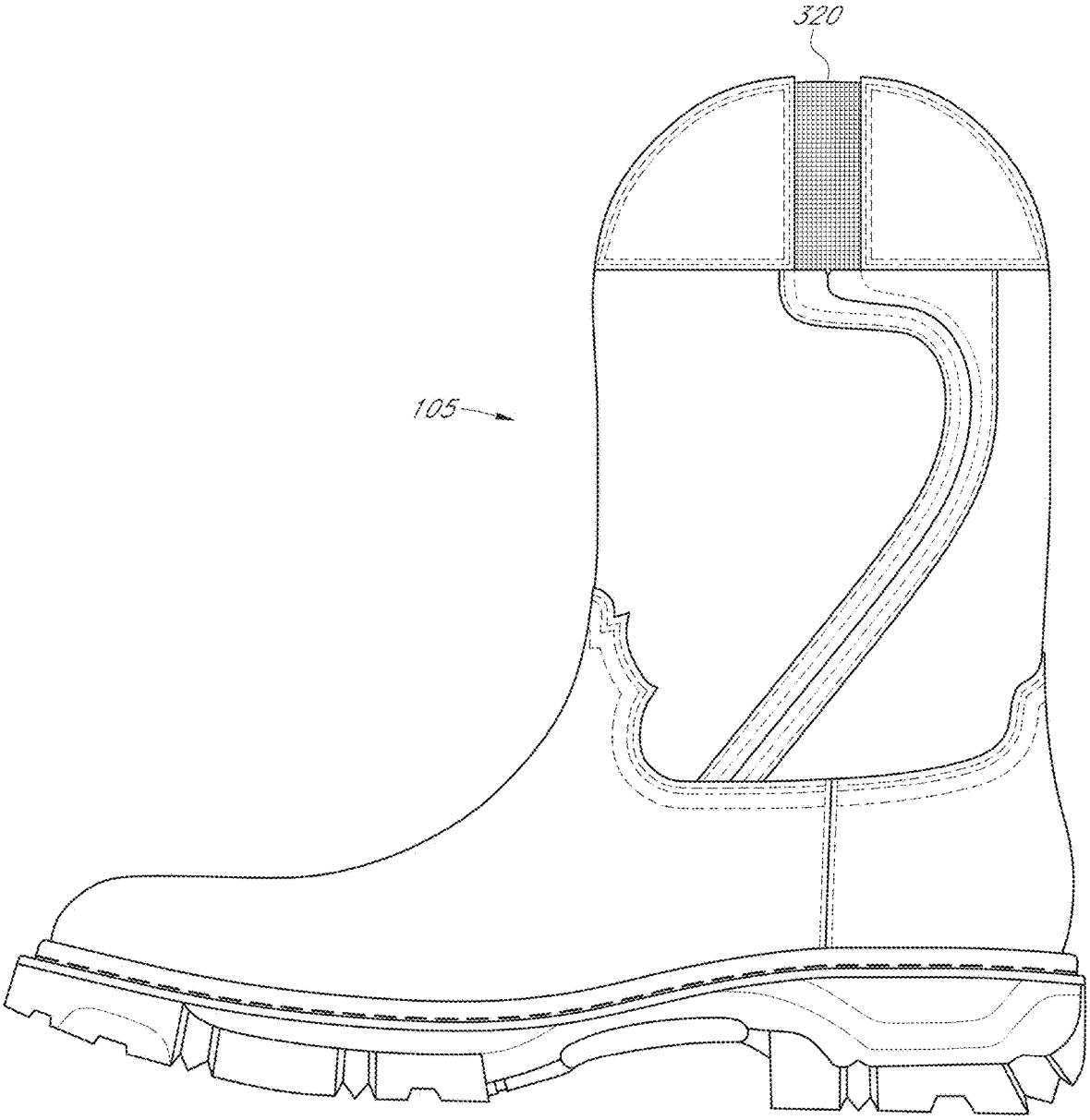
FIG. 12 shows an example of a cowboy boot with a resilient feature partly obscured by flaps of material.

FIG. 12 shows a side view of a boot without any pull strap to obscure a wide resilient portion near the top of the boot shaft 105. Below, this example includes a lower length of the resilient portion 320 that is entirely obscured by side flaps when it is not stretched laterally (as shown here). Using the concepts and notation introduced in FIG. 3, this is an example of how widths ΔB and ΔC can be maximized, while ΔD is minimized (at least for this lower length of the resilient portion 320). A pull strap (rotating or otherwise) can be added to structure shown in FIG. 12, if desired, to obscure the upper length of the resilient portion 320. The shaft shown in FIG. 12 also shows how a boot can look when viewed from the inside. A resilient portion can be constructed to specifically connect portions of the boot shaft as shown. In some embodiments, a lining of a boot can provide the resilient properties described herein.

Additional Features for Resiliency

Figure 13:
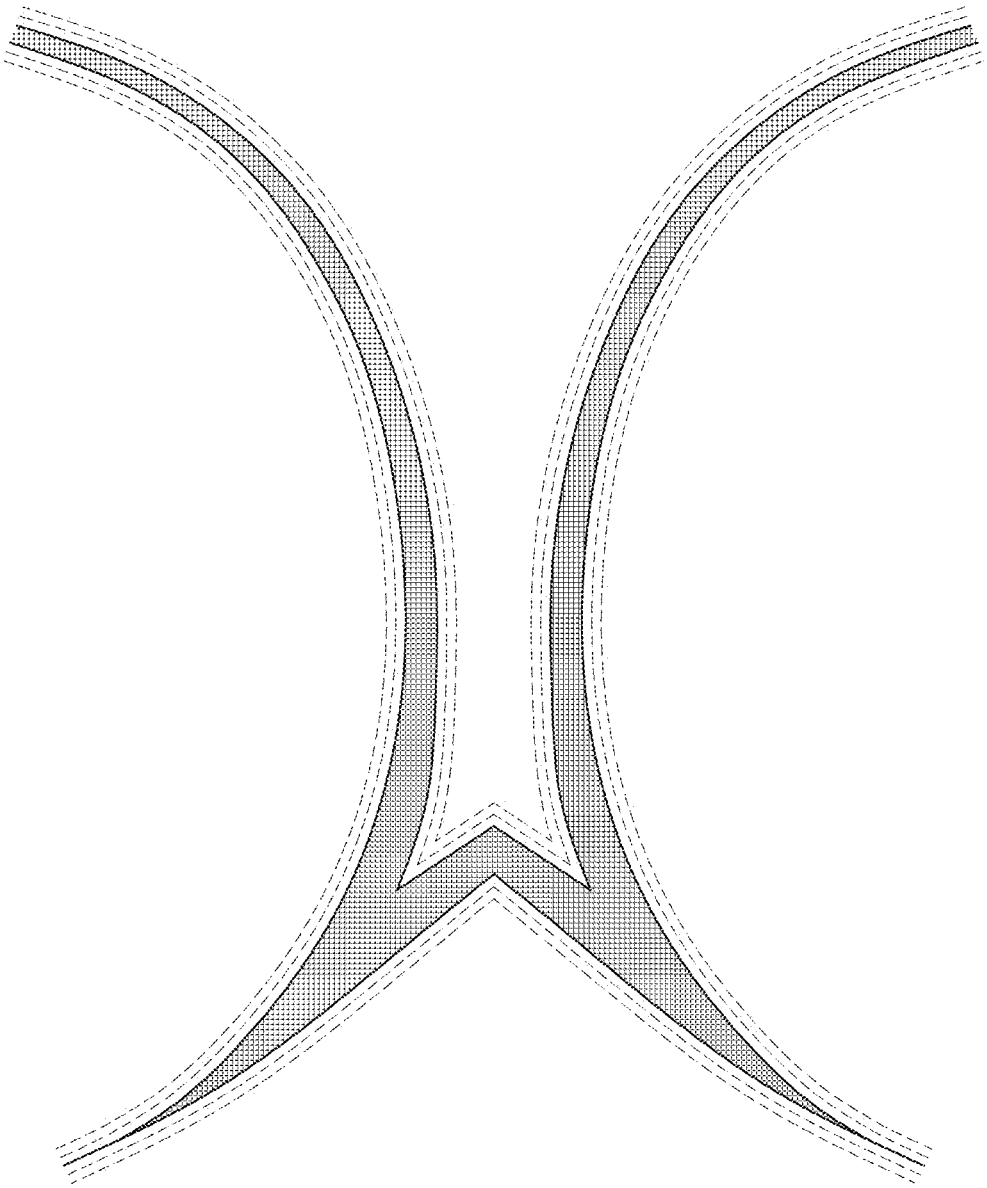
FIG. 13 shows a generally symmetrical design for the rear of a boot shaft.

FIG. 13 shows a symmetrical design for the rear of a boot shaft. This design can implement and embody many of the features and benefits described above. The darker shaded portions represent a resilient material that is visible through gaps in a leather material, for example. When viewed from this direction, the resilient portion can form a rounded "W" shape, where one side of the "W" extends onto a medial side of the boot shaft 105 and the other side of the "W" extends on a lateral side of the boot shaft 105. The dashed lines can represent top-stitching that holds the resilient material in place beneath the surface of the boot shaft. To avoid extra seams or bumps inside a boot shaft, the entire panel shown (and indeed the entire circumference of a boot shaft) can have a resilient material within it. The stretch of the resilient material can depend on where it is secured to or otherwise associated with the outer portion of the boot shaft that is commonly formed out of leather.

Figure 14:
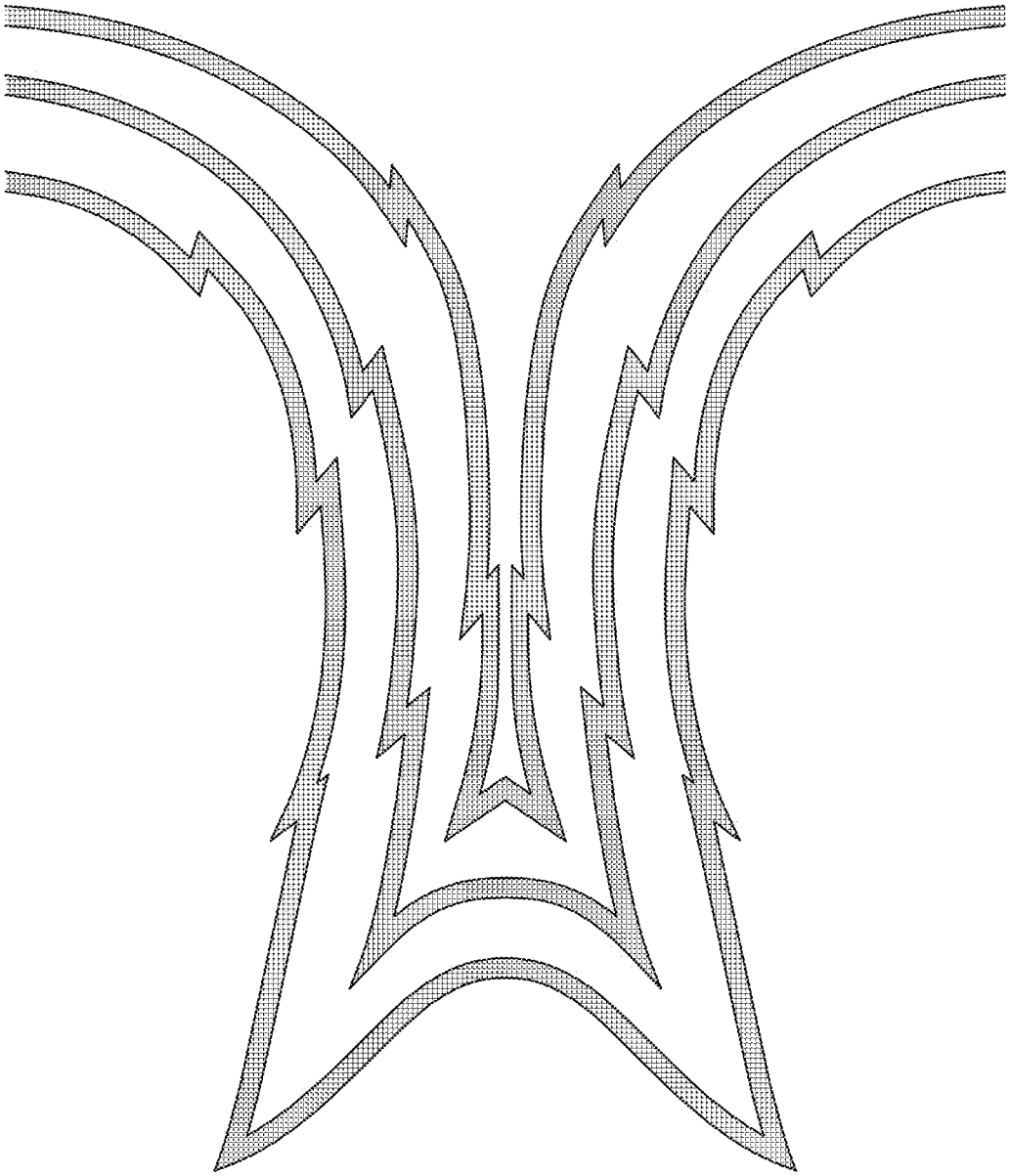
FIG. 14 shows another generally symmetrical design for the rear of a boot shaft.

FIG. 14 shows another design, also symmetrical, for the rear of a boot shaft. This design includes three nested "W" shapes, each having jagged lines. A boot having this design can have numerous resilient properties if each of the lines shown represents an underlying resilient portion. Alternatively, only one or two of the lines shown can represent a resilient portion, while the others have a similar thickness and appearance but are simply formed from top-stitching, applique, or another decorative material. Furthermore, other symmetrical or non-symmetrical designs incorporating resilient material 320 can be utilized at the back of a boot shaft 105 to provide enhanced comfort, utility, and/or style to a boot 100.

Figure 15:
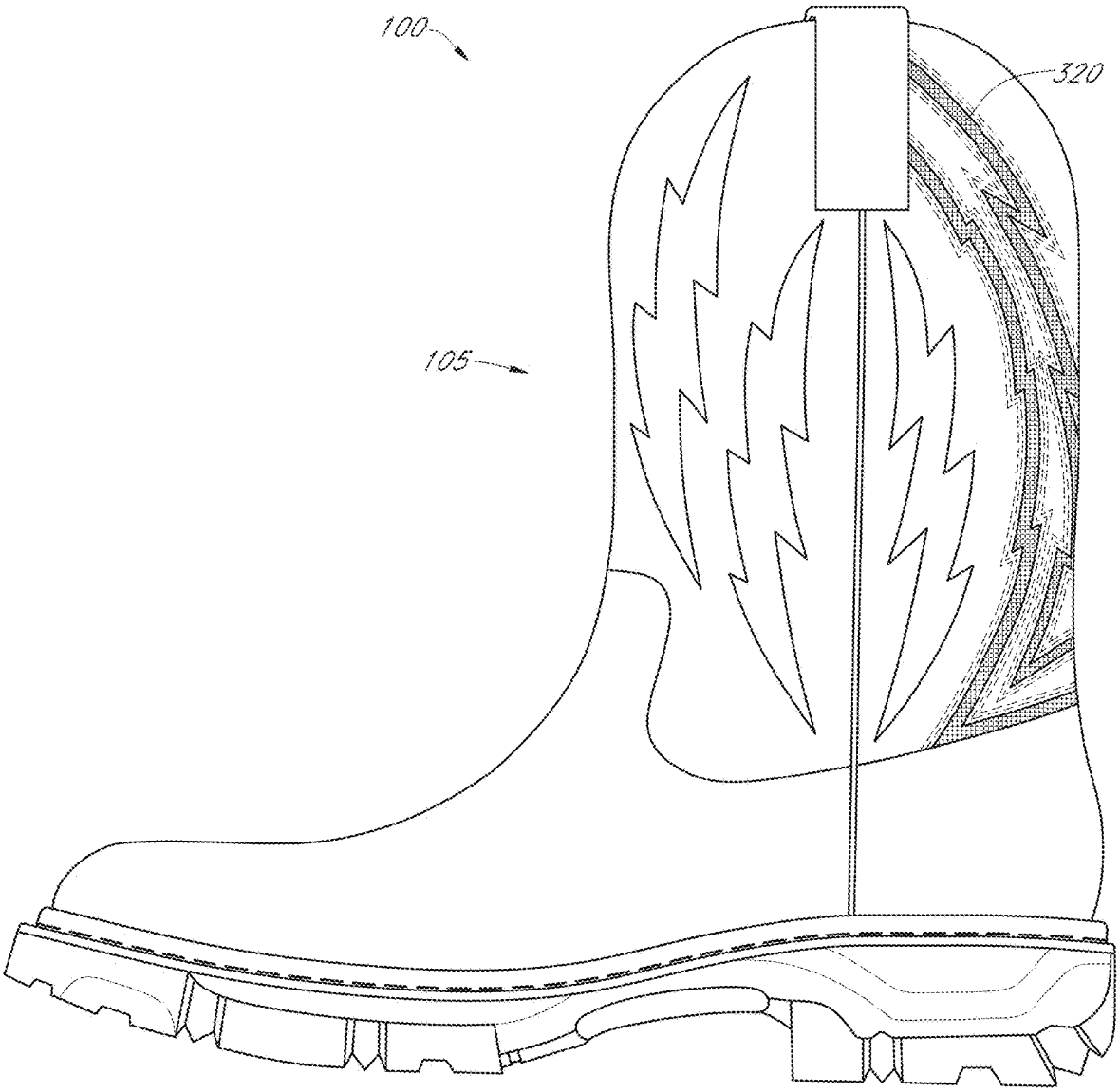
FIG. 15 shows how the back portion of a boot shaft such as those illustrated in FIG. 13 and FIG. 14 can be incorporated into a boot.

FIG. 15 shows how the back portion designs and/or features of a boot shaft such as those illustrated in FIG. 13 and FIG. 14 can be incorporated into a boot. The thick jagged lines can represent gaps in leather that can be filled with elastic material having a particular color or appearance. For example, resilient portions 320 can be formed from gold elastic. The jagged lines shown in FIG. 14 can visually complement the rounded lightning shapes shown on the side of the boot shaft shown in FIG. 15, for example. Moreover, a boot shaft can have designs that generally mirror each other or are centered across a center line, as shown in FIG. 15, in both a front portion of the boot shaft, which extends up generally from the shoe box 110 of the boot and in a back portion of the boot shaft, which extends up generally from the heel of the boot.

Figure 16:
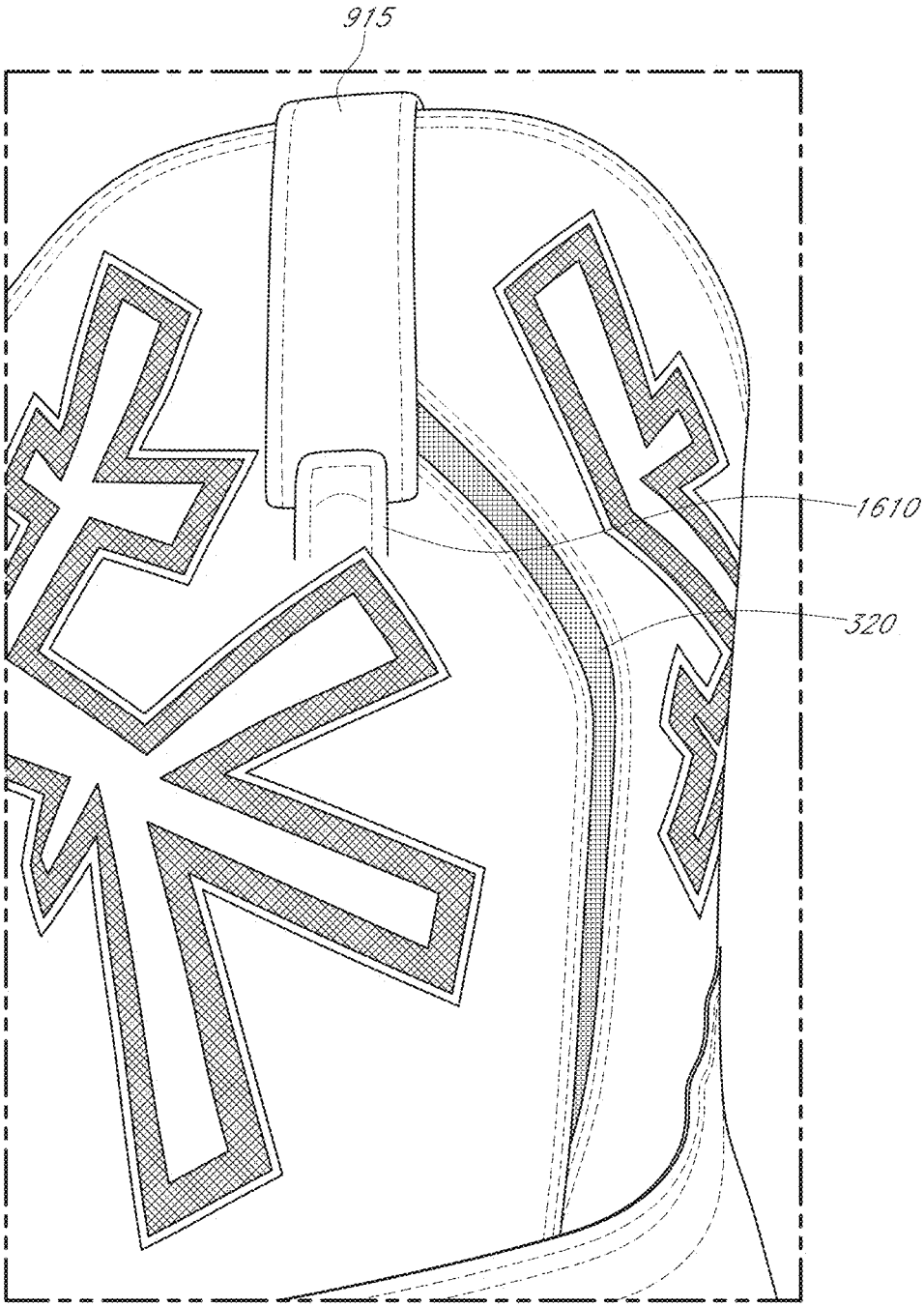
FIG. 16 provides another example of how a resilient portion can be positioned within a boot.

FIG. 16 provides an example of how a resilient portion 320 can curve back and down from behind a pull tab 915. Top stitching 1610 can be provided to help secure a portion of the pull tab 915 to leather on one side of the shaft that is effectively divided by an opening in the leather and joined in an elastic manner by the resilient portion 320. Decorative stitching can form angular shapes in a pattern that is echoed on either side of this divide and/or that may echo a shape of the resilient portion 320.

Figure 17:
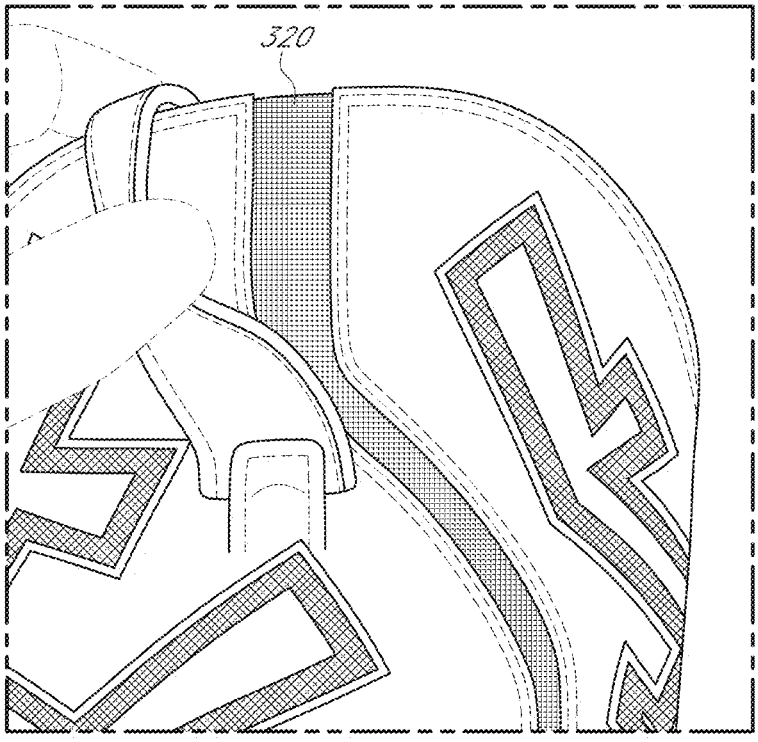
FIG. 17 provides another view of the features described with respect to FIG. 16.

FIG. 17 provides another view of the features described with respect to FIG. 16. Here, the pull tab 915 is pulled aside to reveal a wider length of the resilient portion 320 that was lurking behind the pull tab 915 in the view of FIG. 16.

Resilient Boot Lining

As briefly discussed above with respect to FIG. 12, a lining of a boot can serve as the resilient portion 320. The lining can be tacked down and/or stitched to the edge of an opening in a leather material, for example. If the lining itself has resilient properties, no additional resilient material may be required. Some linings that can be used to achieve this purpose are "aeromesh" and/or spandex-containing materials. A higher-stretch spandex material can stretch by approximately 5%, for example. As a practical matter, an amount of resilience can be increased by allowing more resilient material to be located between stitched-down portions. Using the terminology of FIG. 3, increasing ΔA can increase the overall stretch of a boot shaft. Additionally, increasing the resilient properties of the material itself—e.g., by using a material with spandex or the like—can increase overall ability to stretch without changing ΔA. Different stitching materials and patterns can also contribute to overall resilience or amount of stretch provided. Alternatively, a boot lining can be constructed to compliment a resilient feature. For example, a boot lining can have a parallel resilient material overlapping with the external resilient feature, such that both inner and outer resilient features expand and contract in tandem. Alternatively, a boot can have a single resilient feature forming a single layer of material at a resilient portion, whereas the remainder of the boot has two layers (e.g., leather outer, and a separate liner), each of which are attached to the boundaries of the resilient material.

Figure 18:
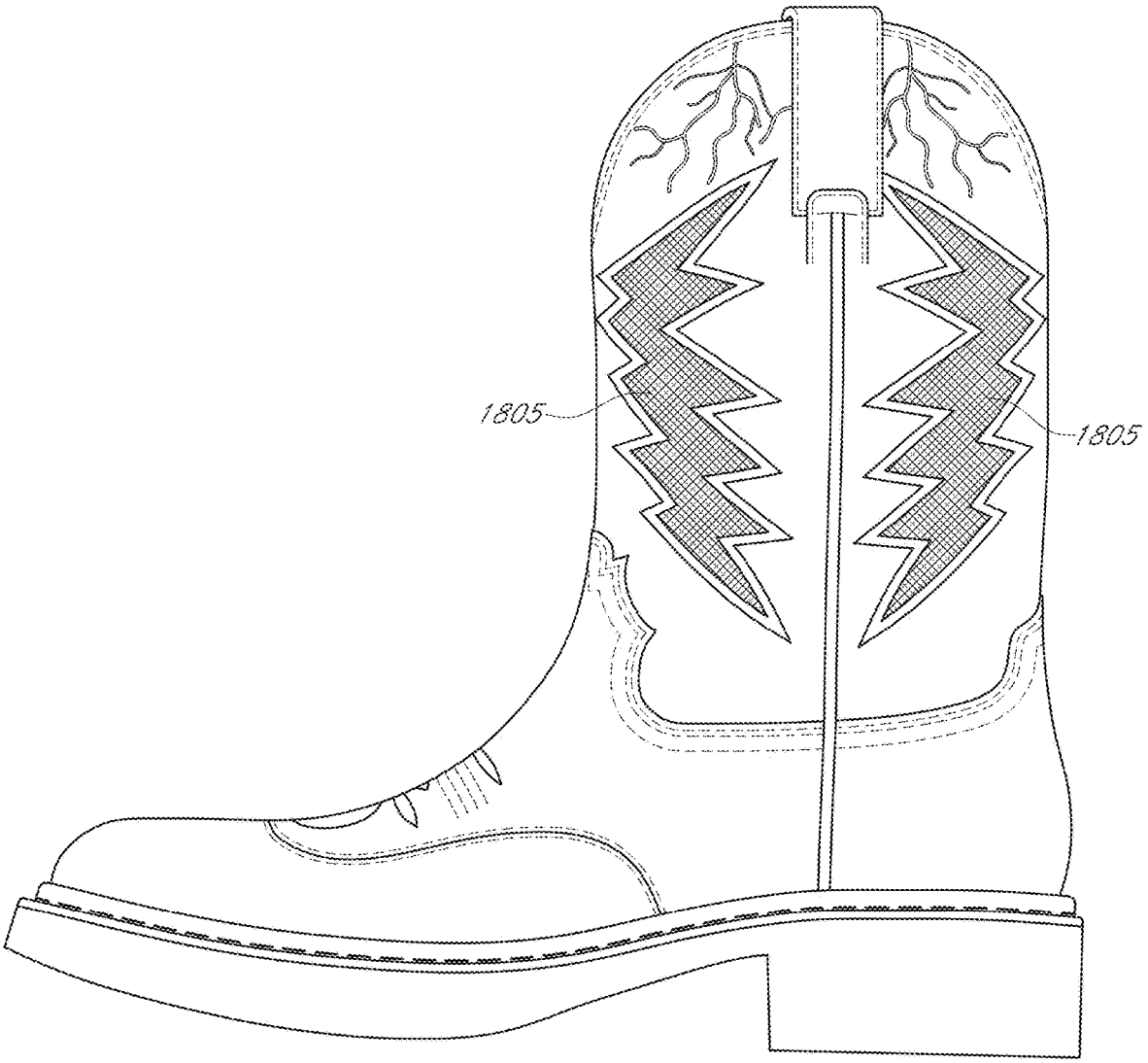
FIG. 18 illustrates a boot with stylized lightning bolt-shaped openings in the leather that are mirror images of one another and that can have within them material with resilient and/or air flow/cooling properties.

FIG. 18 illustrates a boot with stylized mirrored lightning bolt openings 1805 in the leather that can have within them material with resilient and/or air flow/cooling properties. As shown, a boot can have a resilient portion 1805 that does not extend all the way to the top of the boot shaft. This can still provide helpful stretch when a user's foot is inserted into a boot, because a heel may not tend to squeeze tightly through a shaft until a foot attempts to turn the corner down into the toe box 110. At this point, the heel is located part way down the shaft, so the lightning-shaped openings in this figure can provide resilience at the relevant portion of the boot shaft. In some examples, resilient and/or ventilating material can also provide air openings to increase comfort for the wearer in hotter environments as air circulates through the shaft.

Comfort in a boot can also be enhanced with systems and methods that allow for a movement of air within the boot shaft. For example, in the boot illustrated in FIG. 18, the stylized lightning bolt openings in the boot shaft can be spanned by an air-permeable material configured to allow air flow and circulation such as the escape of air heated by a wearer's foot and leg and ingress of outside air during use of the boot.

Additional Materials and Constructions

Figure 18A:
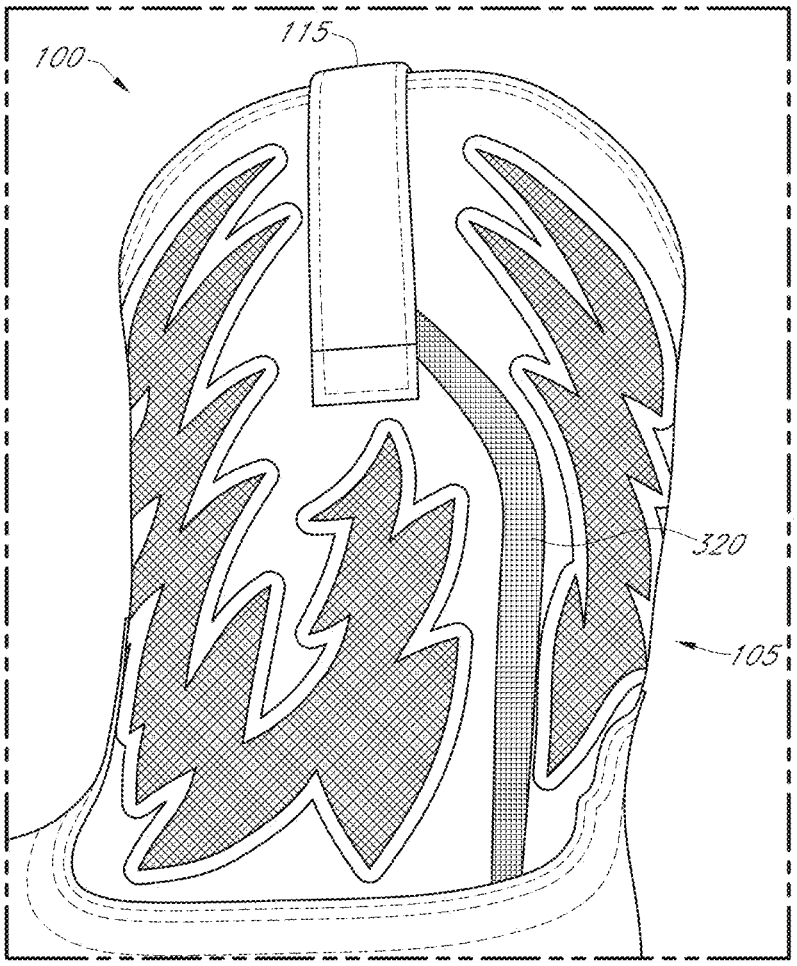
FIG. 18A shows a boot with a shaft formed from a resilient material.

FIG. 18A shows an example of a boot 100 with a boot shaft 105 that is made largely of various resilient, air-permeable and/or other materials that are woven, knit, or otherwise interconnected. FIG. 18A2 is a photographic image of the boot of FIG. 18A. As seen in these figures, although the shaft is made of various interconnected fabric materials (rather than leather or leather-like materials), the styling and general effect of the boot continues to provide a Western style and rugged impression. The boot shaft 105 in FIG. 18A includes the resilient portion 320 as well as the pull strap 115 that were discussed with respect to earlier figures of this disclosure. Forming a shaft from knitted or otherwise resilient materials can enhance comfort and flexibility. It can also provide airflow (e.g., for cooling or odor reduction). Construction of such a shaft can have similarities to construction of a sock.

Figure 18B:
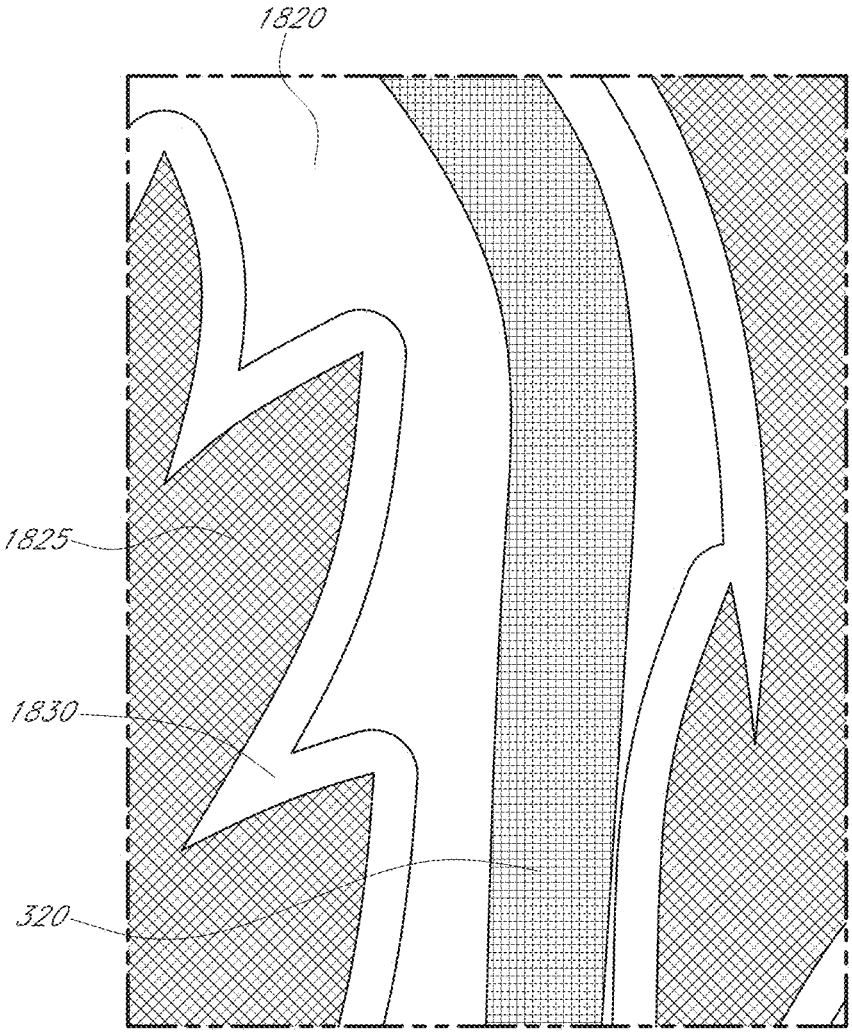
FIG. 18B shows a close-up view of the resilient portion seen in FIG. 18A

FIG. 18B shows a close-up view of the resilient portion 320 seen in FIG. 18A and how it is connected by being knit or woven together into the adjacent portions of the boot shaft 105. FIG. 18B2 is a photographic image of the boot portion described with reference to FIG. 18B. The material of the boot shaft 105 of FIG. 18B can be formed of various regions made of diverse fibers, where the various regions each have their own properties, including, for example: level and direction of resiliency, level of durability, level of ventilating capacity, depth or absence of pile, tightness and other weave properties, and other aspects of function and/or physical appearance. For example, some regions, such as 1820, 1825, can be formed of a material having a higher pile and/or looser styles of knitting. Other regions, such as 1830, can be formed of material with a tighter weave or knit and low or non-existent pile, and can serve as zones of outline and demarcation between the various other regions.

FIG. 18A, shows various regions that can be configured as a whole to mimic the styling of other boots seen earlier in this disclosure. Furthermore, design of the multi-material or multi-region fabric, including thoughtful placement of the various regions with their differing properties, can allow boot designers to provide extra resiliency in the boot shaft where needed for allowing a wearer's heel to pass comfortably through the boot shaft while maintaining a circumference of desired narrowness and a desired fit once the foot is either inside the shoe box or withdrawn from the boot altogether.

Figure 18C:
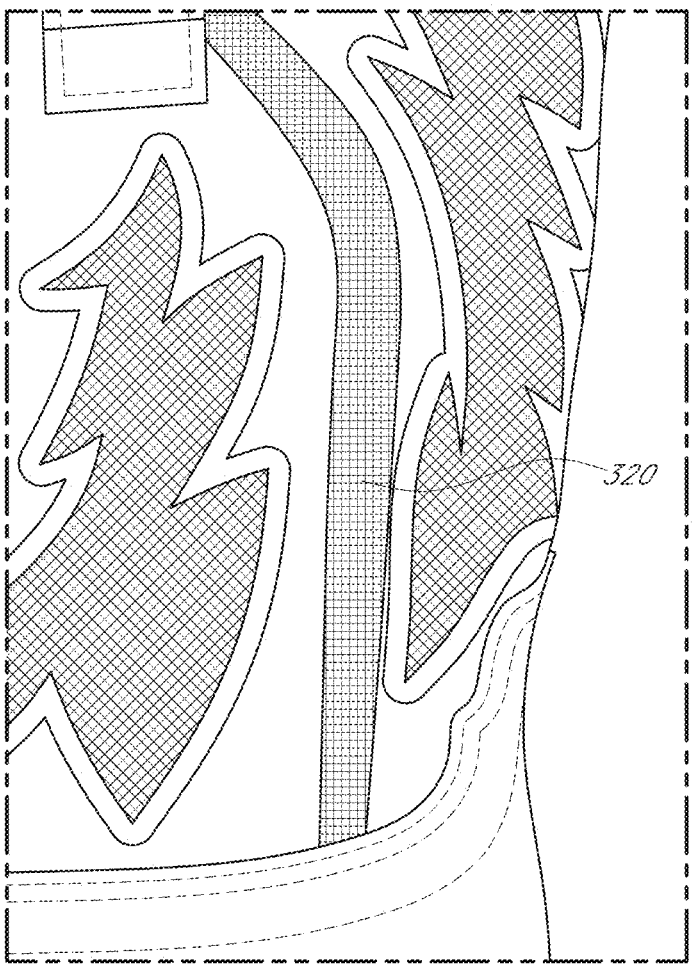
FIG. 18C shows a close-up view of a bottom area of the resilient panel.

For example, FIG. 18C shows a close-up view of a bottom area of the resilient panel 320. FIG. 18C2 is a photographic image of the bottom area of the resilient panel 320 described with reference to FIG. 18C.

Figure 18D:
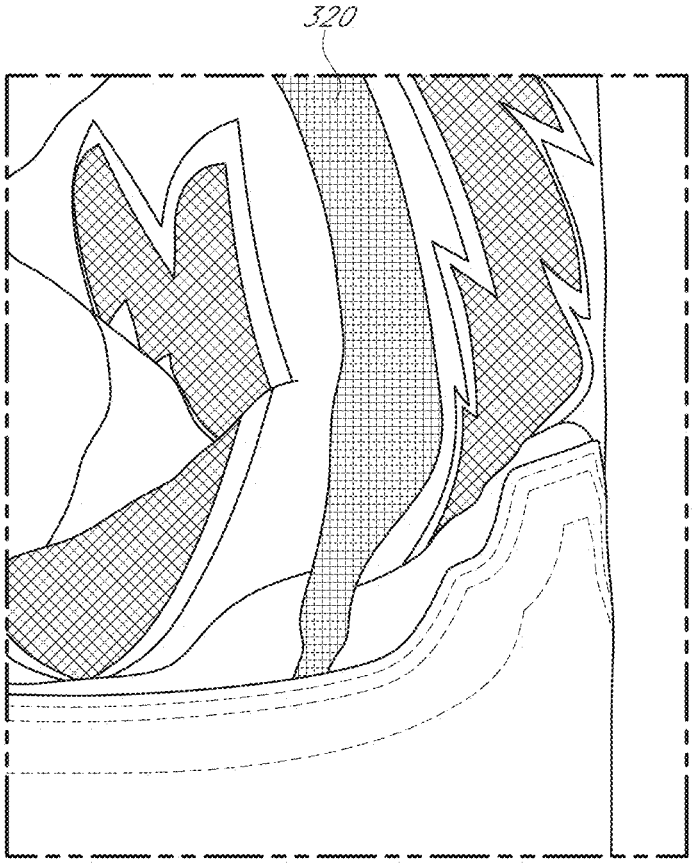
FIG. 18D shows the same area of the boot when the resilient panel 320 is being temporarily deformed

FIG. 18D shows the same area of the boot as seen in FIGS. 18C and 18C2 when the resilient panel 320 is being temporarily deformed and expanded (e.g., to allow passage of a wearer's foot and heel through the boot shaft). FIG. 18D2 is a photographic image of the area of the boot described in FIG. 18D. As shown, a resilient portion can interact with other portions that are also, at least to some extent, resilient.

Footbed Comfort Features

Figure 19:
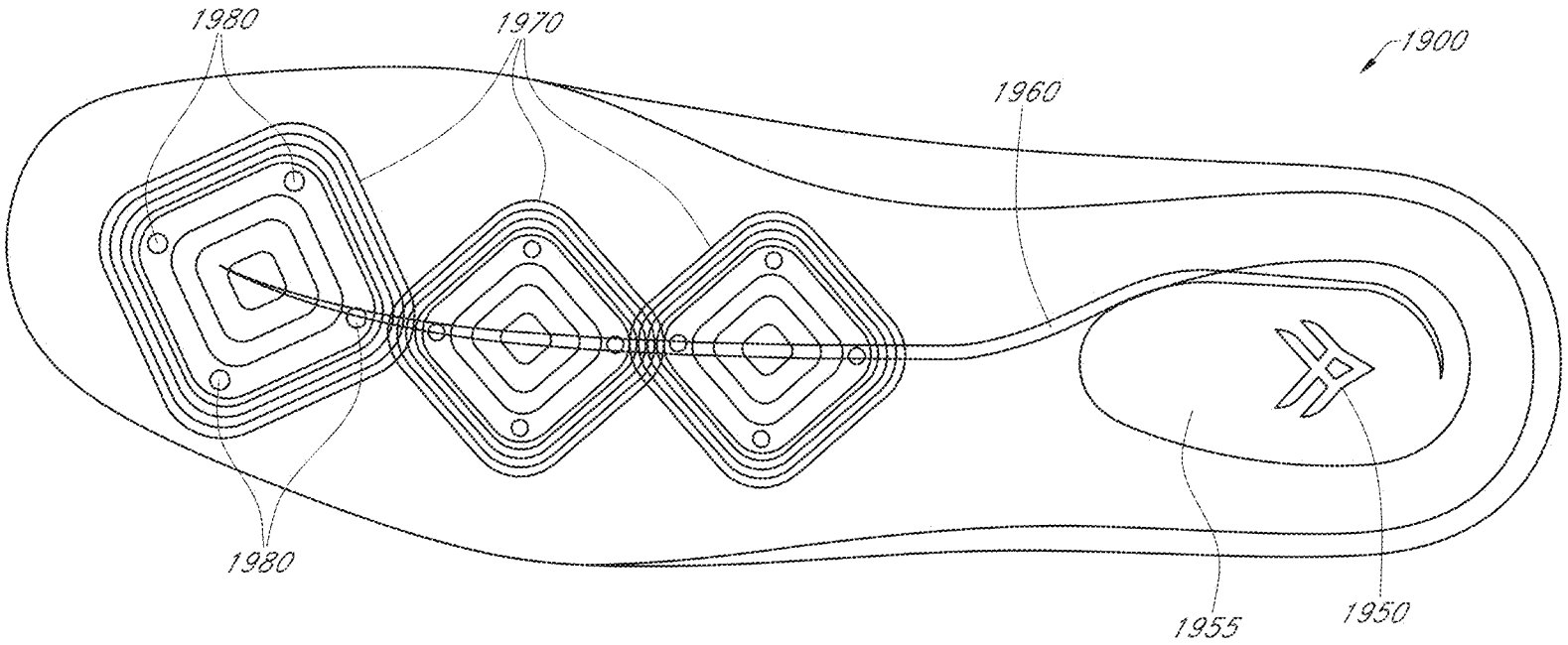
FIG. 19 illustrates a top view of one example of an innersole that can be used inside a boot to provide airflow in the shoe box of the boot.

As disclosed above, comfort in a boot can be enhanced with one or more systems and methods applied to the shaft of a boot. Comfort in a boot can also be enhanced with systems and methods that allow for a movement of air within the shoe box 110 of a boot, where the wearer's foot can become uncomfortably warm and even damp due to perspiration and lack of airflow. Wetness of a foot within a boot contributes greatly to the formation of blisters on the foot, and so keeping the wearer's feet dry within the boot is a matter of health and hygiene as well as of comfort. FIG. 19 illustrates a top view of one example of an innersole (or insole) 1900 that can be used inside a boot to provide airflow in the shoe box 110 of the boot. In some embodiments, decorative and/or informative designs may be printed on a top surface of the innersole 1900. For example, the innersole 1900 seen in FIG. 19 includes decorative design features 1950, 1960, and 1970, which may refer to functional systems within the innersole 1900 without providing direct function themselves. The top surface of the innersole 1900 may include a raised heel area 1955 that covers a cushion positioned under the wearer's heel and airholes 1980 that can allow for the flow of air out of the innersole 1900 and into a front, toe portion of the shoe box 110.

Air induction and expulsion technology, built into an insole, can enhance the comfort and desirability of footwear such as the boots illustrated herein. For example, an orthotic can form a removable footbed with a heel air chamber forcing expelled air to the forefoot in gait. Air can enter the shaft of a boot and permeate the heel and toebox regions of an inside of a boot (either in the absence or presence of a wearer's foot). This air can be drawn into the materials within a raised heel area 1955. For example, this area can be raised because it houses at least one resilient portion having small empty pockets surrounded by rubberized or foam-like material. Multiple materials can be combined, some having a greater ability to retain or accept air, and others having a greater ability to create resilience, even under pressure from a heel of a wearer. The materials comprising the raised heel can be engineered to compress downward when a heel bears down with more force during a wearer's walking motion and decompress upward when a wearer's weight shifts to the other foot. In this way, a resilient heel portion can alternately compress and decompress regularly, all the while providing comfort and support while a wearer walks and works.

The complex of materials within the raised heel area 1955 can tend to expand, thereby drawing air into the small air pockets within a foam-like material. This air can be drawn in from the surrounding air in the boot. It can reach the foam material by penetrating other permeable surface layers. For example, the top of an insole may be formed from a relatively even and comfortable but breathable material. Once air is present in the raised heel area 1955, it can be urged forward under pressure from a heel, passing toward the toe region through one or more passages within the insole. These passages can be smooth and relatively direct internal passages or tubes leading to the airholes 1980, or they can be ad-hoc passages—e.g., between tiny odd-shaped chambers formed within an aggregate material forming one or more permeable layers of the insole. As air makes its way forward toward a toe or fore-foot region of the insole, it can in turn force air up and out of the airholes 1980, thereby causing a cooling effect for the feet of a wearer.

The structure of an insole can help to bias forward movement of air through the insole itself using structures that encourage air movement in some portions of the insole but not others. For example, air can be more easily taken in through a heel portion (e.g., while a heel is not exerting pressure), but when a heel exerts pressure, it can close off the easiest air entry route, thereby biasing air movement through the next easiest route which is forward toward the toe region. All the while, air can be generally prevented or inhibited from moving sideways, backwards, and downwards by including materials with fewer air gaps or passages in these areas of the sole. In this way, the periodic heel strike and lift of a wearer (combined with the shape and materials of an insole) can act as a one-way valve that allows air first to enter, then be pushed forward through the insole, then exit near the toe region. This can tend to cool as well as dry the deeper—and traditionally danker—nether regions of the boot interior.

As noted above, the markings on the upper surface of an insole 1900 can correspond to underlying function and alert a user to that function. For example, the raised heel area 1955 can serve as an air intake and pump, an elongate design feature 1960 can represent, overlay, or reveal the shape of a generally elongate passage or series of passages through which air can pass under pressure from the pump, and the broad design features 1970 can represent, surround, and/or serve as an air exhalation portion of the insole 1900. The airholes 1980 can be open, thereby allowing air to escape. Other holes can also be provided. Alternatively the toe region can be upwardly air permeable to allow airflow from the surface of the insole 1900 more generally.

Figure 20:
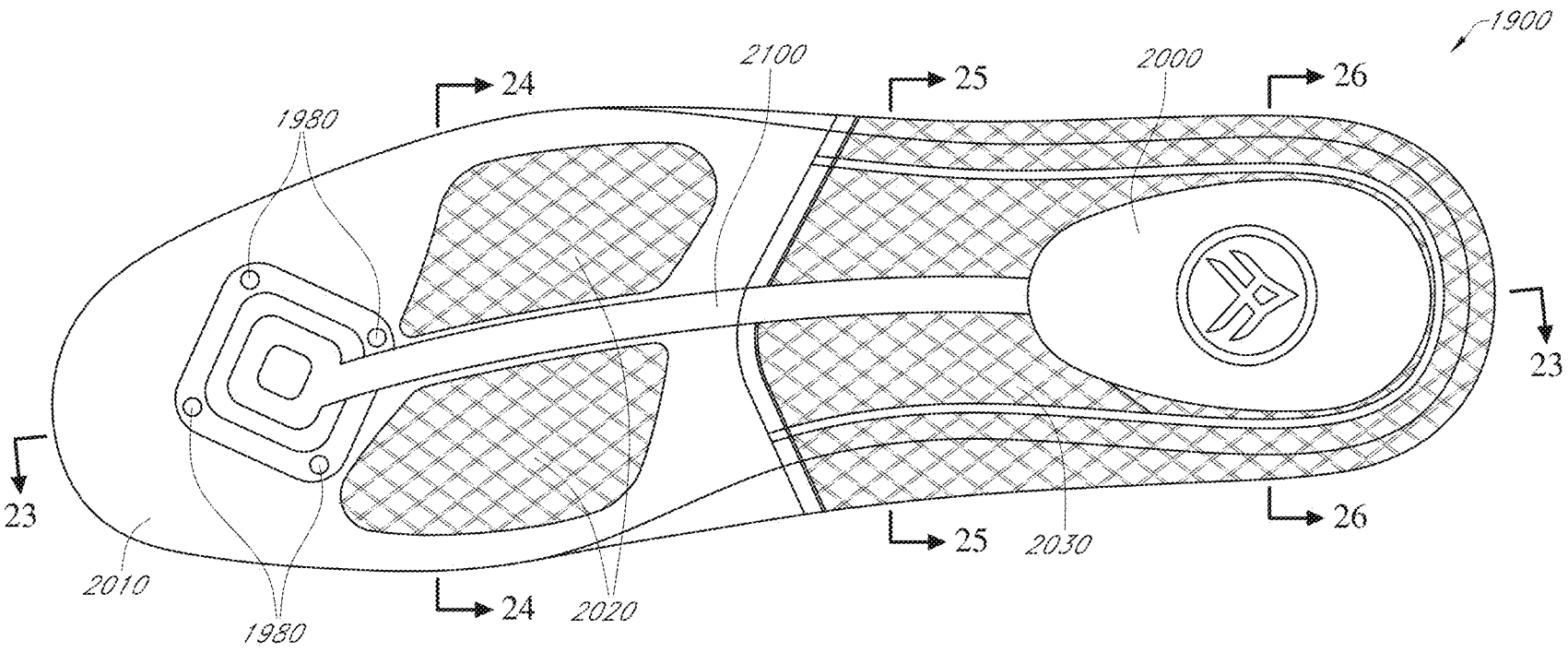
FIG. 20 illustrates a bottom view of the innersole of FIG. 19 that can be used inside a boot to provide airflow in the shoe box of the boot.

FIG. 20 illustrates a bottom view of the innersole 1900 that can be used inside a boot to provide airflow in the shoe box of the boot. As seen in FIG. 20, a bottom cover for a heel cushion 2000 may be positioned under the wearer's heel when the wearer's foot is fully inside the shoe box 110. In some embodiments, the heel cushion 2000 is made of a material that includes cavities capable of taking in and containing air, wherein the material of the heel cushion 2000 can also be deformable under pressure, causing the air cavities to expel the air within them. One example of such a pressure that can cause the air cavities to expel the air they contain is the pressure exerted by a wearer's heel upon the heel cushion 2000 during normal walking while wearing the boot. As the wearer steps down on the heel cushion, air inside the cavities is expelled. As the wearer lifts the heel in order to take a next step, pressure on the heel cushion is released, allowing the air cavities to expand and thereby draw in air. The process can repeat with every step. The heel cushion 2000 can form an air pump using memory foam (e.g., 4 mm thick) combined with high density foam (e.g., 12 mm thick). See FIG. 26 for a cross section view through layers that can meet these descriptions. The top layer of an innersole 1900 can be formed from a BK mesh fabric (e.g., comprising polyester).

Also shown in FIG. 20 is an air channel 2100 that extends from the heel cushion 2000 to a portion of the innersole 1900 positioned under the wearer's toes when the wearer's foot is fully inside the shoe box 110. The air channel 2100 can be configured to capture air expelled from the air cavities of the heel cushion 2000 and to transport the air to the toe portion where airholes 1980 allow the captured air to be released under the boot wearer's toes, thereby providing air circulation inside the shoe box 110. Visible in FIG. 20 are a molded chassis 2010, metatarsal zone pads 2020, and a molded waist-to-heel shank/heel cup stabilizing orthotic 2030. These can be formed from the materials described further below.

In some embodiments, a separate air-moving device can be embedded in the insole, forming a relatively independent envelope having a bladder at the heel portion, an elongate air tube, and an air expelling portion. Thus, air can be constrained within this envelope and move efficiently from heel to toes without escaping laterally because of the continuity between side-walls of different portions of the air-moving device. Some embodiments can include multiple independent air moving devices or connect multiple tubes to a single heel "pump."

Figure 21:
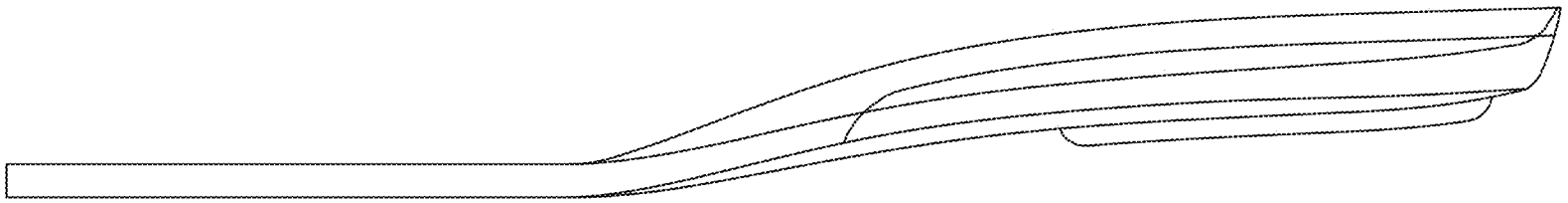
FIG. 21 illustrates a first side view of the innersole of FIGS. 19 and 20.
Figure 22:
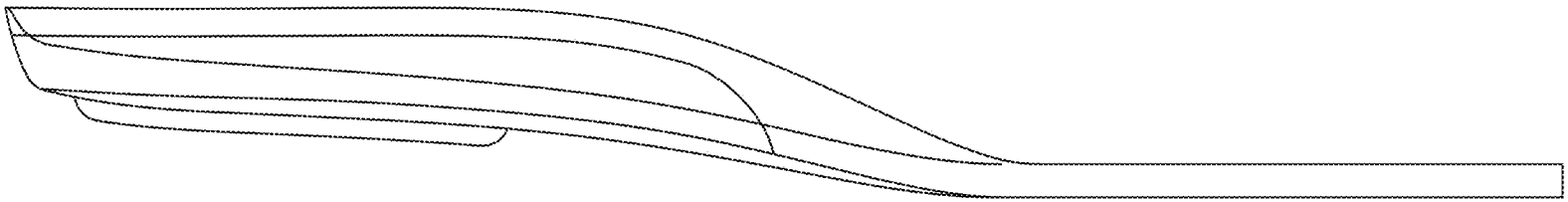
FIG. 22 illustrates a second side view of the innersole of FIGS. 19 and 20.

FIGS. 21 and 22 illustrate first and second side views of the innersole 1900 of FIGS. 19 and 20. FIG. 21 is an outside view (from the side opposite "FIG. 20" in FIG. 20), and FIG. 22 is an inside view (from the side where "FIG. 20" is located).

Figure 23:
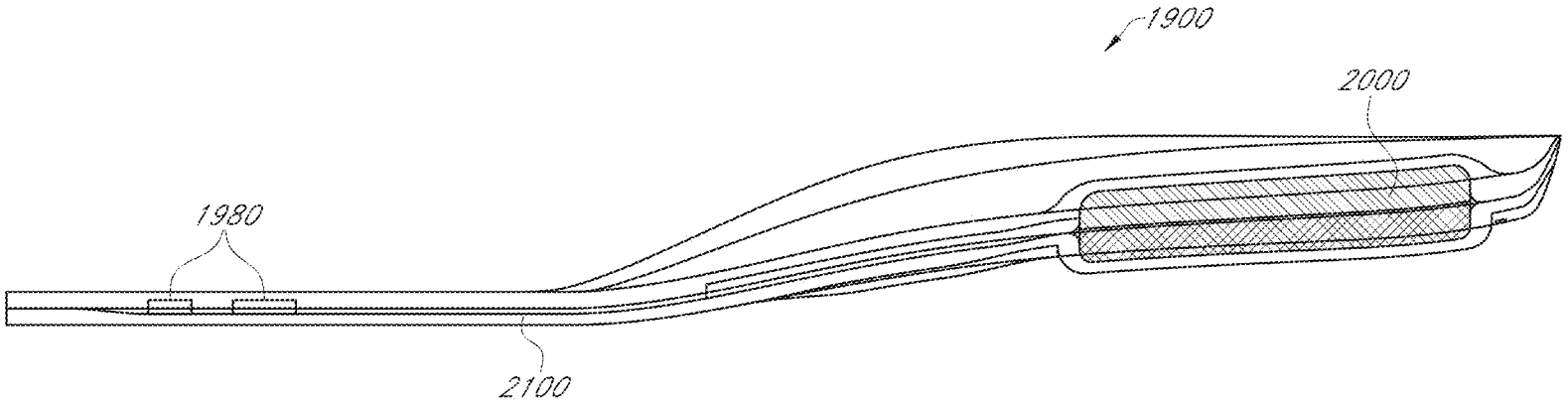
FIG. 23 illustrates a cross-sectional side view of the innersole of FIGS. 19 and 20 along the section 23-23 seen in FIG. 20.

FIG. 23 illustrates a cross-sectional side view of the innersole of FIGS. 19 and 20 along the section 23-23 seen in FIG. 20. The cross-sectional view shows the heel cushion 2000 and the air channel 2100 which carries air expelled from the heel cushion to the air holes 1980 that provide air circulation to toe areas of the shoe box. The innersole 1900 can be formed from layers of material, each having a specified function and together forming a functional insole unit. These layers can be adhered (e.g., using adhesive curable under specified manufacturing conditions relating to temperature, UV radiation, humidity, etc.) and/or integrally formed, milled, or stamped. In some embodiments, a resilient and long-wearing portion thereof is formed from polyurethane. A top layer can be formed from moisture wicking and/or other comfort enhancing material.

Figure 24:
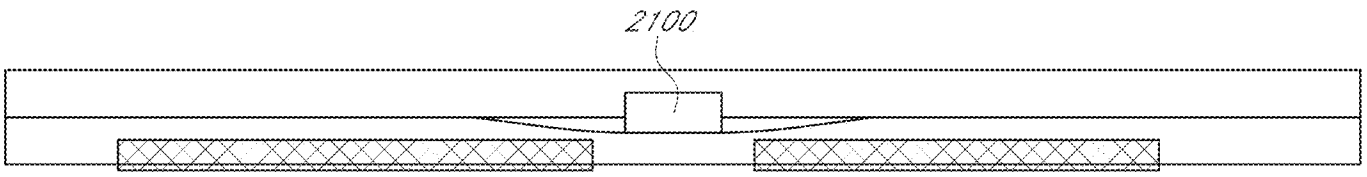
FIG. 24 illustrates a cross-sectional view of the inner sole 1900 of FIGS. 19 and 20 along the section 24-24 seen in FIG. 20.

FIG. 24 illustrates a cross-sectional view of the inner sole 1900 of FIGS. 19 and 20 along the section 24-24 seen in FIG. 20. In the center of this figure, the air channel 2100 can be seen in between other layers of the insole 1900. Example layer thicknesses and other distances are also illustrated, where units are in millimeters. The cross-hatched areas can represent rubberized or otherwise resilient portions and can correspond to similarly hatched areas in FIG. 20.

Figure 25:
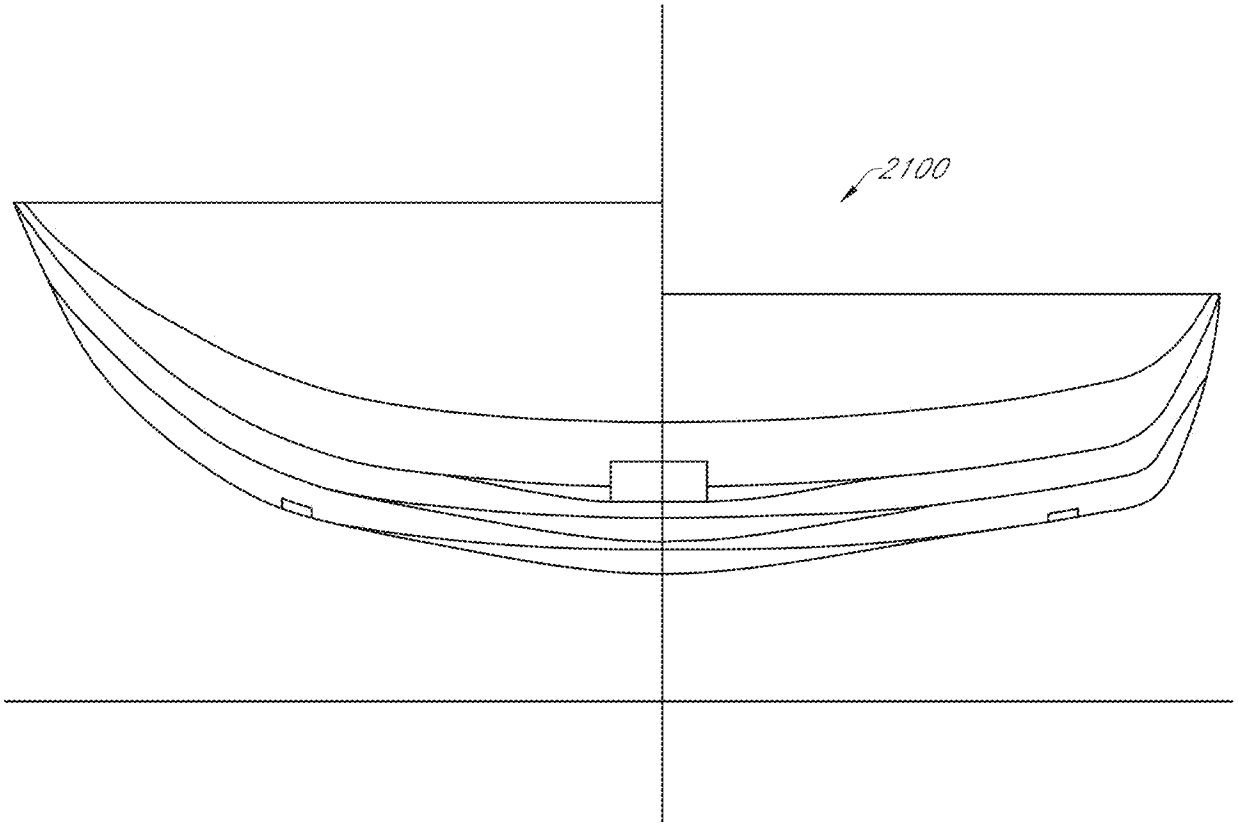
FIG. 25 illustrates a cross-sectional view of the inner sole 1900 of FIGS. 19 and 20 along the section 25-25 seen in FIG. 20.

FIG. 25 illustrates a cross-sectional view of the inner sole 1900 of FIGS. 19 and 20 along the section 25-25 seen in FIG. 20. In the center of this figure, the air channel 2100 can be seen in between other layers of the insole 1900. Example layer thicknesses and other distances are also illustrated. FIGS. 24 and 25 both illustrate how other layers can be slightly displaced to envelop the walls of an air channel 2100. The channel can be formed from a rectangular or other shaped tube or passageway that is deformable and resilient in its own right.

Figure 26:
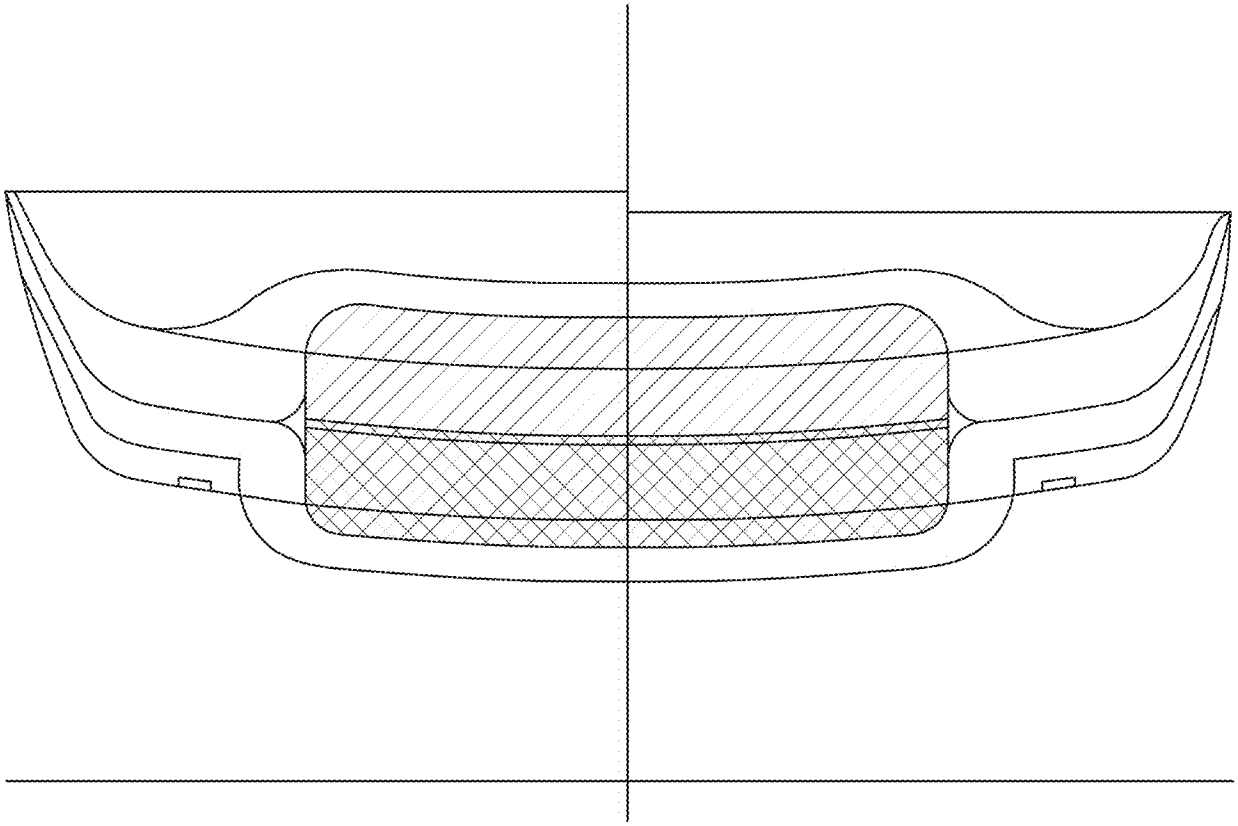
FIG. 26 illustrates a cross-sectional view of the inner sole 1900 of FIGS. 19 and 20 along the section 26-26 seen in FIG. 20.

FIG. 26 illustrates a cross-sectional view of the inner sole 1900 of FIGS. 19 and 20 along the section 26-26 seen in FIG. 20. This section is taken through the heel portion. Example layer thicknesses and other distances are also illustrated, where units are in millimeters. This figure shows how outer layers can generally envelop inner layers, thereby assisting in the air flow dynamics and venting functions discussed above. The cross-hatched areas can represent rubberized or otherwise resilient portions and can correspond to similarly hatched areas in FIG. 20. Additional hatching can be seen in upper layers, which can represent air-containing foam layers. Both materials can be resilient, and both can also contain air pockets or share functionality.

Figure 27:
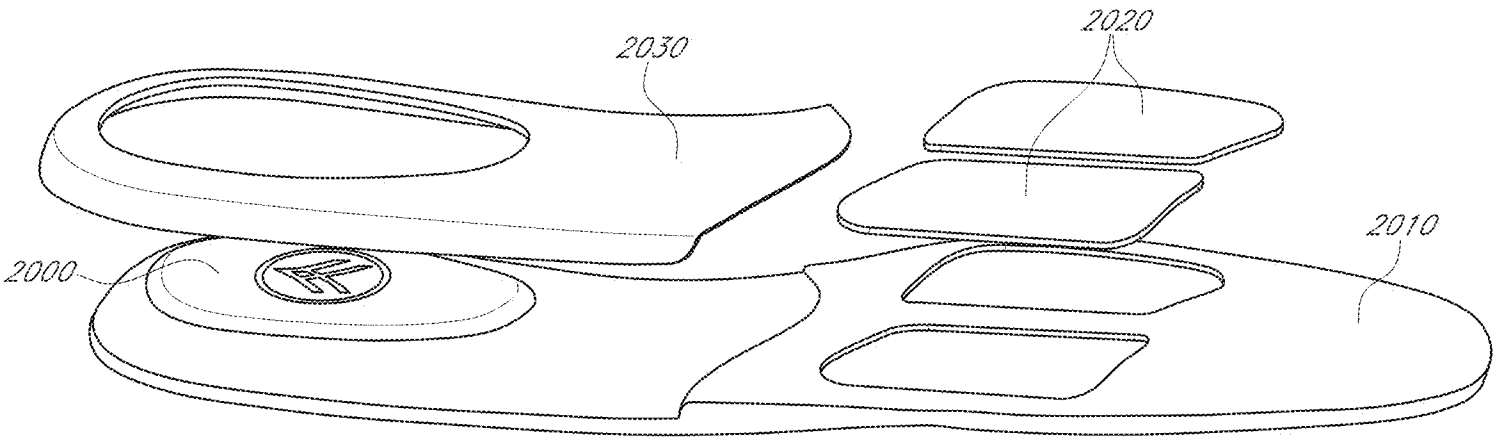
FIG. 27 illustrates an elevated, perspective, exploded view of the bottom of the innersole shown in FIG. 20.

FIG. 27 illustrates an elevated, perspective, exploded view of the features shown in FIG. 20. For example, a molded chassis 2010, metatarsal zone pads 2020, and a molded waist-to-heel shank/heel cup stabilizing orthotic 2030 are shown. These can be formed from the materials described further below.

FIGS. 19-27 show how a footbed can be formed from various functional layers. Some useful embodiments can involve the following layers, feature, and benefits.

In a first embodiment, a topcover can be formed from anti-microbial sublimated graphic mesh fabric with multiple air release cylinders. The benefits of this approach can include bacteria fighting additive with slip-resisting texture and brand identifiers. Perforation holes (e.g., 3.0 mm thick) can allow forced air to circulate the foot aiding in keeping the foot dryer.

A full length EVA foam top bed (e.g., 2205, FIGS. 20, 27) can be useful and be formed from blown TPE (thermoplastic elastomer) (e.g., 2.0 mm thick) with molded bottom net airflow channels. Benefits can include cushioning. Foam can reduce impact on joints and muscles during heel strike through gait. Air flow channels allow forced air to circulate the foot aiding in keeping the foot dryer.

Calcaneous open cell heel strike foam padding (see generally FIG. 26) can be formed from a memory foam top layer (e.g., 4.0 mm thick) with high density EVA bottom layer pads (e.g., 12.0 mm thick). Benefits of dual-density foam padding can be that it aids in comfort and shock absorption. Open cell structure allows forced air into the air channel grooves at heel strike operative aiding in keeping the foot dryer. This structure can be referred to as an ambulatory air pump and can be located in the general vicinity of the heel cushion 2000 of FIGS. 20, 27.

A molded chassis (e.g., 2010, FIGS. 20, 27) can be formed from a closed cell medium density EVA (ethyl vinyl acetate) base. Benefits include cushioning and support.

Metatarsal zone pads (e.g., 2020, FIGS. 20, 27) can be formed from molded SEBS (styrene ethylene butylene styrene), and forefoot can be formed from TPU (thermosplastic urethane) elastomer pads. These materials can provide benefits such as shock attenuation to absorb shock and provide cushioning upon impact.

A molded waist-to-heel shank/heel cup stabilizing orthotic (e.g., 2030, FIGS. 20, 27) can be formed from closed cell high density EVA. This structure and material can provide enhanced motion control, arch support and torsional stability.

The above features can be included in a product referred to as Hawx, for example.

In some embodiments, a topcover can be formed from perforated anti-microbial sublimated graphic spandex fabric. Benefits include that perforated cylinders allow air flow to the foot upon impact aiding in keeping the foot dryer. Bacteria fighting additive helps to reduce foot odor.

A top layer foam can be formed from full length open cell PU memory foam (e.g., 2.0 mm thick) with multi-depth calcaneous pads. Benefits include that these materials conform to the foot on impact for added pressure relief and comfort.

A full length chassis base can be formed from poured PU (polyurethane), which can provide superior rebound and all day comfort. Metatarsal and calcaneous pads can be co-molded poured PU elastomer regions. These can provide shock attenuating rebound properties and comfort upon impact.

A waist to heel orthotic can be formed from back screened TPU, a gradiated enhanced arch support orthotic, and a post-applied truss designed cup stabilizer. This can provide a medially extended orthotic with enhanced torsional stability and aid in preventing excess pronation.

Waterproofing Considerations

Manufacturers of work boots and cowboy boots may frequently wish to offer their customers a boot that is waterproof, so that a boot wearer can use the boots in wet conditions, if needed, without allowing excessive water inside the boots and on their feet. On the other hand, boots that are completely waterproof from bottom to top may suffer from a lack of ventilation within the boot, thereby encouraging perspiration, which is another source of undesirable foot moisture. A fully-waterproof boot may also be unnecessarily expensive. Boot manufacturers may choose to accommodate these opposing considerations with a boot that is waterproof for a selected distance up from the bottom of the boot and that is not waterproof for the remainder of the distance up to the top of the boot. Waterproofing all or some (e.g., a lower portion) of a boot may be accomplished by forming the lower portion from waterproof materials, by inserting a waterproof internal vamp lining into the shoe box 110 of the boot 100, by spraying or otherwise applying a waterproof coating to the lower portion of the boot, and/or by a variety of other methods.

Figure 28:
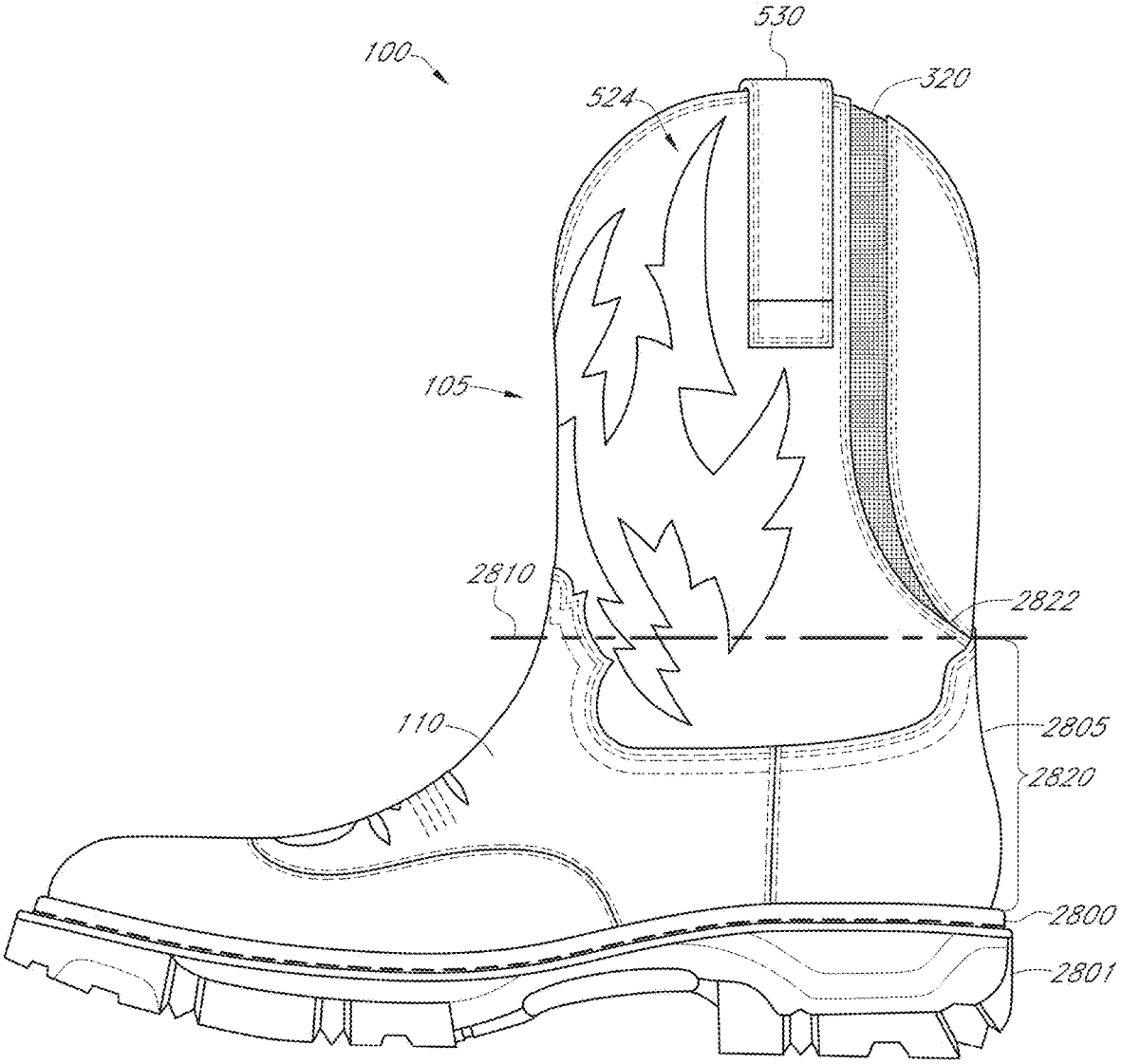
FIG. 28 shows one embodiment of a boot that is designed with a waterproof lower portion and a non-waterproof upper portion.

FIG. 28 shows an embodiment of a boot with a waterproof lower portion and a less-waterproof upper portion. A bite line 2800 of the boot 100 is a line around the perimeter of the shoe box 110 where the shoe box 110 is attached to the sole 2801 of the boot, frequently with stitching, gluing, or other connecting methods. A foxing 2805 is a piece of leather or other leather-like material that is sewn or otherwise overlaid over a portion of the boot, such as over a toe portion or a rear portion of the shoe box 110 for decoration and/or to provide extra support, such as for the wearer's heel when wearing the boot. As shown in FIG. 28, a top edge of the foxing 2805 can be cut in a decorative shape for aesthetic reasons and for providing additional protection for the wearer's Achilles tendon region.

FIG. 28 also includes a waterproof line 2810, shown parallel with the ground and a distance 2820 above the bite line 2800. The waterproof line 2810, which is often not discernible from the outside of the boot, is a line that demarcates the lower, waterproof portion of the boot. In some embodiments, the waterproof line 2810 may be an imagined, conceptual line.

Frequently, boot manufacturers define a "waterproof" boot as one that is waterproof for a selected distance up from the bite line 2800, or from another standard point near the bottom of the boot, such as the bottom of the sole 2801 of the boot. This is often sufficient to allow a wearer to walk through large puddles while maintaining dry feet. For example, a boot manufacturer may determine that four inches above the bite line 2800 is a good placement for the waterproof line 2810, providing a sufficient amount of waterproof boot below the line 2810 to keep the boot wearer's feet dry, comfortable, and safe. Other manufacturers may determine that a distance 2820 of five inches, or three inches, or any other desired distance 2820 above the bite line 2800 or other specified point will provide a desired amount of waterproofed boot. For example, a manufacturer may designate a position for the waterproof line 2810 that is a certain number of multiples of a height of the shoe box 110 above a bite line 2800, such, for example, two times the height of the shoe box or one and a half times the height of the shoe box 110. In FIG. 28 the waterproof line 2810 is positioned very close to the top of the foxing 2805; however, this relative placement is not required.

When a boot designed to be waterproof includes a resilient feature 320 that extends below the waterproof line 2810, if the resilient feature 320 is made of non-waterproof material, the resilient feature 320 may compromise the waterproof protection provided by the boot 100 in the area below the waterproof line 2810.

One solution to such a situation is to use a waterproof resilient material, such as a waterproof elastic, to form the resilient feature 320. For example, if any of the boots 100 shown in FIGS. 5-12 were to be waterproof, and if the resilient features 320 extended below the waterproof lines 2810 (which are not shown in FIGS. 5-12) of the boots, the manufacturer may choose to use waterproof elastic to ensure the integrity of their waterproof protection.

Additionally or alternatively, the resilient feature 320 can terminate at a point above the waterproof line 2810. An example is shown in FIG. 28, where the resilient feature 320 terminates at a point 2822 that is above the waterproof line 2810. Additionally, the resilient feature 320 in FIG. 28 is shown to extend downward while curving toward the rear of the boot 100. This placement can allow for more stretch of the resilient feature 320, and therefore of the boot shaft 105, right near one of the pressure points where the wearer's heel may push against the inside of the boot shaft 105 as the wearer's foot enters or exits the boot shaft 105. Examples of such pressure points are depicted in FIG. 2B.

Figure 29:
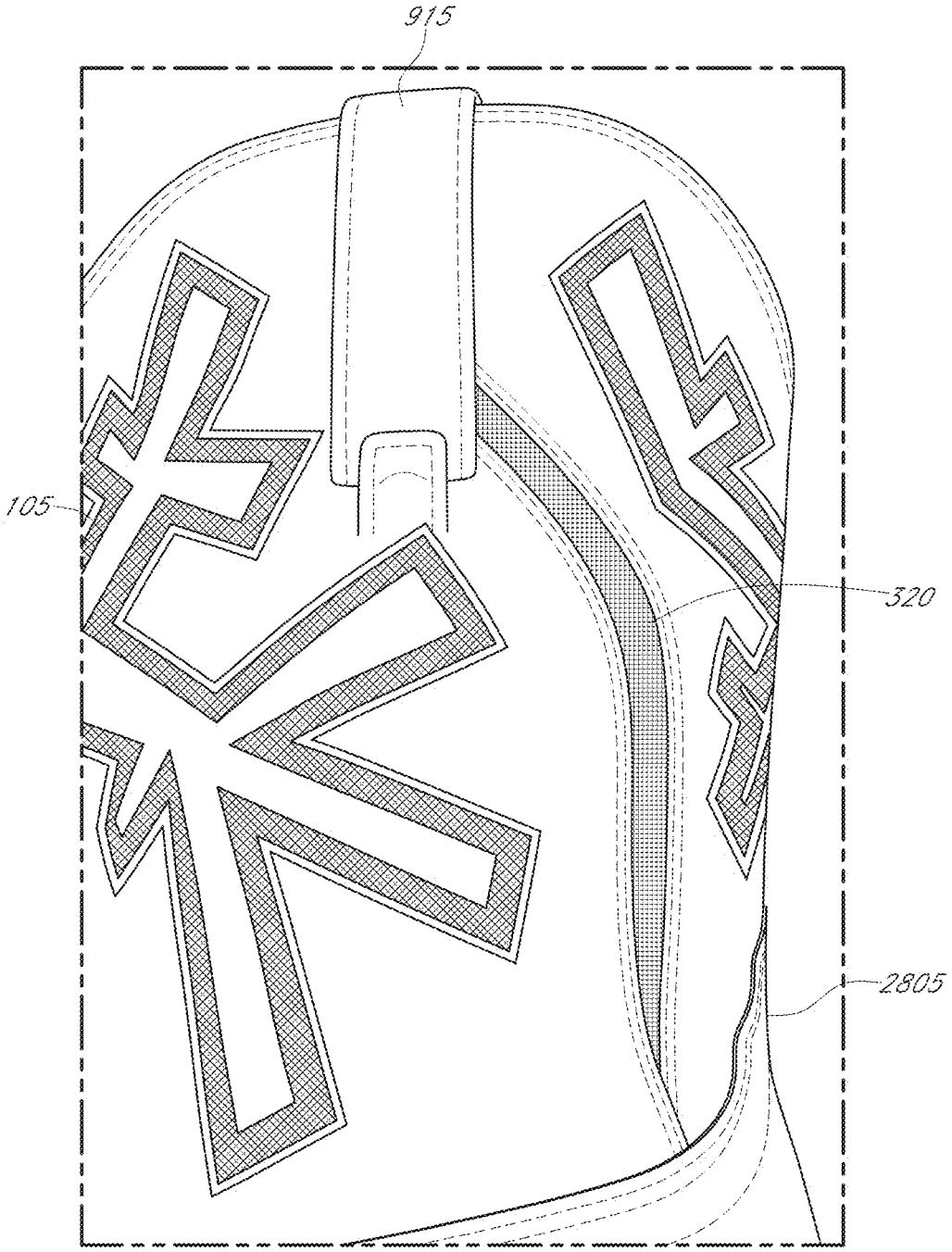
FIG. 29 shows a close up of a boot shaft with a resilient feature.

FIG. 29 shows a close up of a boot shaft 105 with a resilient feature 320 that extends from beneath a pull tab 915 in an arced and tapered curve towards a top edge of the foxing 2805 at the rear of the boot shaft 105. The placement and shape of the resilient feature can accommodate waterproof aspects of a boot, as discussed above.

Figure 30:
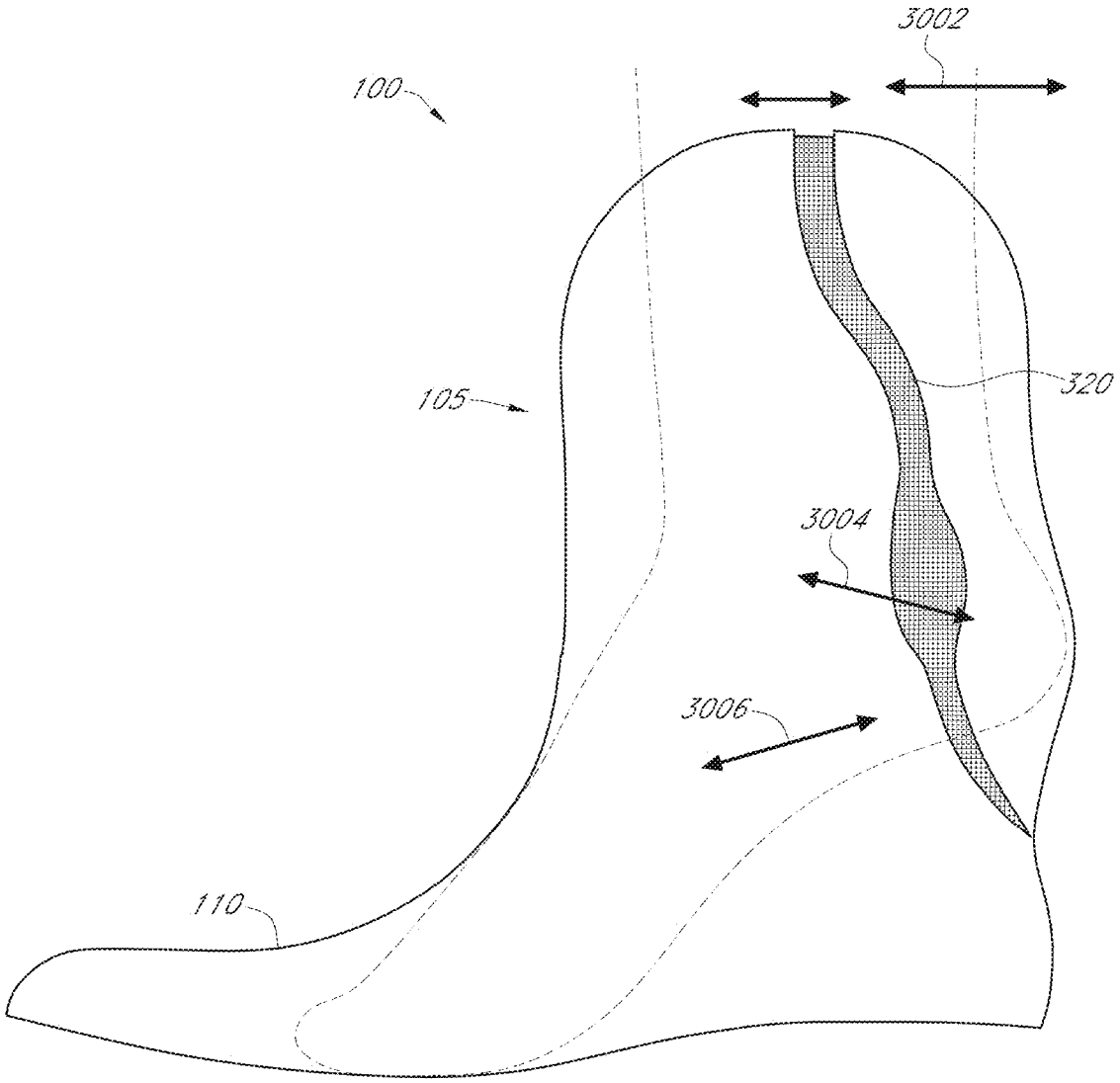
FIG. 30 is a schematic diagram illustrating a foot entering or exiting the boot shown in FIG. 29.

FIG. 30 is a schematic diagram illustrating how a foot entering or exiting a boot through the shaft 105 can be aligned with features of a resilient feature 320 shaped generally like the resilient feature of FIG. 29. The description of FIG. 4, which shows a resilient feature 320 of a different shape, applies generally to FIG. 30 as well. The arrows 3002, 3004, 3006 show some of the possible directions of stretch provided by the resilient material.

Figure 31:
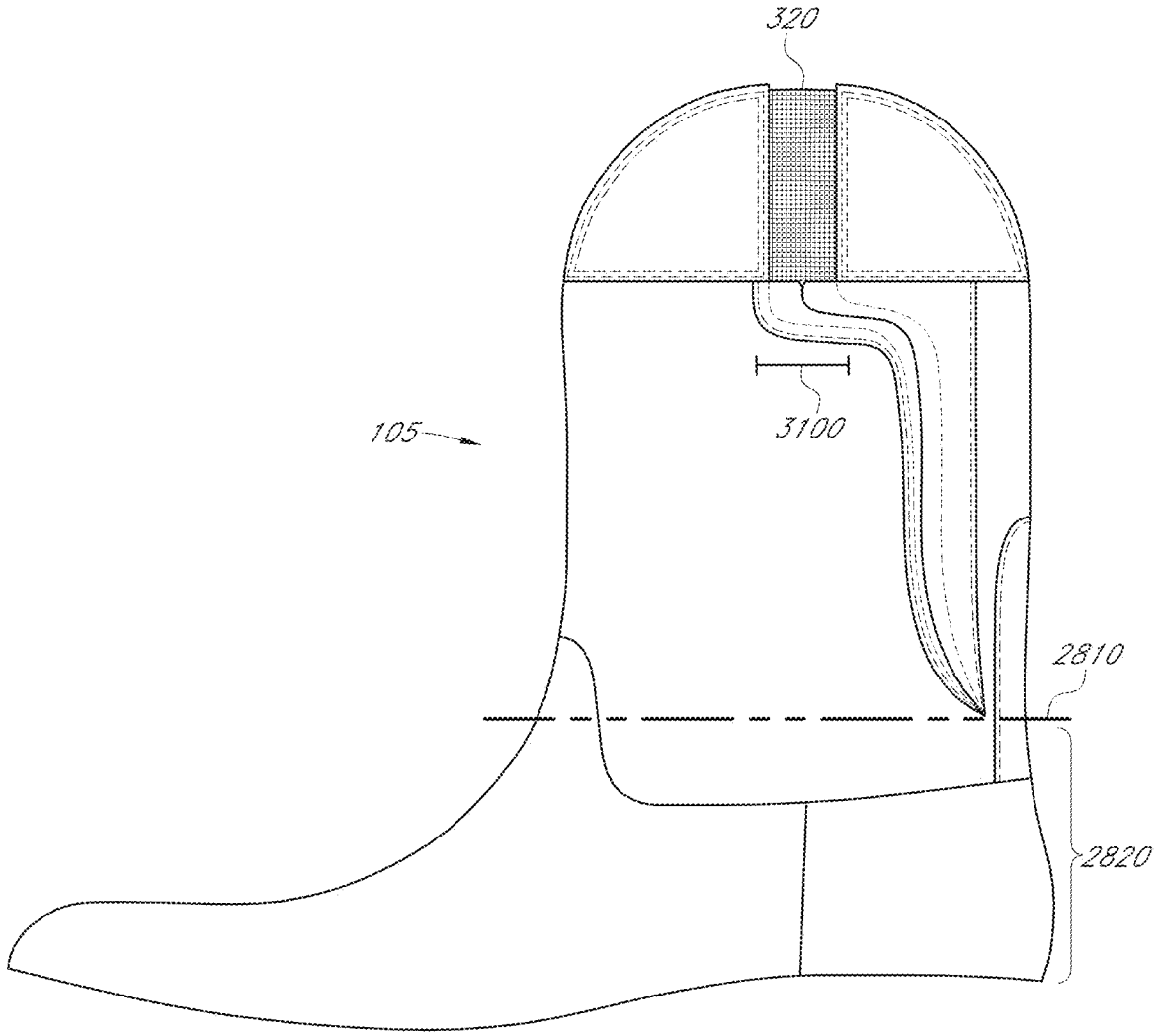
FIG. 31 shows the inside of a boot as shown in FIG. 29.

FIG. 31 shows the inside of a boot having a resilient feature 320 that terminates at or above the waterproof line 2810. Stitching line 3100 shows the area where stitching may attach a pull tab (e.g., pull tab 915, not shown in this figure) to the boot shaft 105. As shown, the stitching line 3100 is positioned below where the resilient feature 320 turns sharply to the right. Placing the stitching line 3100 in this position allows the resilient feature 320 to stretch and/or be deformed without any constraint from the stitching line 3100. This figure also illustrates how an interior lining of a boot shaft can advantageously avoid spanning a gap spanned by a resilient feature 320. Near the top, much of the width of a resilient feature is exposed (in this interior view), such that ΔA and ΔD are similar, while ΔB and ΔC are minimized. Closer to the waterproof line 2810, this changes such that ΔD is minimized, while ΔB+ΔC approach the same width as ΔA. Thus, as a foot enters the boot, it slides past a more continuous material (often formed from a substance with a slick surface) having a less prominent seam—as opposing sides abut or nearly abut.

Figure 32:
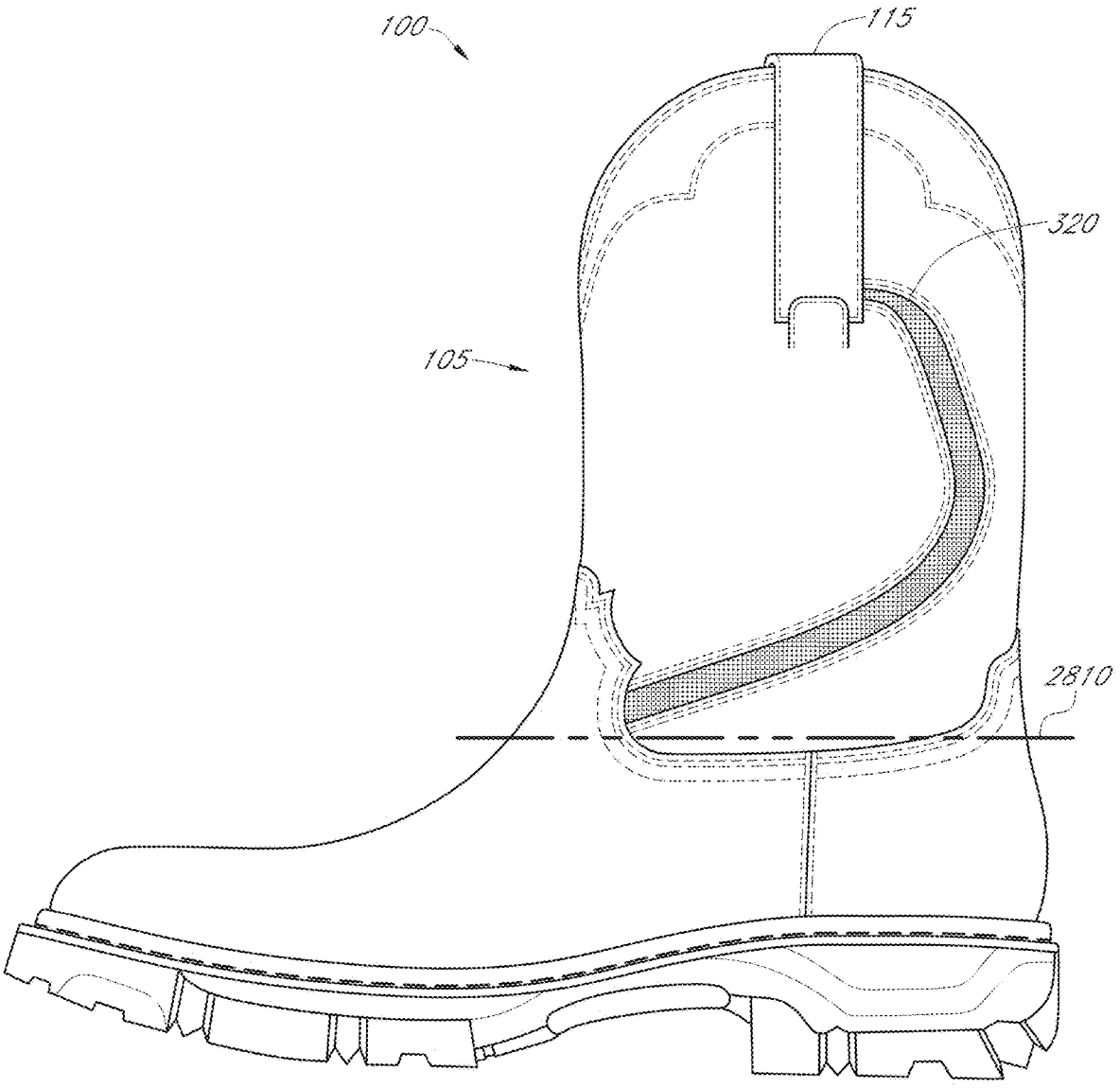
FIG. 32 shows another embodiment of a boot.

FIG. 32 shows another embodiment of a boot 100, this one having a wider resilient feature 320 that curves first down and to the rear, then forward, terminating above the waterproof line 2810. Using the framework disclosed with regard to FIG. 3, the resilient feature 320 of FIG. 32 is shown as having a relatively large exposed area (ΔD) and relatively narrow "flaps" (ΔB and ΔC) to cover the exposed area, thus disclosing an alternative design choice with respect to earlier embodiments shown, in which the ΔD was minimized, covered, and/or camouflaged. This embodiment, in contrast, uses the resilient feature 320 as a bold design feature that echoes the curve of the foot and boot shape. The placement and shape of the resilient feature can accommodate waterproof aspects of a boot, as discussed above.

Figure 33:
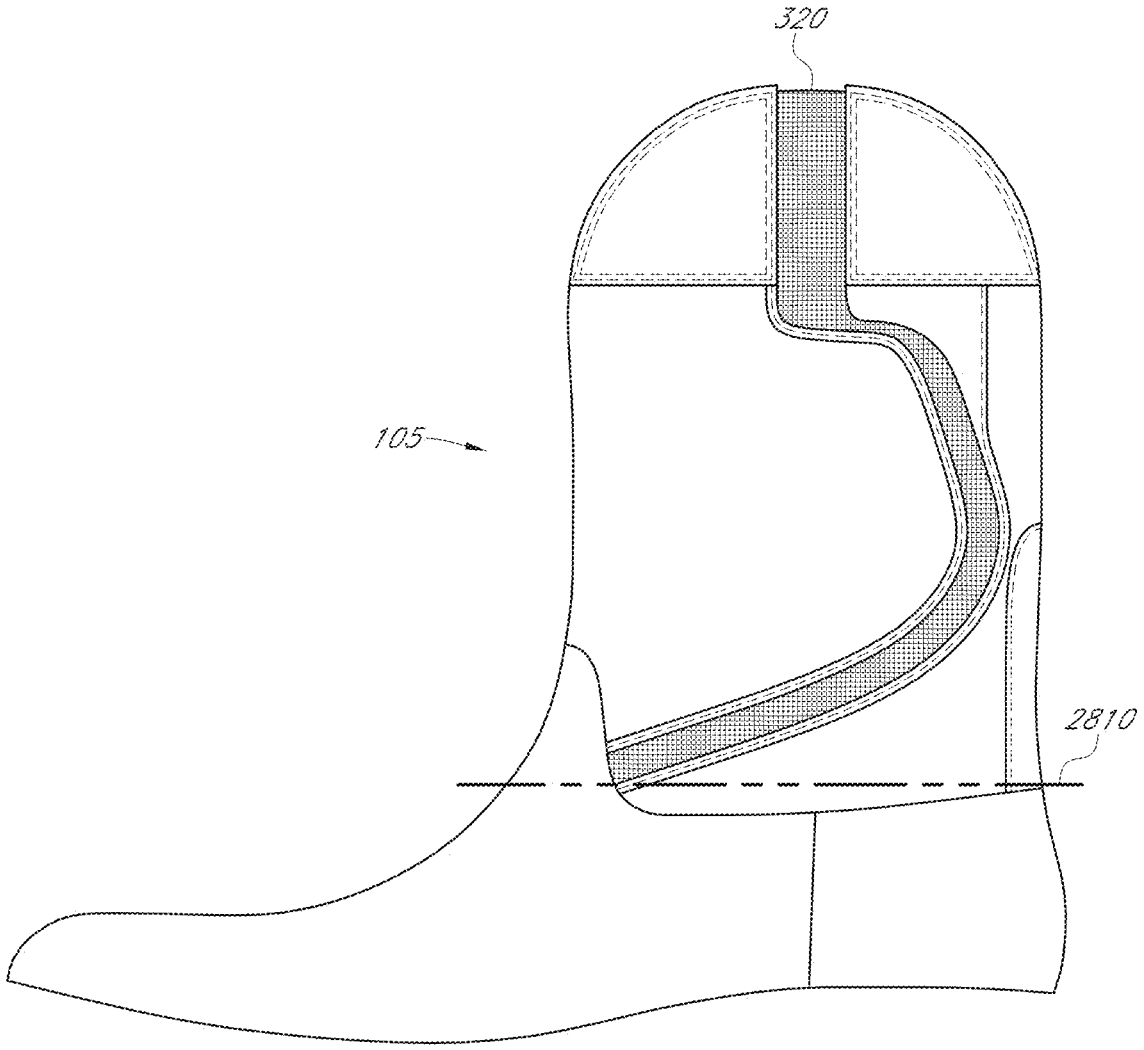
FIG. 33 shows the inside of a boot having a resilient feature as shown in FIG. 32.

FIG. 33 shows the inside of a boot having the resilient feature 320 shown in FIG. 32, where the resilient feature 320 terminates at or above the waterproof line 2810. Here, as with the outside of the boot, the ΔD portion of the resilient feature is exposed such that ΔB and ΔC are minimized and remain relatively constant for the length of the feature 320, while ΔA and ΔD also remain relatively constant. The shape of the resilient feature 320 can affect the amount and angle at which portions of the shaft can stretch or separate. In this embodiment, the front portion of the shaft can hinge forward and upward, generally about a point near the front of the shaft. This embodiment allows room for a reinforced section at the rear of the boot shaft (which may be configured to provide a strong sliding surface for a heel to pass by).

Figure 34:
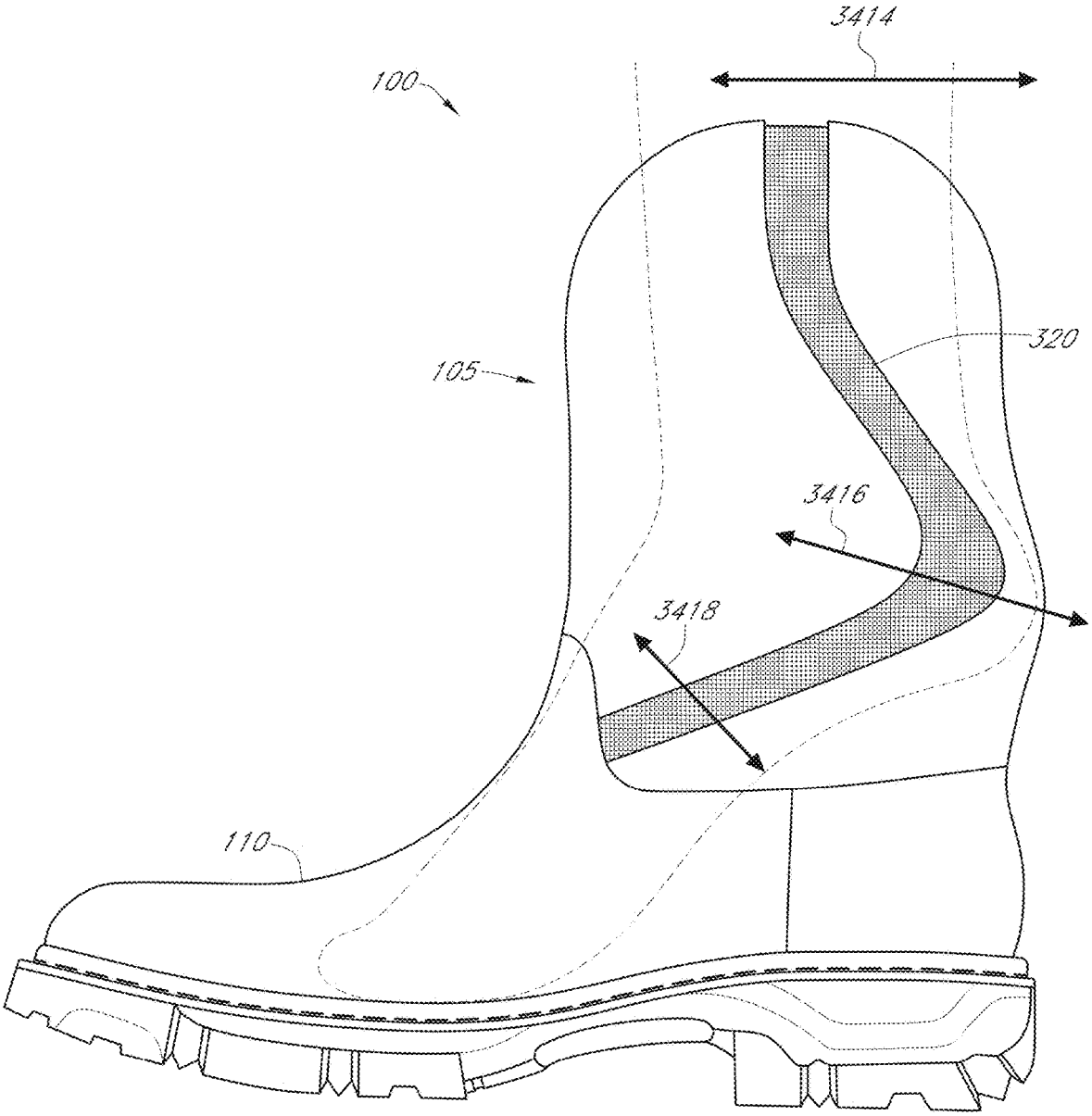
FIG. 34 is a schematic diagram illustrating a foot entering or exiting the boot of FIG. 32.

FIG. 34 is a schematic diagram illustrating how a foot entering or exiting a boot through the shaft 105 can be aligned with features of a resilient feature 320 shaped generally like the resilient feature of FIG. 32. The description of FIG. 4, which shows a resilient feature 320 of a different shape, applies generally to FIG. 34 as well. The arrows 3414, 3416, 3418 show some of the possible directions of stretch provided by the resilient material.

Figure 35:
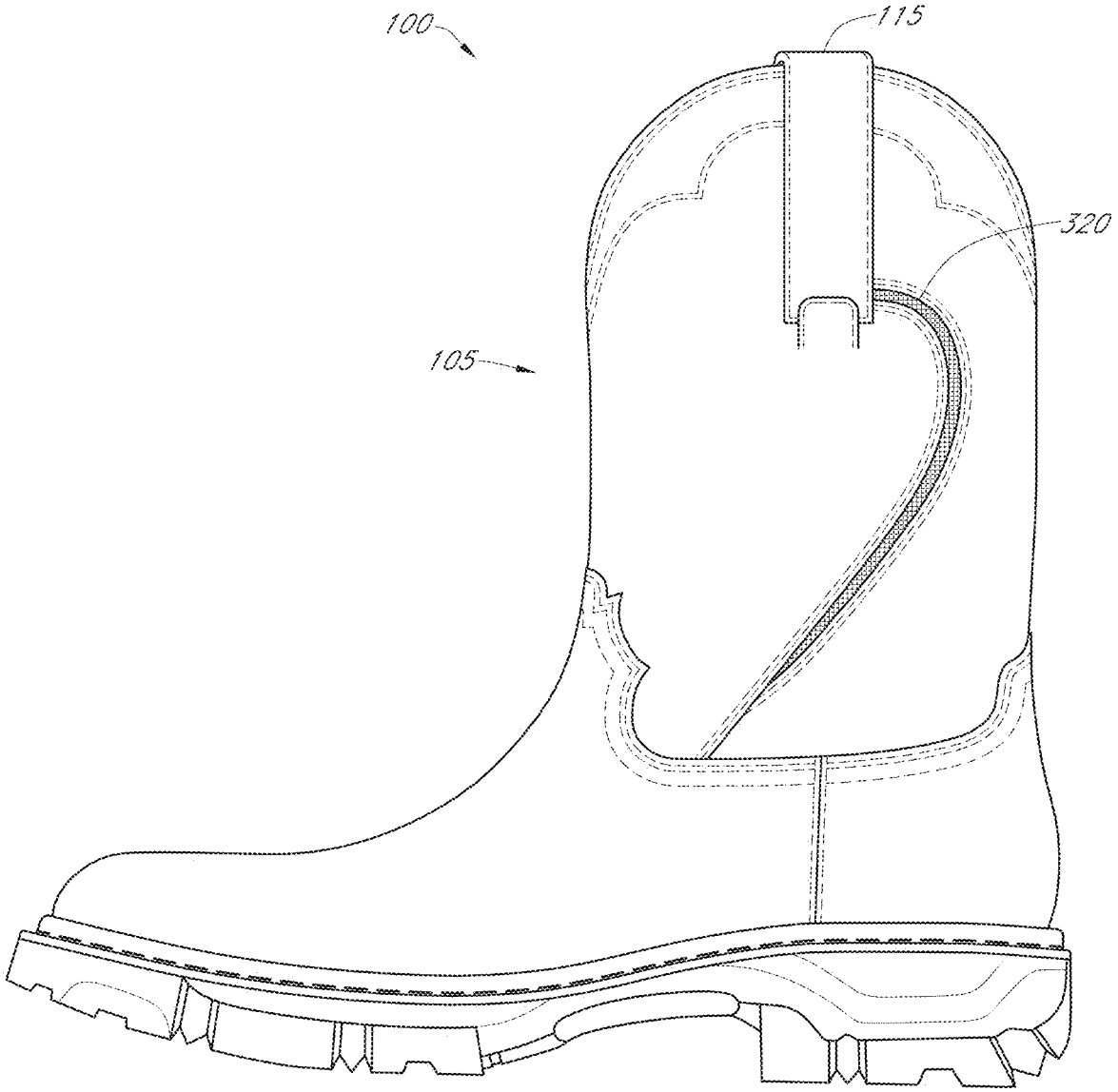
FIG. 35 shows another boot with a resilient feature, this one extending from beneath the pull tab.

FIG. 35 shows another boot 100 with a resilient feature 320, this one extending from beneath the pull tab 115 in a curved arc that extends down and generally toward the front of the boot shaft 105. In this embodiment, the exposed portion ΔD of the resilient feature 320 tapers and narrows as it extends down, to the point where ΔD=0 and the gap is completely closed. Thus, if this is a waterproof boot, the ΔD gap can be closed before the resilient feature 320 reaches the waterproof portion toward the bottom of the boot.

Figure 36:
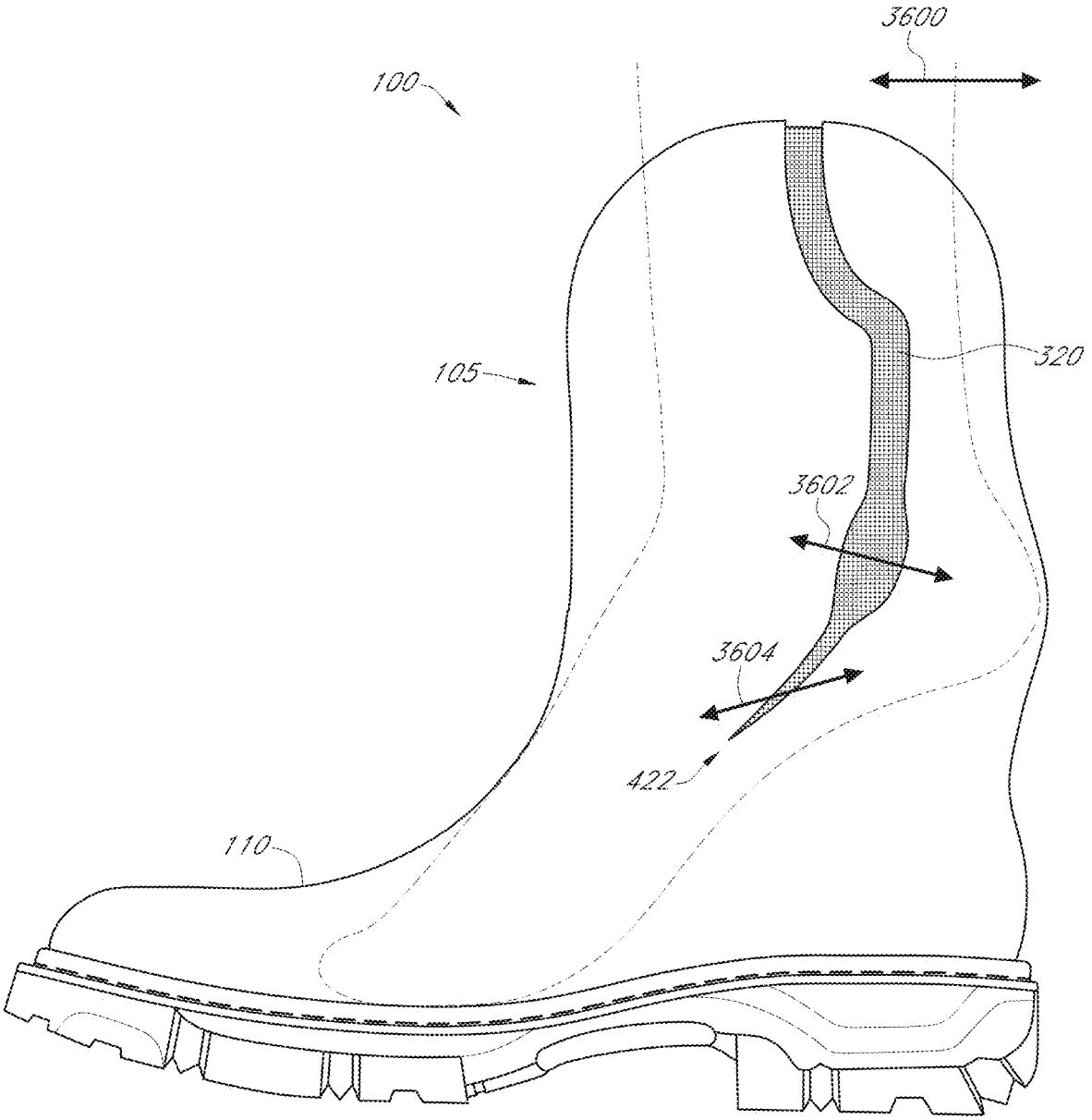
FIG. 36 is a schematic diagram illustrating a foot entering or exiting the boot of FIG. 35.

FIG. 36 is a schematic diagram illustrating how a foot entering or exiting a boot through the shaft 105 can be aligned with features of a resilient feature 320 shaped generally like the resilient feature of FIG. 35. The description of FIG. 4, which shows a resilient feature 320 of a different shape, applies generally to FIG. 36 as well. The arrows 3600, 3602, 3604 show some of the possible directions of stretch provided by the resilient material.

Figure 37:
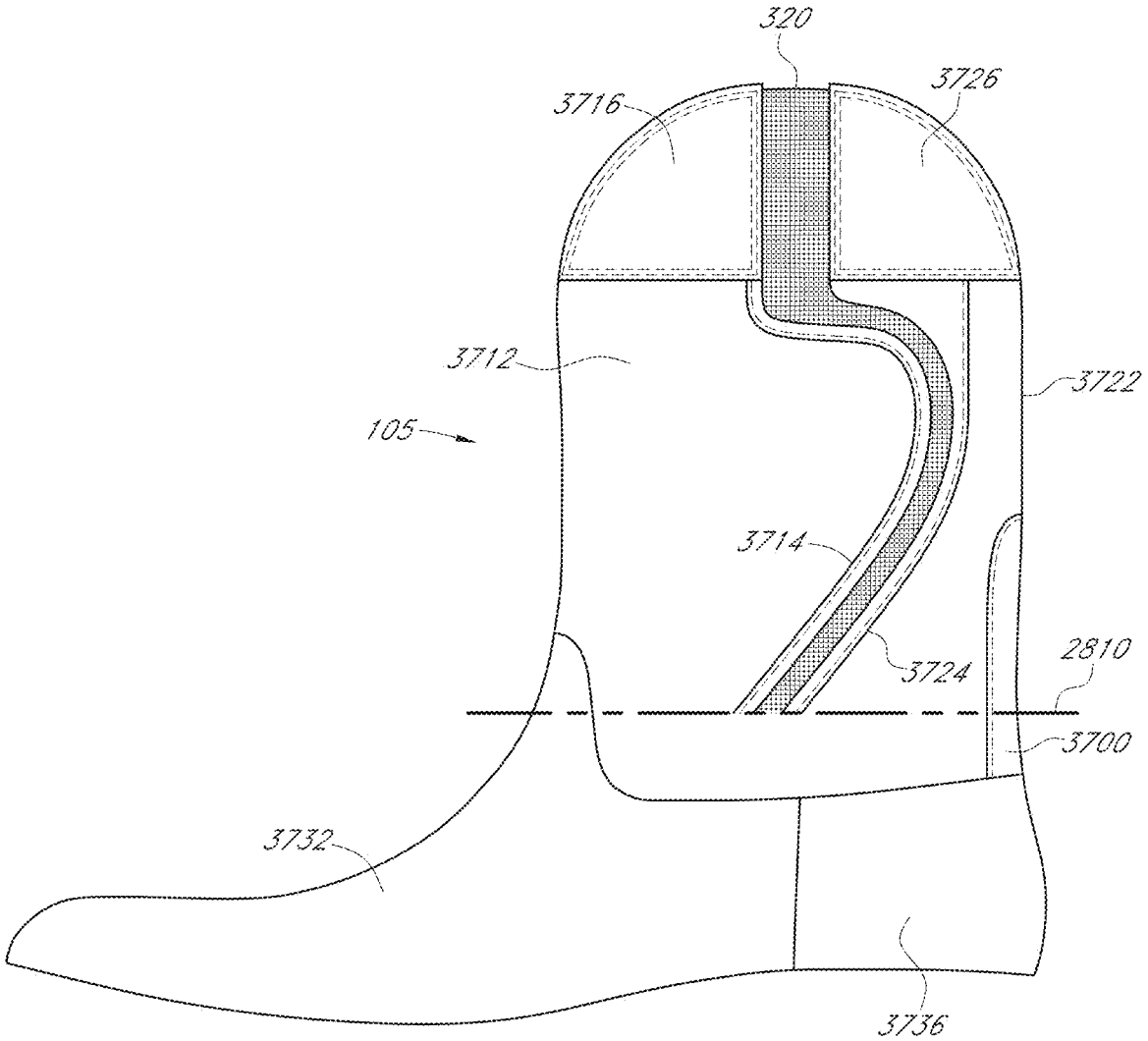
FIG. 37 shows the inside of a boot having a resilient feature, the outside of which was shown in FIG. 35.

FIG. 37 shows the inside of a boot having the resilient feature 320 of FIG. 35, where the resilient feature 320 terminates at or above the waterproof line 2810. Here, however, the ΔD portion of the resilient feature does not taper to a point but rather terminates at the waterproof line 2810. This figure shows an internal heel slide or counter 3700. An internal front shaft lining 3712 is shown, bordered near the resilient feature 320 by an internal front elastic cover 3714. An internal top front collar lining 3716 can provide a strong surface for a user to grasp when pulling a boot on his or her foot. An internal back shaft lining 3722 has a corresponding internal back elastic cover 3724 and an internal top back collar lining 3726. Generally below the shaft where a user's foot will be positioned, an internal vamp lining 3732 can be provided and can interface with the internal front shaft lining 3712 and the internal back shaft lining 3722. The internal heel slide or counter 3700 can be a hard piece of leather, fiberglass, or other supporting material that allows a user's heel to settle into an internal counter pocket 3736 and can create a foundation of support for the back of the wearer's foot.

Figure 38:
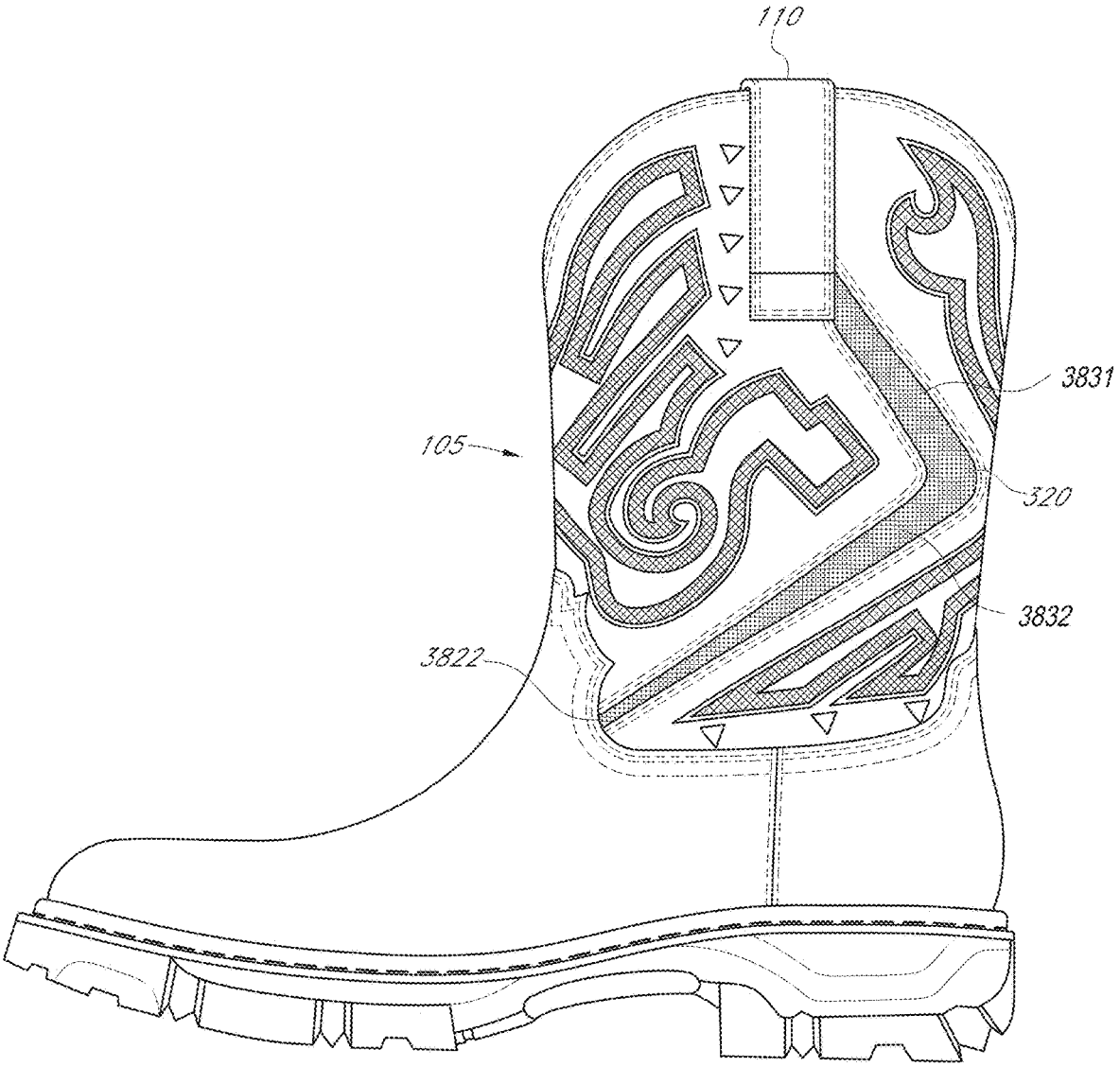
FIG. 38 shows a boot with a resilient feature extending from under a pull tab.

FIG. 38 shows another boot 100 with a resilient feature 320, this one extending from behind the pull tab 115 first down and to the rear, then angling down and toward the front as it tapers and narrows. The resilient feature 320 can comprise an upper angled linear portion 3831 and a lower angled linear portion 3832 that converge at the vertical level of the donning point. The lower linear portion can terminate at a lower terminus 3822 near the doffing point. Although the gap ΔD is not completely closed at the lower terminus 3822 of the resilient feature 320, the resilient feature 320 may terminate at a point that is above a waterproof line (not specifically depicted here). The terminus 3822 can serve (together with a mirrored terminus on the other side of the boot not visible in this view) as an effective hinge as the front portion of the boot shaft rotates up and away from the back during foot entry (as permitted by stretching by the resilient portion 320). This resilient portion has its greatest visible width at roughly the vertical midpoint of the shaft. This can also generally correspond to a position of maximum pressure when a heel is pushed into the shaft upon entry. Maximizing available resilient material at such a position can greatly enhance comfort and function. Numerous experiments have been performed to identify a useful position for a wide point of a resilient material 320. It can be helpful to position a wide portion thereof at a "donning point," or a point at which a heel most forcefully encounters the back of a boot when being put on, or donned, by a user. A heel slide (e.g., formed from leather) can be secured to the back inside portion of a boot to assist a heel in sliding past this point. In FIG. 38, the reference numeral 320 is located near a donning point. When a resilient portion 320 is shaped as shown here, elongate portions of resilient material can provide lengths of stretching function that radiate in two lines from this donning point, increasing comfort and increasing available stretch. Similarly, a "doffing point" can correspond to the place at which a front of a foot most forcefully and directly encounters the top inside portion of a boot when a user doffs the boot (e.g., extracts his or her foot therefrom). A doffing point can be located close to the reference numeral 3822 in this figure. The front of the boot shaft can hinge upwardly and forwardly, generally around this point, to aid in the doffing function and allow a foot to exit more comfortably.

Figure 39:
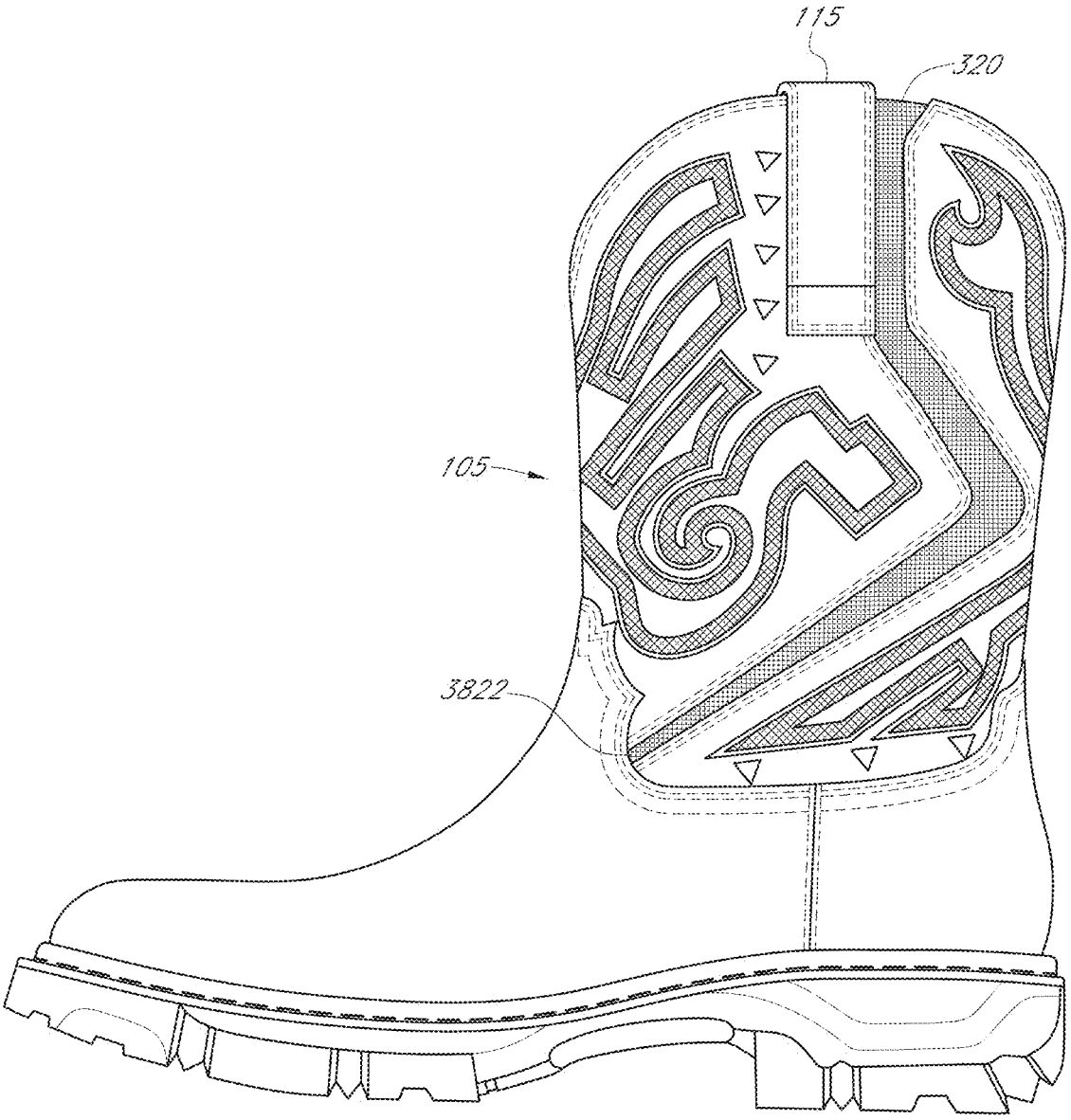
FIG. 39 shows a boot similar to the configuration seen in FIG. 38, but with a resilient feature terminating at the top, next to, and not under, the pull tab.

FIG. 39 shows another boot 100 that is very similar to the boot shown in FIG. 38. This example also has an angular resilient feature 320 that extends back and then toward a point 3822 at the front of the boot shaft that can be above the waterproof line 2810 (not shown) for waterproof boots. In this embodiment, the resilient feature 320 is slightly wider at its terminus 3822 than was the resilient feature 320 shown in FIG. 38. Also, in FIG. 39, the resilient feature extends up alongside the pull tab 115 all the way to the top of the boot shaft 105 rather than having its top portion covered behind the pull tab 115. This top portion of the resilient feature 320 can also, optionally, extend at least partially behind the pull-tab 115. A "waterproof" label can be sewn into the boot to indicate a general height of a waterproof line.

Figure 40:
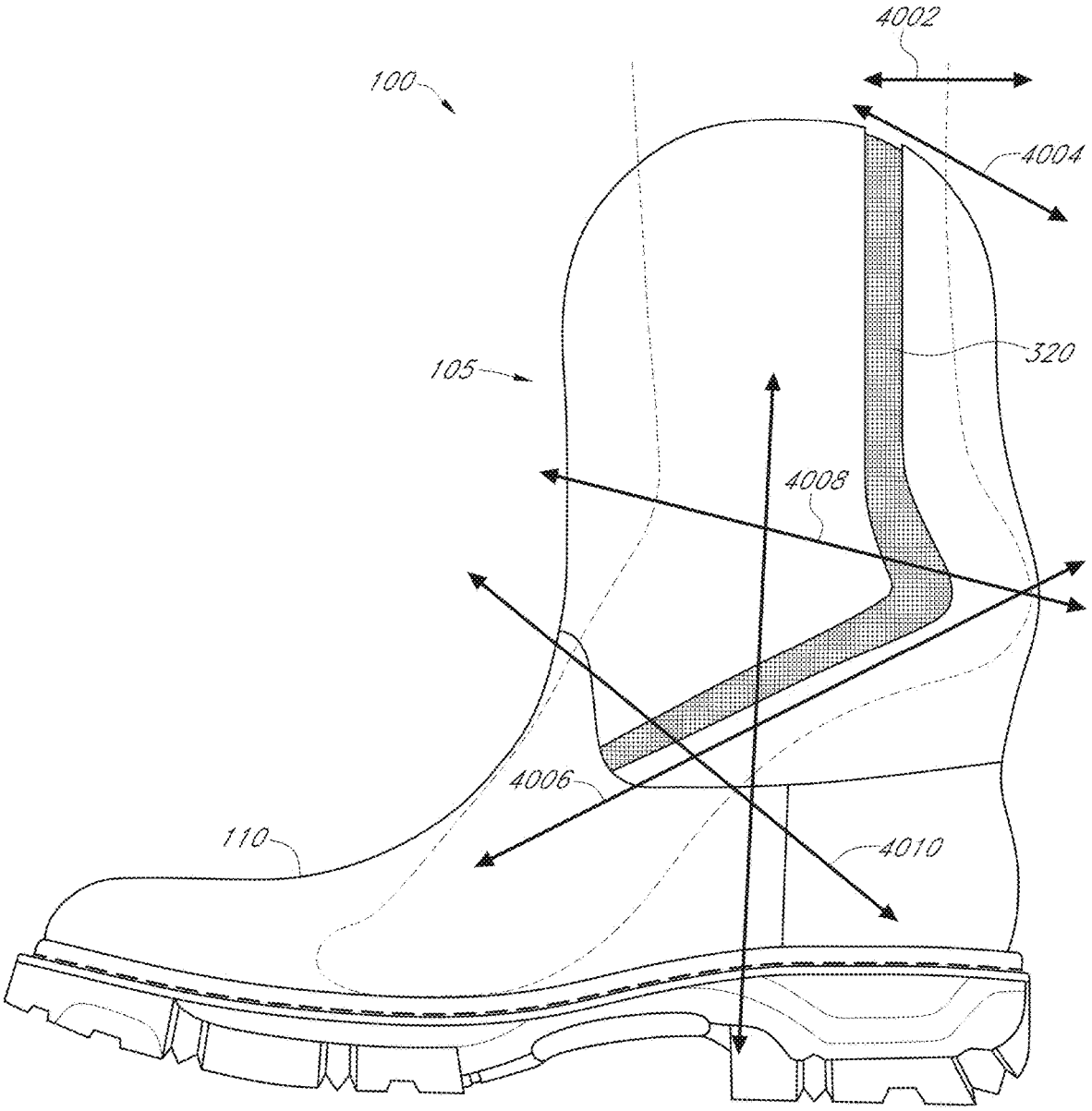
FIG. 40 is a schematic diagram illustrating a foot entering or exiting a boot similar to the one shown in FIG. 39.

FIG. 40 is a schematic diagram illustrating how a foot entering or exiting a boot through the shaft 105 can be aligned with features of a resilient feature 320 shaped generally like the resilient feature of FIG. 38 or FIG. 39. The description of FIG. 4, which shows a resilient feature 320 of a different shape, applies generally to FIG. 40 as well. The arrows 4002, 4004, 4006, 4008, and 4010 show some of the possible directions of stretch provided by the resilient material. Stretch can occur along one or more of these directional axes during different times as a foot enters the boot. The foot shown schematically in this figure illustrates the donning and doffing points discussed above with respect to FIG. 38.

Figure 41:
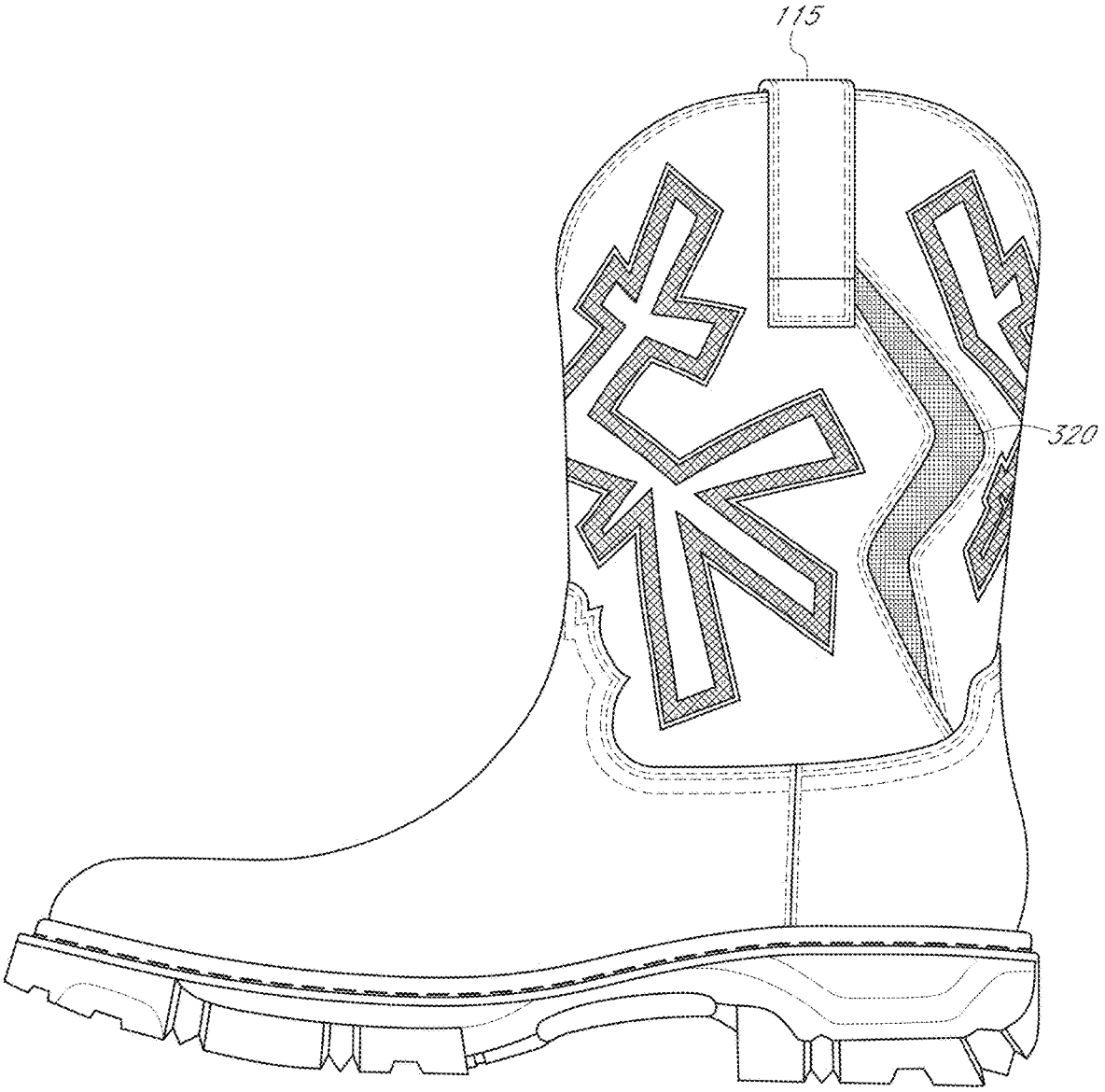
FIG. 41 shows another example of a boot with a resilient feature extending from under a pull tab.

FIG. 41 shows another boot 100 with a resilient feature 320, this one extending from behind the pull tab 115 in slightly rounded zig-zag shape of varying width ΔD that extends back toward the rear of the boot shaft 105. In this embodiment, the exposed portion of the resilient feature 320 provides expansion and possible ventilation to the boot shaft, and also serves as an aesthetic component of the boot shaft design.

Figure 42:
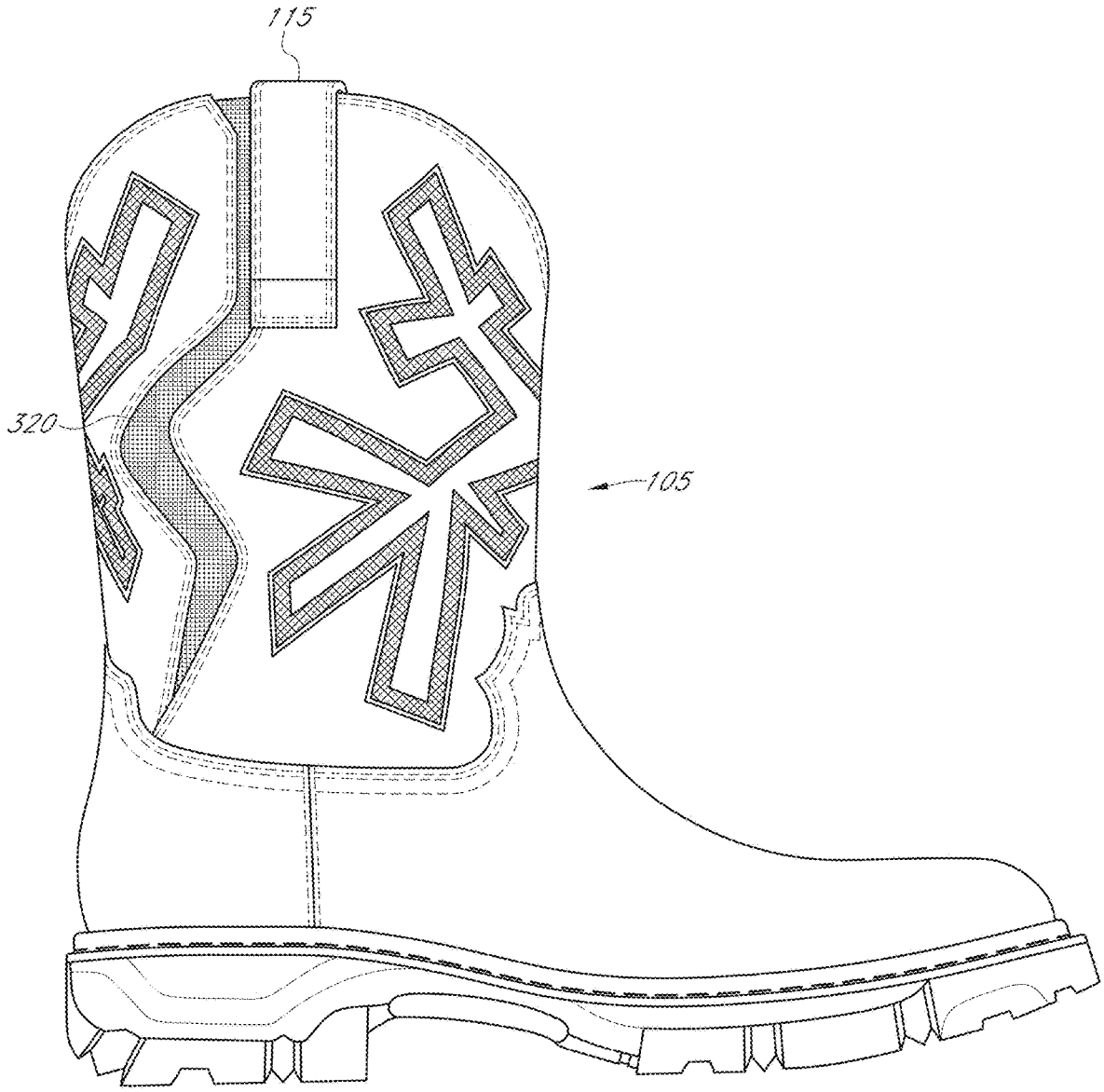
FIG. 42 shows a boot similar to that of FIG. 41, but with a resilient feature terminating at the top, next to, and not under, the pull tab.

FIG. 42 shows another boot 100 that is very similar to the boot shown in FIG. 41, having slightly rounded zig-zag shape resilient feature 320 that extends back towards the rear of the boot shaft. In this embodiment, the resilient feature extends up alongside the pull tab 115 all the way to the top of the boot shaft 105 rather than having its top portion entirely covered behind the pull tab 115. This top portion of the resilient feature 320 can also, optionally, extend at least partially behind the pull-tab 115. A "waterproof" label can be sewn into the boot to indicate a general height of a waterproof line.

Figure 43:
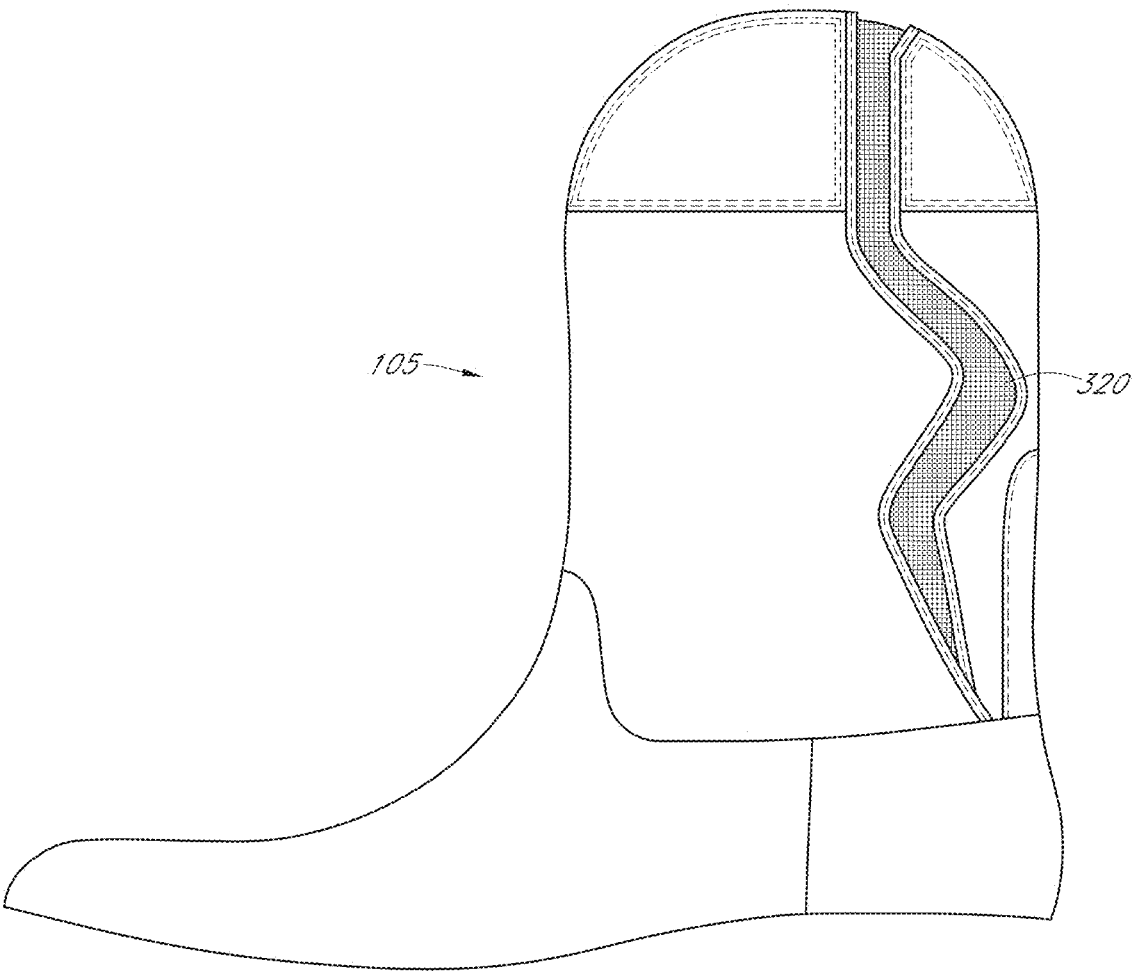
FIG. 43 shows the inside of a boot having a resilient feature, the outside of which was shown in FIG. 42.

FIG. 43 shows the inside of a boot having the resilient feature 320 of FIG. 42, where the resilient feature 320 terminates at or above the waterproof line 2810.

Boot Linings

Boots often include a lining. A lining can cover seams inside the boot, provide some cushioning, and make walking in the boot more comfortable. Linings can facilitate foot entry and provide materials designed for apposition with a wearer's sock or skin. Depending on the material used, a lining can also allow air to flow inside the boot, helping moisture evaporate and helping to regulate the temperature and/or moisture level within the boot.

Figure 44:
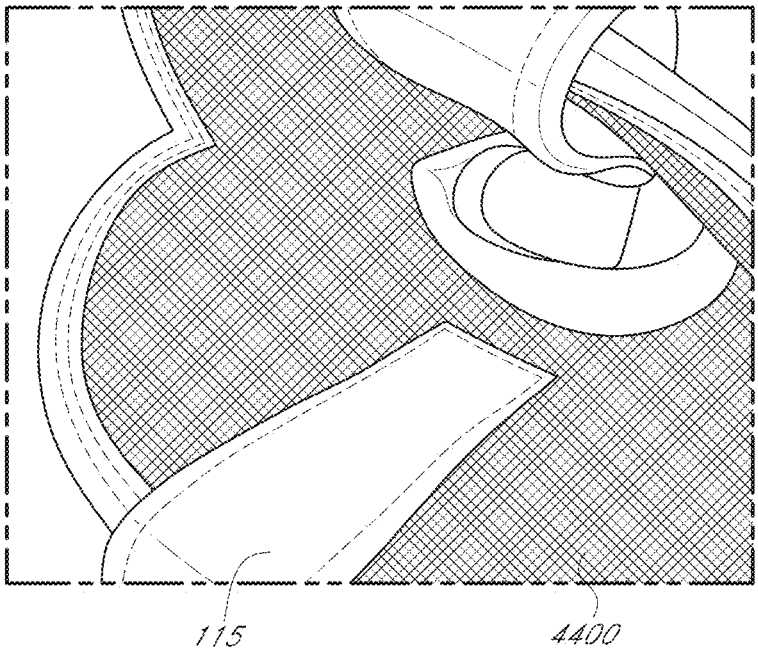
FIG. 44 shows a portion of a full lining inside a boot shaft.

FIG. 44 shows a view of a boot, looking into the interior of the boot shaft 105 from above. In the embodiment shown, the boot lining 4400 appears to cover the entire interior of the boot shaft, at least. An inside portion of a pull tab 115 can be seen extending down into the interior of the boot shaft. In the embodiment shown, the boot lining 4400 material is a textured, perforated, woven material that may provide some breathability to the interior of the boot shaft and may include some resiliency. However, with such a unitary lining, any resilient features 320 that may be included in the exterior of the boot shaft 105 will be constrained by the resiliency, or lack thereof, of such a boot lining 4400.

Figure 44B:
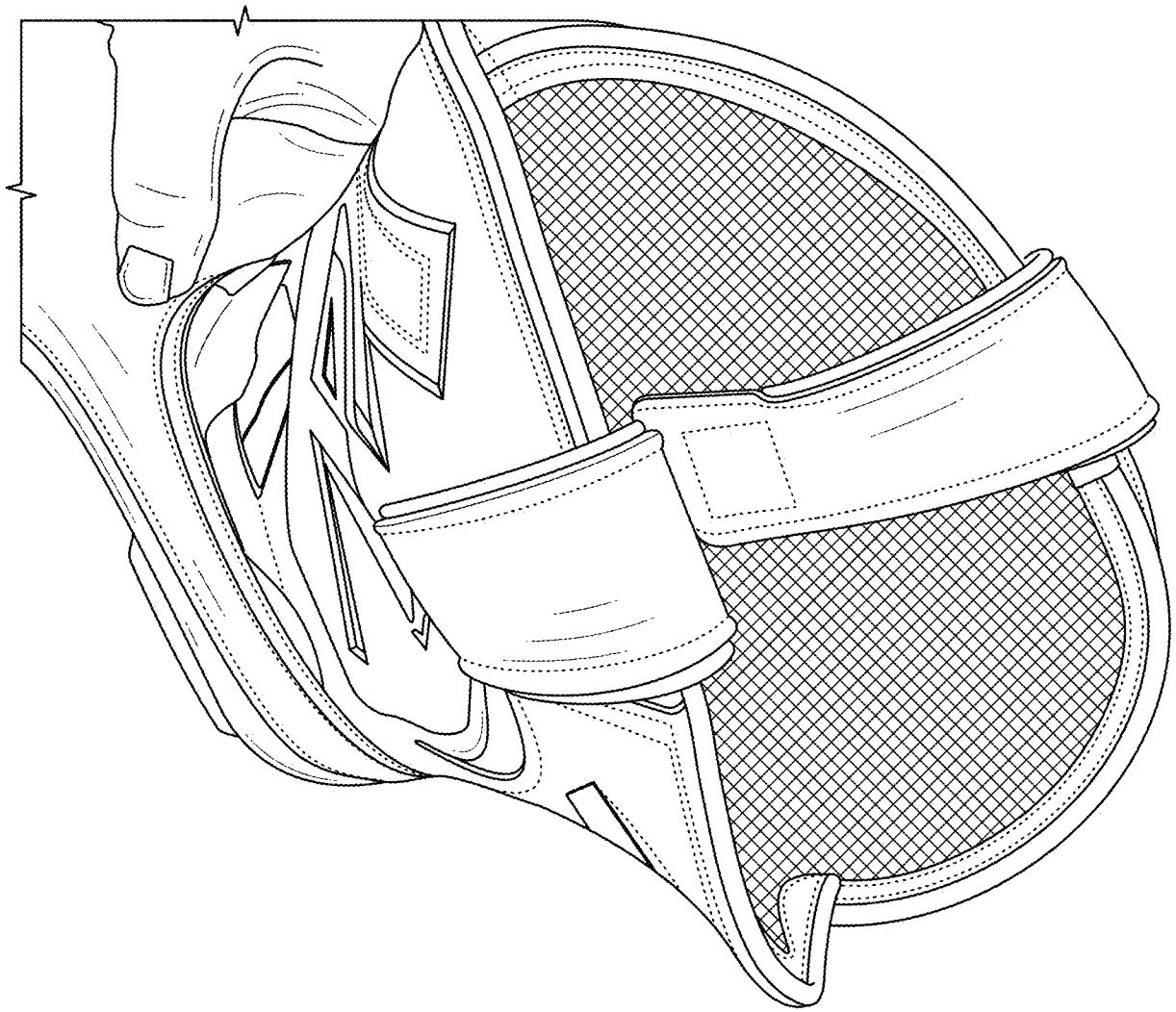
FIG. 44B is a line drawing of a photographic image of a boot with a full lining as described with reference to FIG. 44.

FIG. 44B is a photographic image of a boot with a full lining as described with reference to FIG. 44. In the photograph of FIG. 44B, a resilient feature can be seen curving down from the pull tab. If the unitary lining extends down behind the resilient feature, then the resilient feature will be constrained by the resiliency, or lack thereof, of the boot lining.

Figure 45:
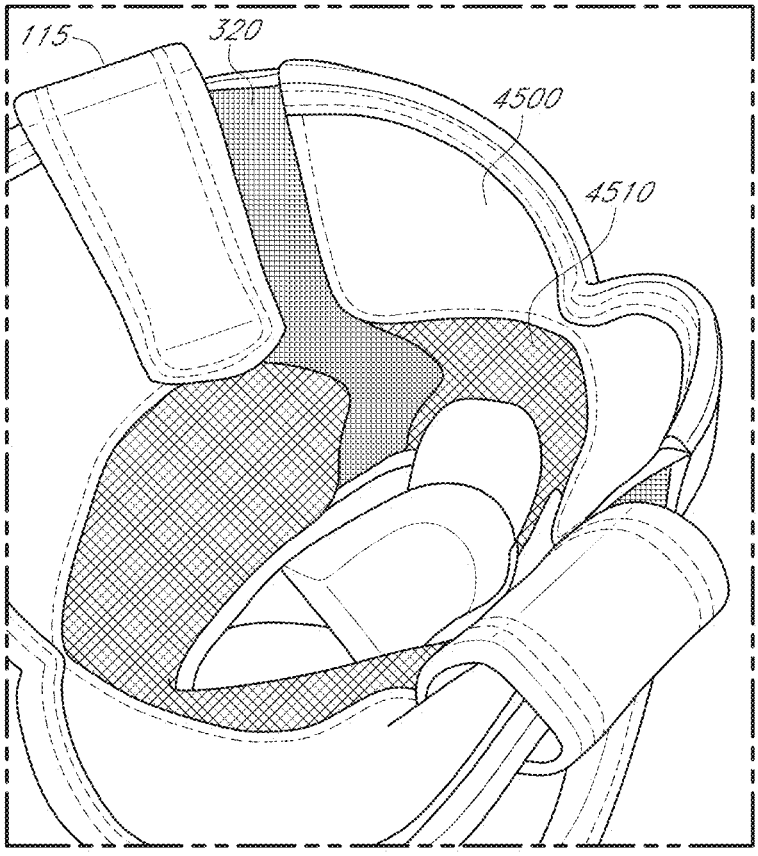
FIG. 45 shows a portion of a customized lining inside a boot shaft.
Figure 45B:
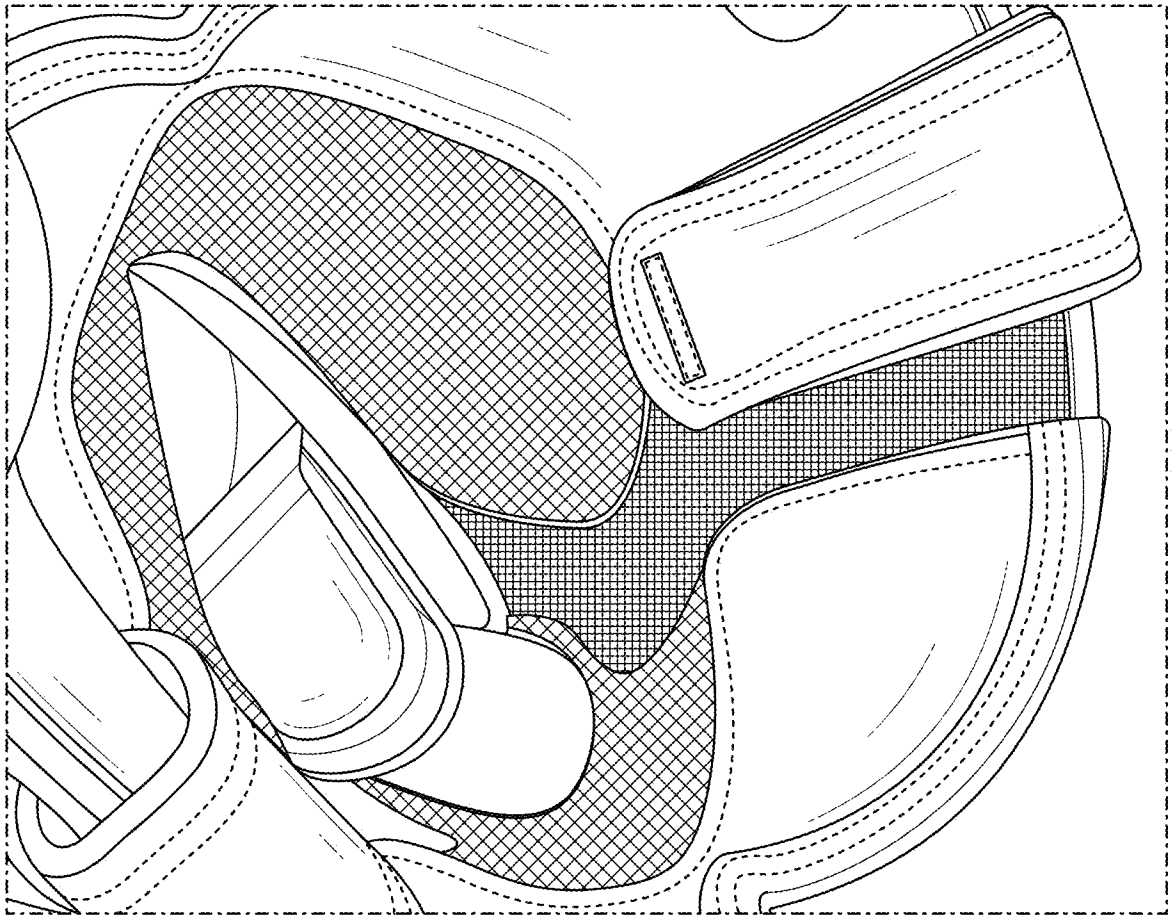
FIG. 45B is a line drawing of a photographic image of the customized lining as shown in FIG. 45.

FIG. 45 shows a view of another embodiment of a boot, again looking into the interior of the boot shaft 105 from above. FIG. 45B is a photographic image of the customized lining as shown in FIG. 45.

In this embodiment, two different types of boot lining are shown. A first boot lining 4500 is used around a top portion of the interior of the boot shaft. A second boot lining 4510 is used below the first boot lining 4500 and can extend for any portion of the remainder of the boot shaft, and possibly into the shoe box 110 of the boot. In some embodiments, the first boot lining 4500 may be made of a more durable material, such as leather or a leather substitute, which can provide structural integrity to the top of the boot shaft, which endures more handling and manipulation by the boot wearer, especially when inserting or extracting the foot into or from the boot. In some embodiments, the first boot lining 4500 may provide less breathability than the second boot lining 4510, but, being near the opening of the boot shaft, breathability may be of less importance than durability. In some embodiments, the second boot lining 4510, which may wrap more closely around the boot wearer's calf and ankle, may be made of a more padded, flexible, and breathable material. Selection of suitable materials for a first and second boot lining 4500, 4510 may depend on a variety of factors.

As is also shown in FIG. 45, rather than encompassing the entire interior surface of the boot shaft, the first boot lining 4500 and the second boot lining 4510 are configured to expose the resilient feature 320 from the interior of the boot shaft. No boot lining 4500, 4510 covers at least portions of the resilient feature 320 from the inside of the boot shaft. Instead, the boot linings 4500, 4510 are stitched or otherwise fixed to the boot shaft around a perimeter of the resilient feature 320. In this manner, the resilient feature is free to expand and/or contract to the full extent of its capability, without being constrained by the characteristics of any boot lining 4500, 4510. As seen in FIG. 45, where the resilient feature may be shaped in a zig-zag, a curve, or any other shape, the one or more boot linings 4500, 4510 may also be shaped to accommodate and refrain from constraining the resilient feature 320.

In view of these principles and referring to FIGS. 31, 33, 37, 40, and 43, the resilient feature 320 is exposed in the interior of the boot shaft. Any one or more boot linings 4500, 4510 that may be included as part of the boot design can be shaped in the manner shown in FIG. 45 to provide important characteristics, such as durability, comfort, and cost-effectiveness while also generally reducing constraints on the expansion and/or contraction of the resilient feature 320.

Construction

Constructing and manufacturing a boot with consistency can be challenging, especially when dealing with resilient materials such as the resilient material 320. One approach to repeatable, predictable construction is to create a template or physical guide for positioning materials. That physical guide can also be permanent and can play a role in the finished boot, for example. An intermediate material can be molded on to resilient material 320 to help position portions of a boot shaft prior to stitching these components together. This material can act as a gauge. Using a moldable intermediate material that is also resilient can help create resilient extension of the resilient material 320.

Figure 46A:
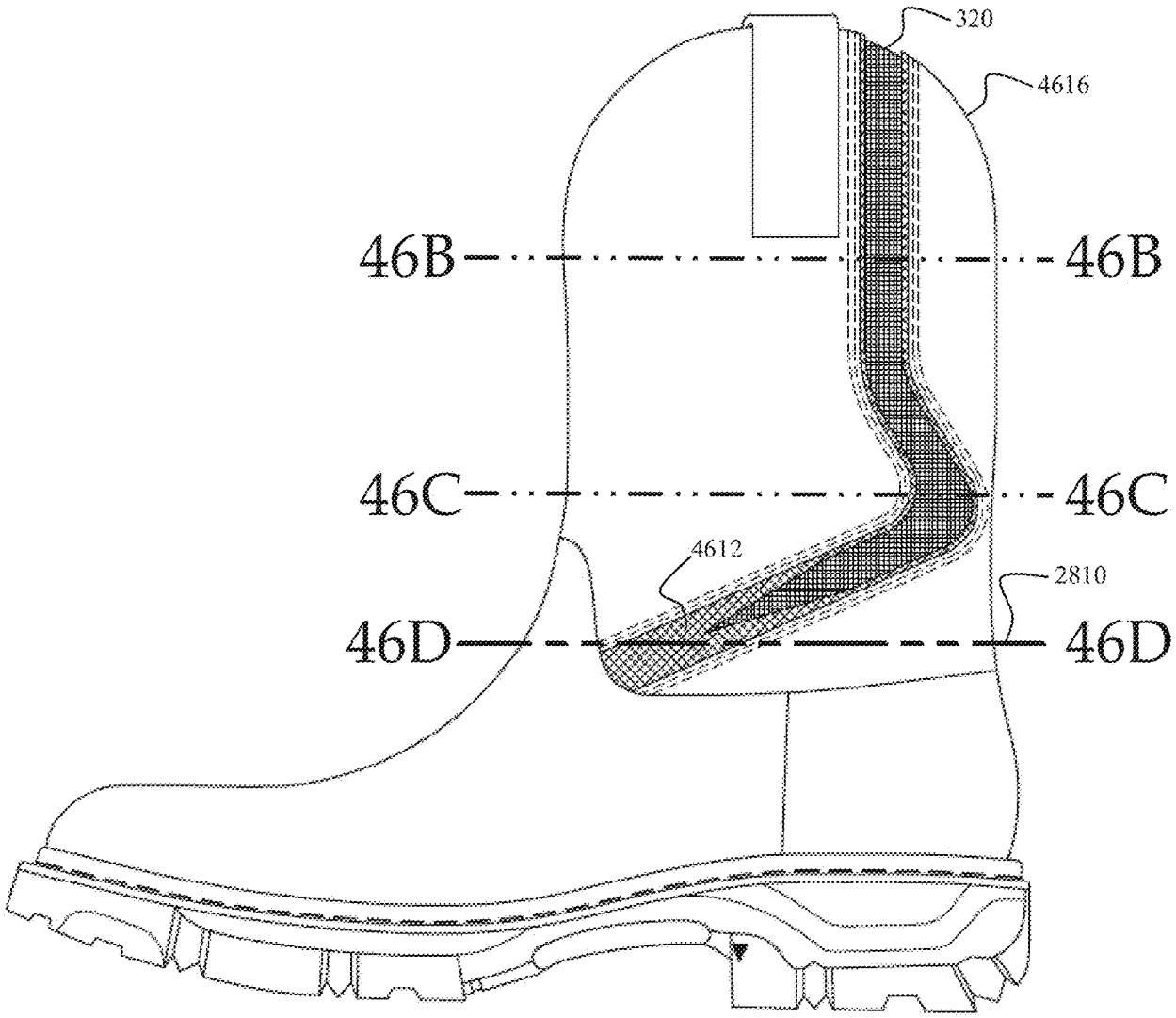
FIG. 46A shows use of an intermediate material in conjunction with a resilient portion of a boot shaft.

FIG. 46A shows an intermediate material 4612 at the interface between a resilient portion 320 of a boot shaft and the other (often leather) portions thereof. This material can assist in waterproofing, attachment, and construction. KPU or other types of injected Urethane such as TPU can serve as an intermediate material, for example. The intermediate material 4612 can be molded or otherwise secured to a resilient portion 320. For example, KPU and/or TPU can be molded to elastic. The intermediate material can assist in waterproofing by entirely covering up portions of a resilient material as shown toward the bottom of the resilient portion 320 in FIG. 46A. As shown, the intermediate material can form a bead that runs along the sides of the resilient portion 320 before tapering in to fully cover the resilient portion 320 at approximately the waterproof line 2810. The illustrated taper is optional and need not terminate to a point as shown. For example, an intermediate material as an edging or bead along the full length of the resilient portion 320 such that no taper occurs.

Figure 46B:
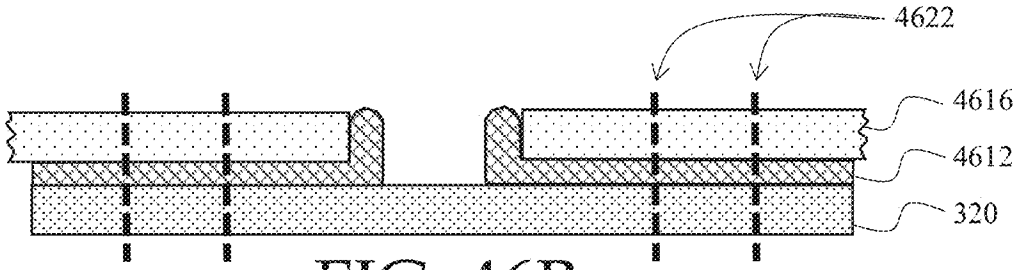
FIG. 46B shows a schematic cross-section of the resilient portion of FIG. 46A.

FIG. 46B shows a schematic cross-section through the resilient portion 320, where two beads of the intermediate material 4612 protrude upward (outward) from the resilient material 320. A portion of the intermediate material 4612 can also lay flat against the resilient portion 320 and be adhered (e.g., molded) thereto. An outer material 4616 (e.g., leather) is also shown. The outer material 4616 can be any of a number of leathers or other materials having various thicknesses. The intermediate material 4612 can advantageously have a thickness (including the protruding bead) in the range of 1-3 mm. The bead itself can protrude beyond the flat portion of the intermediate material 4612 by 1-2 mm, for example. The outer material 4616 can comprise the bulk of the shaft's outer shell. A double layer of stitching 4622 is also illustrated here, and this technique can secure these layers together. Top stitching techniques can also provide aesthetic benefits in addition to functional strength. The protruding bead portion of the intermediate material 4612 can also provide a guide to assist in evenly spacing lines of stitching, improving strength and appearance.

Because of its upward (outward) protrusion and physical presence, the intermediate material 4612 can serve as a physical positioning template to align the resilient material 320 precisely within the gap in the outer material 4616 (e.g., between leather pieces forming the shaft), enabling more accurate and efficient construction of boots and avoiding misplaced seams. Alternatively or additionally, protrusions of an intermediate material 4612 can serve to align an outer material 4612 more precisely and help create more even spacing and seams when sewing an outer material 4612 to resilient material 320. Molding or otherwise affixing the intermediate material on the resilient material of the resilient portion 320 can be accomplished using a metal or other mold having a fixed shape and resilient material swatches can be aligned using registration marks or other physical structures or optical features. The intermediate material can then in turn act as a registration and alignment device after it has cured, for example.

Figure 46C:
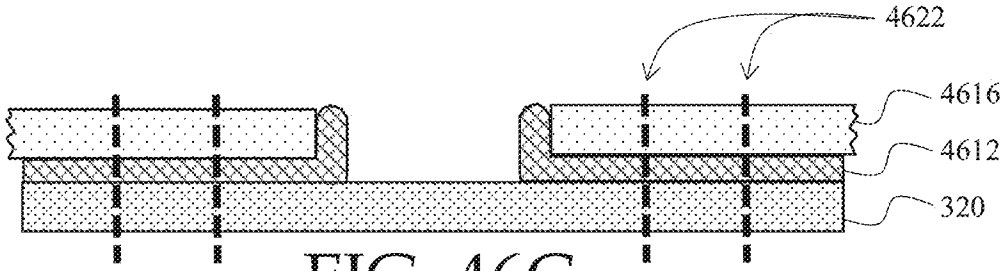
FIG. 46C shows a different schematic cross-section of the resilient portion of FIG. 46A.
Figure 46D:
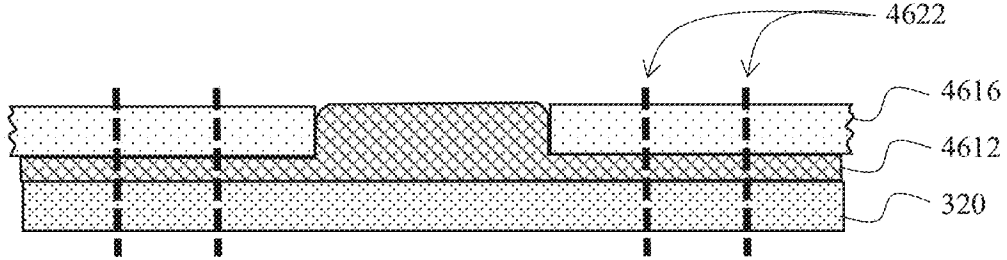
FIG. 46D shows yet another schematic cross-section of the resilient portion of FIG. 46A.

FIG. 46C shows similar structures to those of FIG. 46B, but the cross-section is taken at vertical position within the side of the boot shaft where the resilient portion 320 is wider and more resilient material is exposed. In contrast, FIG. 46D is a section taken closer to the base of FIG. 46A, where the intermediate material 4612 spans the entire gap between the front and back shaft portions formed from the outer material 4616 (e.g., leather). The cross-sections shown in FIGS. 46B-D are taken roughly along the lines 46B-D shown in FIG. 46A.

Using the intermediate material for a positioning template can provide many manufacturing benefits, and consistency can be greatly improved. Whereas a typical error rate for resilient material positioning may be 1% or higher, inclusion of the intermediate material can reduce it to virtually zero, or at least reduce it greatly. Waterproof performance can also be enhanced as the intermediate material acts as a filler and seals or otherwise fills seams between other materials.

Shank Systems

Figure 47:
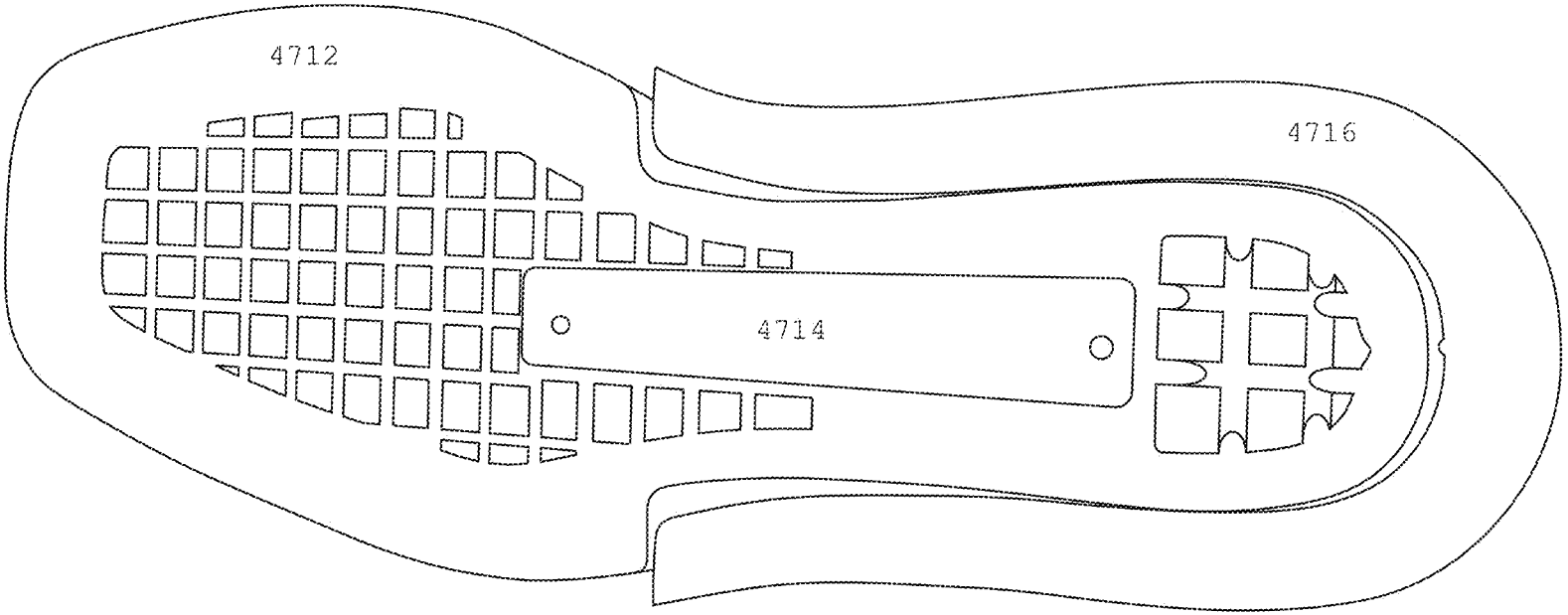
FIG. 47 shows portion of a sole (e.g., for a boot) having a dual shank system.

FIG. 47 is a top view of a portion of a sole (e.g., for a boot) having a dual shank system. An upper portion of a boot is not depicted here. The cushion midsole 4712 can be formed from resilient and durable rubber and can include voids having a waffle-like grid pattern therein, removing some mass and making the soles lighter while maintaining strength and integrity of the sole. A central shank 4714 is provided therein and can strengthen and stabilize the structure. The central shank 4714 can be provided, for example close to (e.g., immediately above or below) the feather line 4944 (see FIG. 49). In FIG. 47, a second peripheral structure forms a closed U shank 4716 which wraps around the heel portion of the cushion midsole 4712. Thus, this illustrates a dual shank system with benefits of strength, stability, and durability. An open U shank configuration can also or alternatively be used.

Figure 48A:
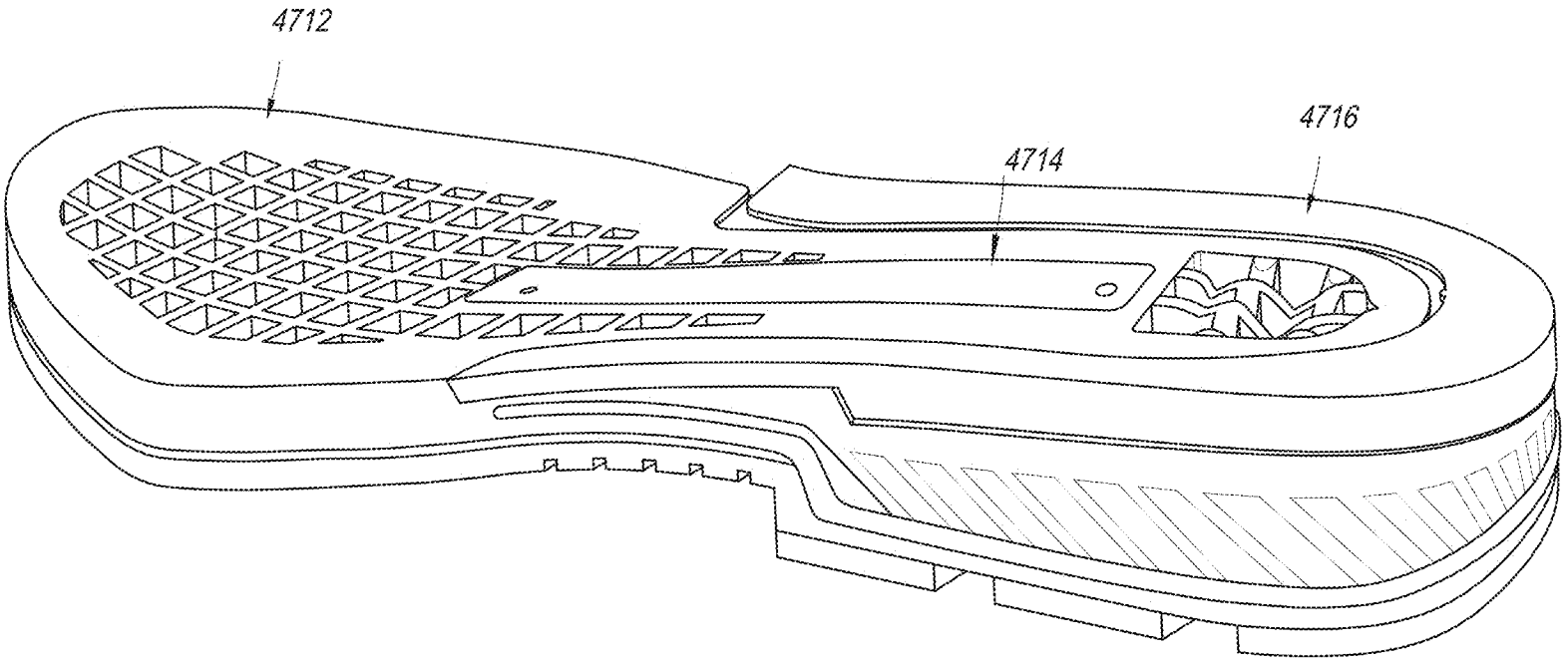
FIG. 48A shows a perspective view of the sole of FIG. 47.

FIG. 48A shows a perspective view of the sole of FIG. 47 (which also has the boot upper removed). The bulk of the sole can form the cushion midsole 4712. A central shank 4714 is depicted again here. The corresponding exploded view of FIG. 48B shows how the closed U shank 4716 can physically cooperate with a stepped opening 4818 in the cushion midsole.

Figure 48B:
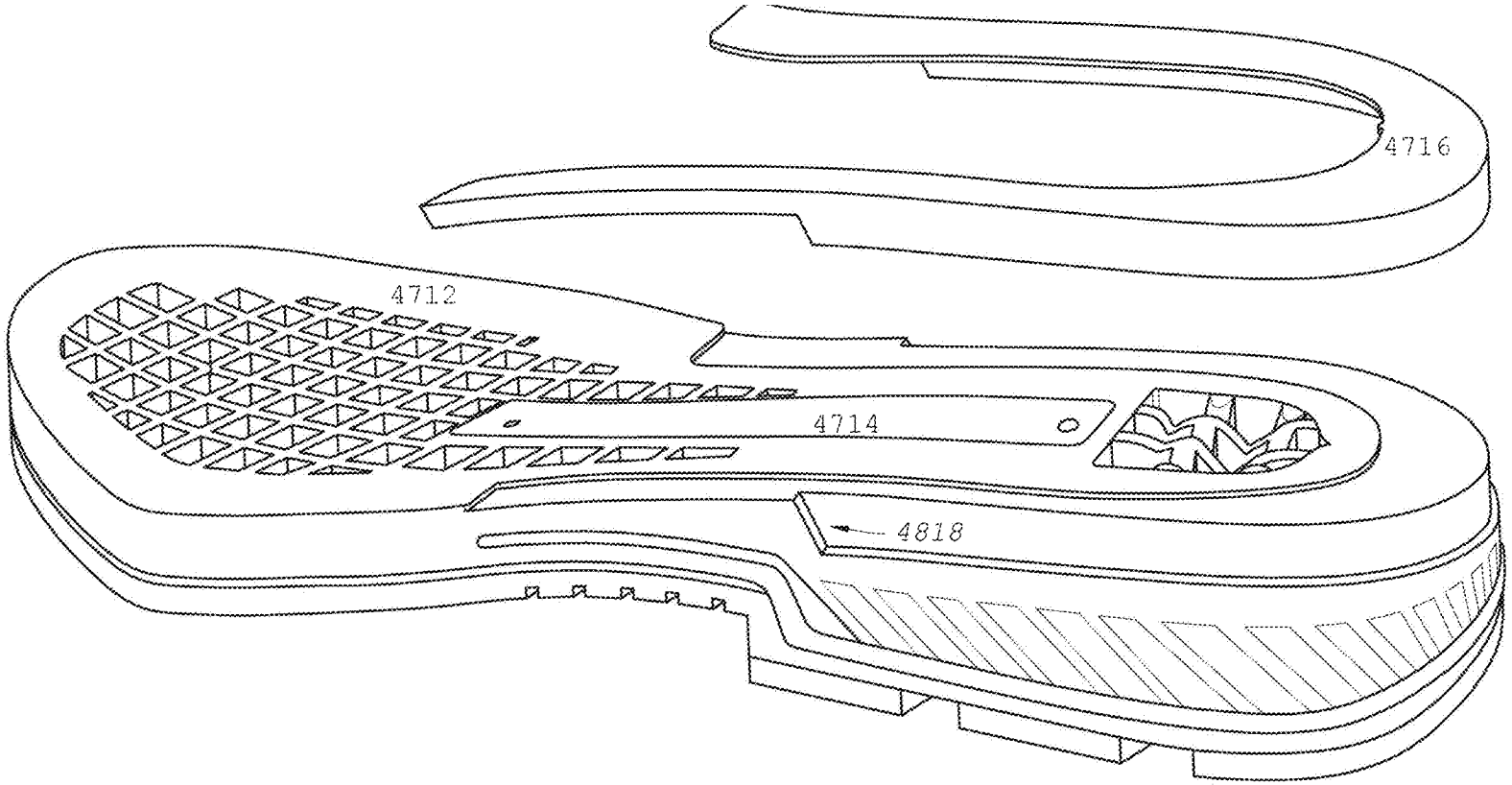
FIG. 48B is an exploded view of FIG. 48A.
Figure 49:
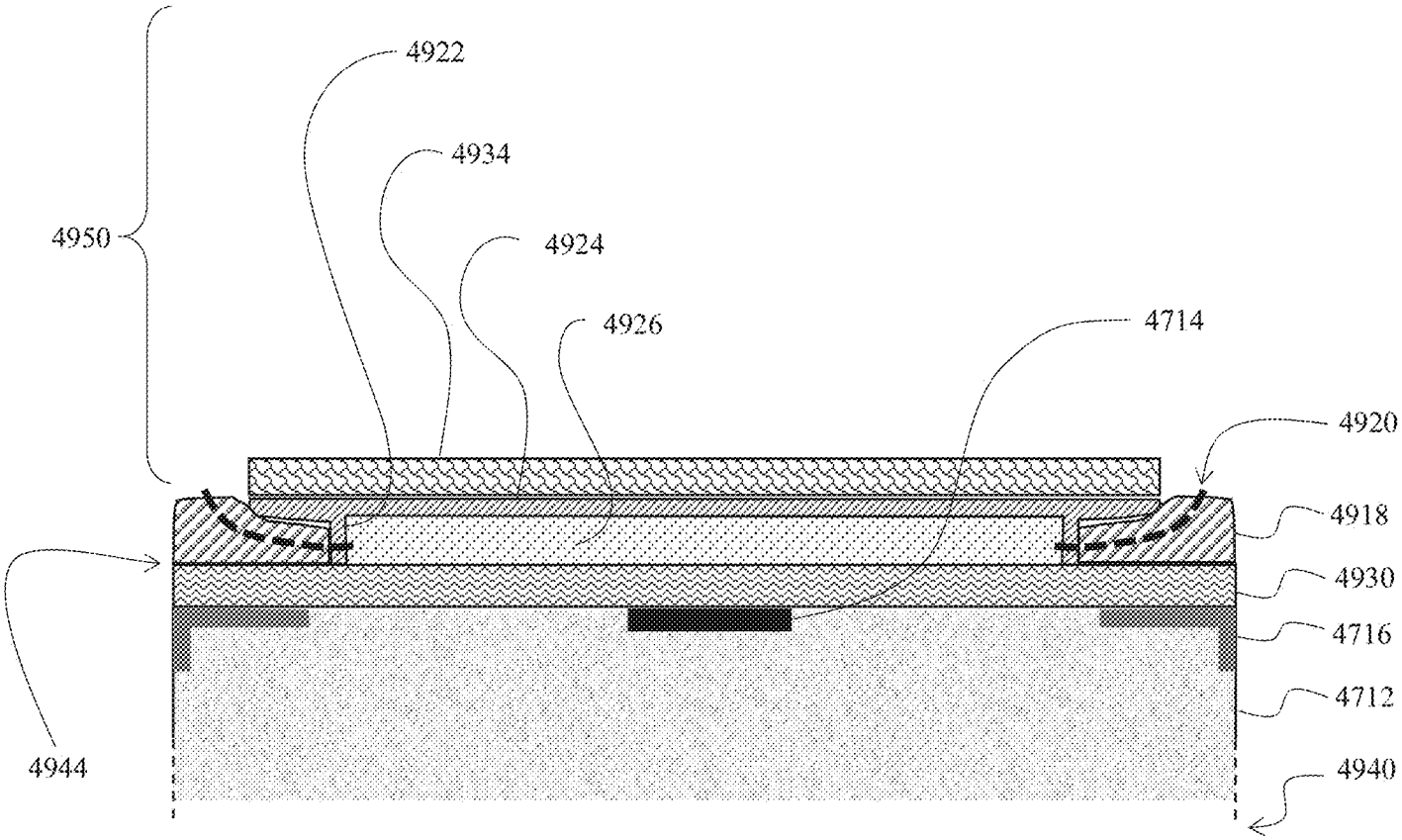
FIG. 49 provides further disclosure about the dual shank system shown in FIGS. 47-48B.

FIG. 49 provides more context for how the dual shank system shown in FIGS. 47-48B integrates into a boot or other footwear. A welt 4918 can be secured with stitching 4920 to a ply rib 4922 which is integrally formed as part of a non-removable insole 4924. After ply ribs 4922 are shortened by trimming, a foam filler 4926 can be inserted and then covered by a full midsole 4930. All these structures can be positioned above the cushion midsole 4712 which can have the central shank 4714 and/or the closed U shank 4716. A footbed/orthotic 4934 (which is often removable) can be positioned above these structures. An outsole can be provided in the general area 4940. A "feather line" is in a region illustrated with reference numeral 4944. A boot upper can be located generally in the region illustrated with reference numeral 4950.

Figure 50:
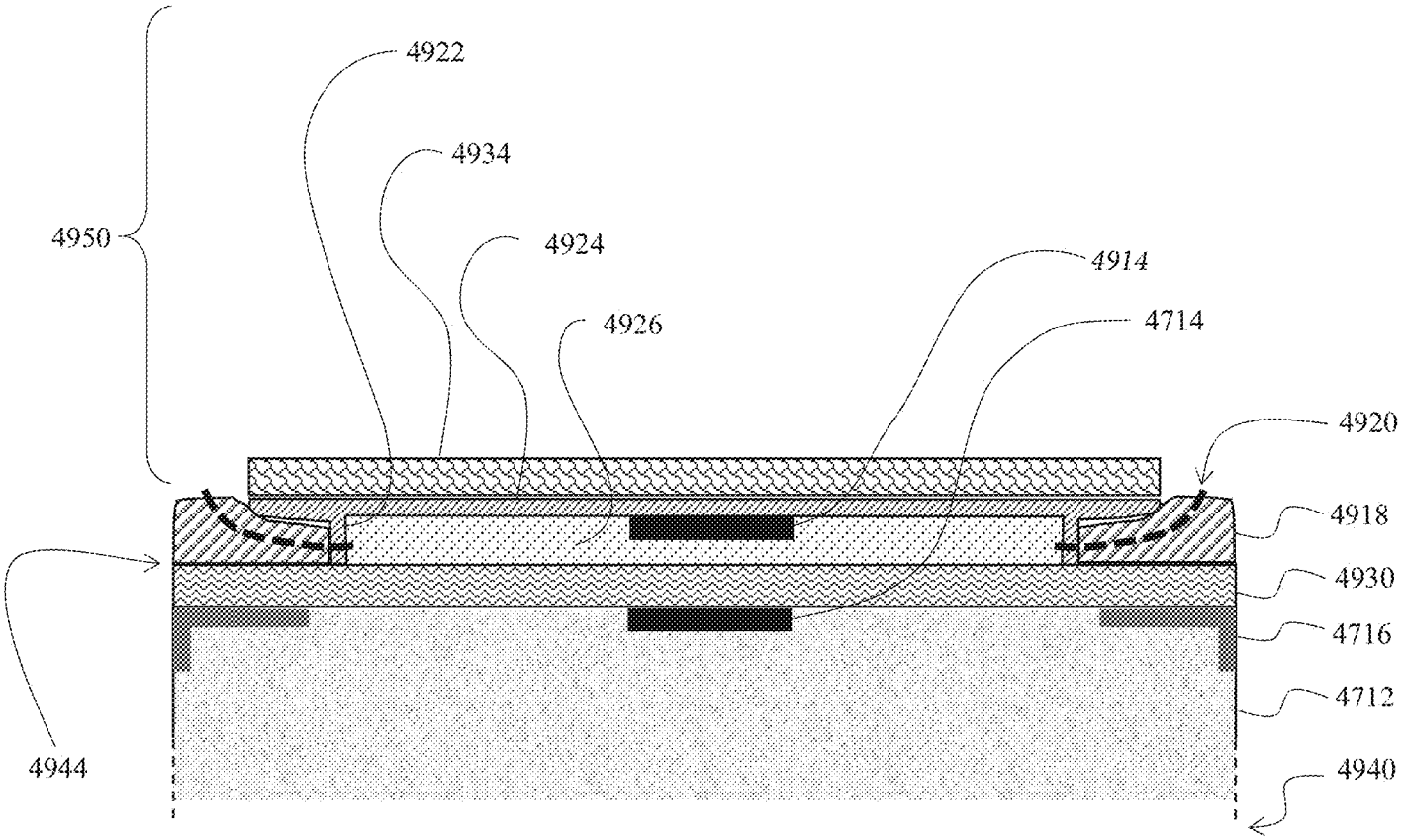
FIG. 50 shows an alternative arrangement structures similar to FIG. 49.

FIG. 50 shows an alternative arrangement structures similar to FIG. 49. Here, a second central shank 4914 is located higher (e.g., at or above the full midsole 4930).

Figure 51:
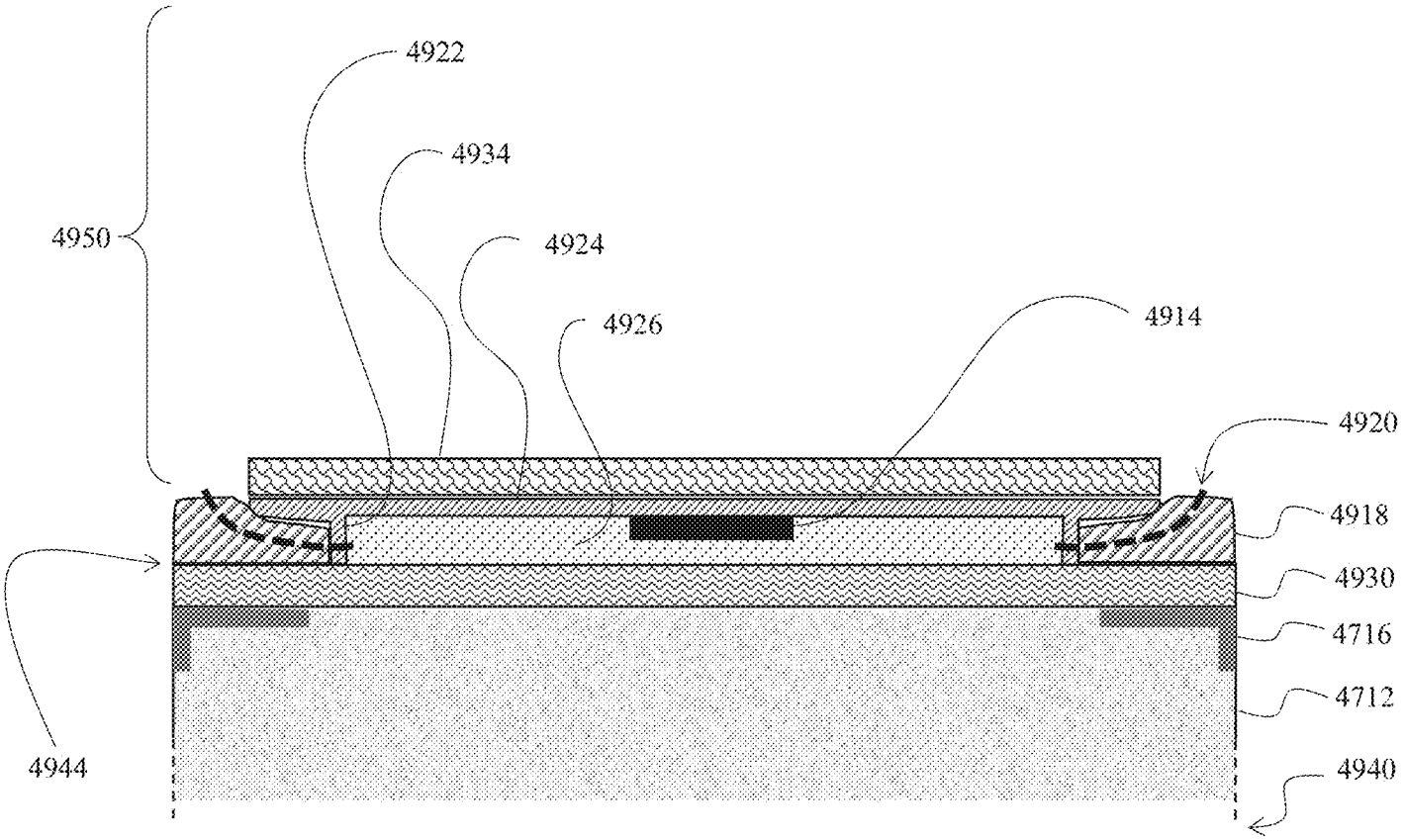
FIG. 51 shows another embodiment of a central shank and a closed U-shaped shank.

FIG. 51 shows a similarly higher central shank 4914 and a closed U shaped shank 4716. Such dual shank configurations can provide additional strength and integrity for the boot, benefiting both the sole and the upper boot portions.

Figure 52:
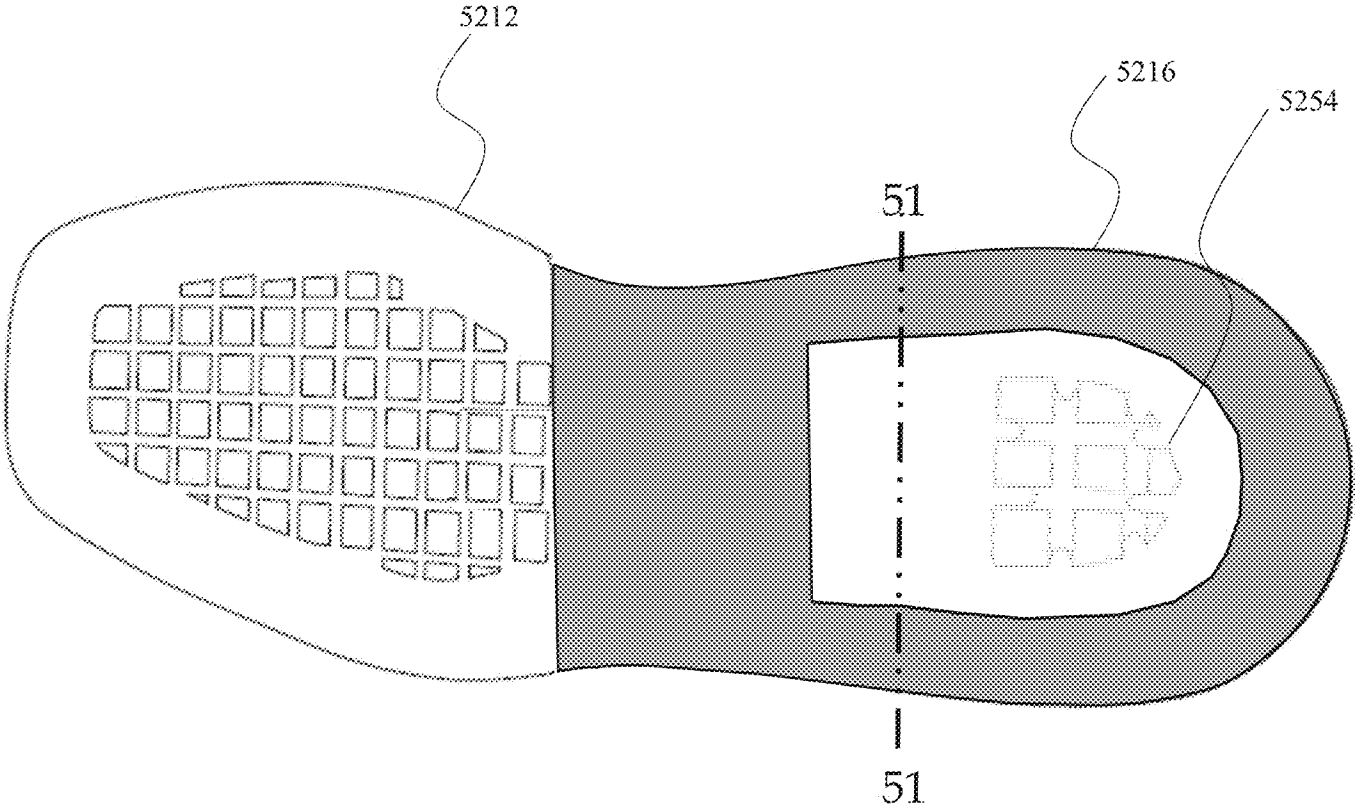
FIG. 52 shows a plan view of a closed U-shaped shank in a cushion midsole.

FIG. 52 shows a plan view of a U-shaped shank 5216 in a cushion midsole 5212, similar to the section view shown in FIG. 51 (after removal of layers above the closed U-shaped shank 5216). Line 51-51 shows approximately where the section view of FIG. 51 would be taken in the context of this figure. This embodiment of a closed U-shaped shank 5216 is strengthened with a robust connection between the two arms of the "U." This still leaves an opening in a heel strike area 5254 to allow for greater cushioning of a user's heel, while maintaining strength and durability with the closed U-shaped shank 5216.

OTHER EMBODIMENTS

Figure 53:
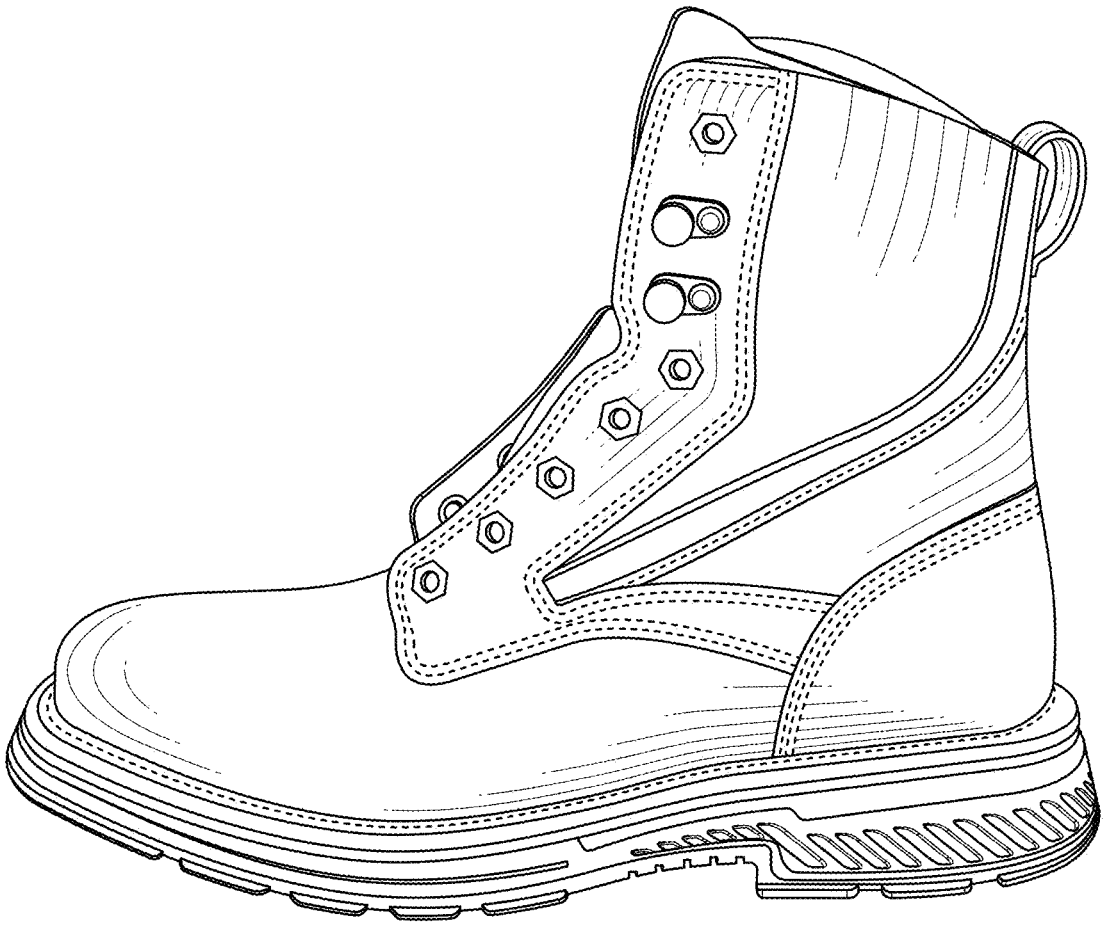
FIG. 53 shows another type of workboot-style boot that includes resilient feature shaft relief system technology and/or adaptive shaft engineering technology as described above.

FIG. 53 shows another type of workboot-style boot that includes resilient feature shaft relief system technology and/or adaptive shaft engineering technology as described above. The boot shown in FIG. 53 includes a combination of holes and hooks that can be used with a shoelace or other similar device to open and close the shaft of the boot. The boot shown in FIG. 53 also includes at least one resilient feature that, in this example, extends from the top of the boot shaft and curves towards a front portion of the boot. The resilient feature can provide expansion and contraction capacity to the boot shaft even when some or all of the other closure mechanisms are used to close the boot shaft. For example, for speed and ease of putting the boot on or off, a wearer may choose to keep the lacing holes towards the bottom of the boot laced up, choosing, for example, to open only the top lacing hole and the more easily unlaced hooks towards the top of the boot shaft. In this situation, the resilient feature can provide additional needed expansion and contraction for passing a foot through the boot shaft that would otherwise not be available without the resilient feature. As was previously described with reference to other embodiments of boots, the shape of the resilient feature can affect the amount and angle at which portions of the shaft can stretch or separate. In this embodiment, the front portion of the shaft can hinge forward and upward, generally about a point near the bottom endpoint of the resilient feature. Additionally, the lower end of the resilient feature can end above a waterproofing line to enhance waterproofing performance. The top of the boot shaft shown in FIG. 53 includes another type of top edge, which is angled or arched from a higher point at or towards the front of the boot and extends down to a lower point at or towards the rear of the boot shaft. In other embodiments, the top edge of the boot shaft can be scalloped, flat, and/or any other functional and/or aesthetically desirable shape. The boot shown in FIG. 53 can further include inner sole and boot shank technology as described above. Additionally or alternatively, boot shown in FIG. 53 can include intermediate material at the interface between a resilient portion of a boot shaft and the other (often leather) portions thereof, as was described with reference to FIGS. 46A-D.

Miscellaneous

As shown in the figures throughout this disclosure, work boots can include both function and style features that integrate smoothly with one another. Purchasers of these styles of boot may prefer to keep the profile of their boot shaft simple, clean, and free of contrivances such as buttons, buckles, zippers, laces and other hardware that could be prone to catching on things and possibly endangering the wearer and/or the boot. As shown herein, comfort and expansion in the shaft of a Western, work, or Wellington-style boot—as well as by non-pull-on boots—while maintaining a simple, clean, and continuous circumference of the boot shaft—can be implemented by adding one or more resilient features to the construction of the shaft. A resilient feature, once installed in a boot shaft, can be integral to the boot shaft and not require any extra hardware to catch on anything that the wearer walks through.

Obvious and visible resilient features may detract from the rugged aesthetic of some styles of boot unless they can be stylistically camouflaged with the boot shaft. Thus, in some embodiments, a maker of Western, work, or Wellington-style boots may seek to optimize boot comfort and temporary expansion in the shaft of the boot, while also seeking to retain and optimize style by minimizing and/or camouflaging visible portions of resilient feature in the shaft of the boot.

Two factors that influence the amount of expansion provided by a resilient feature are location of the resilient feature in the boot shaft and amount of resilient feature included. For example, a larger resilient feature, covering a greater area, can provide greater expansion in a boot shaft. In particular, the greater the proportion of resilient feature to the rest of the boot shaft within any particular circumferential section of the boot shaft, the more expansion can be afforded by the resilient feature.

When the resilient feature can extend all the way to the top of the boot shaft, then there is no constrained circumference above the resilient feature to restrict its expansion. Since the wearer's foot (significantly, the heel) begins to enter through the top of the shaft toward its ultimate destination in the vamp or toe box of the boot, providing for maximum expansion at the top of the shaft can allow for ease of entry and exit of the foot. Expansion is important along the length of the shaft as well, because, as mentioned above, the heel of the wearer's foot must be able to pass through until it is seated in the toe box or vamp.

Thus, using either or both of these methods with long thin resilient features, a boot wearer can benefit from the additional comfort provided by a boot with one or more resilient features while maintaining a desired visual aesthetic.

Embodiments of a boot are disclosed, the boot having an elongate shaft with an elongate axis configured to extend upward along the leg of a user, the shaft having lateral and medial portions with corresponding features; and two pull tabs secured to each elongate shaft, one on the lateral side and one on the medial side. Each of the lateral and medial portions is formed from a protective material and a from a resilient material. Each of the lateral and medial portions is formed primarily from protective material and has at least one elongate opening therein extending generally parallel to the elongate axis of the elongate shaft. Each elongate opening is spanned by resilient material that is secured to the inside of the elongate shaft using at least two rows of stitching that penetrate the protective material and extend up and down either side of the elongate opening. Each elongate opening has a wider portion toward the top of the shaft and a narrower portion toward the bottom of the shaft, and each wider portion is sized to fit behind a pull tab Each pull tab is sized and configured to obscure the wider portion of the elongate opening and the resilient material that spans said opening; and each pull tab is attached to the protective material adjacent to the elongate opening such that it obscures the wider portion thereof by wrapping around a top edge of the elongate shaft containing the elongate opening, the pull tab configured to attach to the protective material on a single side of the elongate opening, thereby allowing the elongate opening to stretch and facilitate periodic entry and exit of a wearer's foot.

Embodiments of a system are disclosed for enhancing boot comfort while maintaining style, the system comprising a boot having a shaft that rises up from a toe box and heel portion of the boot, the shaft primarily formed from a less resilient protective material decorated with multiple lines forming aesthetic designs, and a more resilient accommodating material integrated into the boot shaft. The shaft is separated into a forward portion generally over the toe box and a back portion generally over the heel, with an opening between the two portions that extends from a top edge of the shaft downward toward a sole of the boot. The opening between the two portions is very narrow, such that the two portions touch or are less than one centimeter apart, along more than half of its length. The opening between the two portions is shaped and sized to complement the multiple lines decorating the protective material, such that the opening is difficult to distinguish from such lines and does not appear from a distance to be a functional opening in the protective material. And the opening is spanned by the more resilient accommodating material, which is secured to both front and back edges of the opening from within the shaft such that the resilient accommodating material is fully or mostly obscured by the less resilient protective material The system disclosed in the paragraph above can, in some embodiments, further comprise a second opening, such that a pair of such openings are formed on medial and lateral sides of the boot shaft, each having generally the same shape and construction, and each spanned in the same manner by more resilient accommodating material such that the two openings are approximately symmetrical and to accommodate foot entry simultaneously from each side of the boot shaft. Additionally, in some embodiments, the less resilient protective material is leather. In some embodiments, additional openings in the less resilient protective material of the boot shaft are provided, the openings spanned by perforated or other material that is configured to allow air to continually pass through said additional openings while maintaining the general shape and integrity of the boot shaft. In some embodiments, the opening between the two portions and the resilient material that spans the opening are colored to further complement the multiple lines decorating the protective material and obscure the functional difference between the opening and the decorative lines, thereby providing a stylistic camouflage for the opening. In some embodiments, the opening has a wider portion at the top of the shaft that is configured to expand to a greater extent due to the greater width of resilient material spanning it, said wider portion physically obscured by a pull strap formed from the protective material that loops over the top edge of the shaft and is secured thereto, said pull strap and wider portion configured to permit greater expansion of the opening as a wearer's heel passes through the shaft when a wearer dons or doffs the boot.

Embodiments of a work boot are disclosed, the work boot having comfort features comprising: a rugged sole, a reinforced toe box, a protective leather boot shaft extending upward from the top of the rugged sole to at least three times the height of the toe box, where the shaft has lateral and medial vertical slits that terminate at the top of the shaft, each fully spanned on the inside of the shaft by a resilient material that is secured to the shaft such that the resilient material can be stretched during foot entry or exit but resiliently returns to its resting shape when not being stretched, and where each slit is obscured by at least one obscurement feature.

The work boot described in the paragraph above can, in some embodiments, include an obscurement feature that comprises a strap at the top of each vertical slit that obscures the top of the slit and folds across a top rim of the shaft, the strap secured to the boot shaft with a rotating securement feature such that the strap can be pulled and rotated by a user to exert generally upward force on the boot when a wearer pulls it on to their foot, thereby causing a wearer's heel to pass down through the shaft to rest on an inner portion of the sole.

Embodiments of a method of providing and disguising comfort features in a western-style boot are disclosed, where the method comprises providing at least two of the following: an elongate opening in the shaft of the boot that extends down from the top thereof, spanned by a resilient material that is configured to allow the boot shaft to expand to accommodate entry or exit of a foot through the shaft and to return to a non-expanded state after entry or exit, the elongate opening sized, shaped, and/or positioned to blend into design lines visible on the outside of the shaft; an additional elongate opening in the shaft of the boot that extends from the top thereof, spanned by a resilient material that is configured to allow the boot shaft to expand to accommodate entry or exit of a foot and return to a non-expanded state after entry or exit; at least one pull strap sized and configured to cover at least a portion of one or more of the elongate openings at the top of said opening where it terminates at the top of the shaft; at least one color and shape feature incorporated into at least one of the elongate openings and configured to match other decorative color and shape features to camouflage the elongate opening; at least one color feature incorporated into the resilient material such that the resilient material has a similar color to other decorative features and blends in therewith, even where an elongate opening is wide enough to reveal the underlying resilient material; at least one opening in the material forming the shaft of the boot that does not extend from the top thereof, spanned by a resilient material that is configured to allow at least a portion of the boot shaft to expand to accommodate entry or exit of a foot and return to a non-expanded state after entry or exit; and/or at least one opening in the material forming the shaft of the boot that does not extend from the top thereof, said opening spanned by an air-permeable material configured to allow air circulation such as escape of air heated by a wearer's leg and ingress of outside air during use of the boot.

Embodiments of a method of providing and disguising comfort features in a boot are disclosed, where the method comprises providing at least one opening in a shaft of the boot that extends from the top thereof at least half-way down towards a shoe box of the boot, the opening spanned by a resilient material that is configured to allow the boot shaft to expand in response to pressure to accommodate entry or exit of a foot through the boot shaft and to return to a non-expanded state after said entry or exit, the opening comprising an upper vertical portion and a lower curved portion, wherein the two portions are connected to one another and wherein a transition from the upper vertical portion to the lower curved portion includes a turn of approximately 90 degree in the shape of the opening.

In some embodiments of the method described in the paragraph above, the opening can be further shaped and positioned to blend into design lines visible on the outside of the shaft of the boot. In some embodiments, the method includes at least one pull tab at the top of the boot shaft, including an inner and an outer portion which extend down inside and outside of the boot shaft respectively, the pull tab positioned and sized to hang over and hide the top vertical portion of the opening and the approximately 90 degree turn in the transition of the opening, the inner and outer portions of the pull tab securely attached to the boot shaft below the approximately 90 degree turn in the transition of the opening. In some embodiments, the at least one pull tab is pivotably attached to the boot shaft, allowing a wearer of the boot to pull on the pull tab in a direction other than generally parallel to the upper vertical portion of the opening.

Embodiments of a boot are described, the boot comprising an elongate resilient feature configured to provide greater stretch near a donning point where a heel presses against the back of a boot shaft, the elongate resilient feature including an intermediate material configured to provide a manufacturing template for relative positioning between materials of the boot shaft.

In some embodiments of the boot described in the paragraph above, the boot further comprises at least one pull tab wrapping around and extending over a top rim of the boot shaft and positioned to obscure and generally enclose a top portion of the resilient feature. In some embodiments, the resilient feature spans an opening in the outward-facing portion of the boot shaft and a corresponding resilient feature is positioned within a lining of the boot shaft such that it spans a corresponding opening in the lining of the boot shaft, and the pull tab obscures both of these resilient features near the top rim of the boot shaft. In some embodiments, the pull tab is leather and is configured to rotate forward and back around an axis of rotation formed by a rivet that passes through the pull tab and the shaft of the boot. In some embodiments, the boot further comprises a dual shank system comprising a generally straight and elongate shank and a separate closed U-shaped shank located in a cushion midsole of the boot.

Embodiments of a western boot are disclosed, the western boot comprising: a sole; above and connected to the sole, a shoebox formed primarily from a durable material; and a shaft rising from the shoebox to a shaft top that is open to receive a wearer's foot, the shaft also formed primarily from a durable material and incorporating resilient features such that a shaft front portion generally faces forward, a shaft back portion generally faces backward, elongate medial and lateral openings in the durable material of the shaft that form two openings in a rim at the shaft top, each extend vertically down from the shaft top, separating the shaft front portion from the shaft back portion, and two portions of resilient material form resilient features, one medial and one lateral, each spanning one of the medial and lateral openings to resiliently connect the shaft front and back portions, the resilient features shaped and configured to provide a widest separation at a specific vertical level that eases the tightest transition point for foot entry.

In some embodiments of the western boot disclosed in the paragraph above, the specific vertical level comprises a donning point, the donning point occurring in the shaft back portion where a user's heel contacts the shaft interior during foot entry, while the same foot is simultaneously contacting the interior of the shaft front portion with a top foot surface at a doffing point where the shoe box transitions to the shaft. In some embodiments, the resilient features each comprise two angled linear portions that converge at the vertical level of the donning point and each comprises a lower linear portion thereof terminating near the doffing point. In some embodiments, a lateral space between the front and back shaft portions is greatest at the vertical level of the doffing point even when the shaft is in a relaxed position prior to or after foot entry or exit. In some embodiments, the elongate medial and lateral openings each terminate above an upper limit of the shoe box at a waterproof line, thereby maintaining a waterproof aspect of the boot. In some embodiments, the two portions of resilient material are formed from waterproof elastic, thereby enhancing waterproof performance of the boot. In some embodiments, the western boot further comprises a moldable material formed on the resilient material such that the moldable material protrudes from a surface of the resilient material to establish an edge configured to seat against a corresponding edge in the durable material, thereby positioning the resilient material with respect to the medial or lateral opening prior to seam stitching and improving manufacturing consistency. In some embodiments, the moldable material is formed from KPU, and the resilient material is elastic. In some embodiments, the moldable material provides an overlapping layer positioned between the durable and resilient materials at seam lines extending along the edges of both the front and back shaft portions bordering the elongate openings. In some embodiments, the moldable material spans the entire width of both medial and lateral elongate openings at a lower end of these openings, thereby enhancing strength, resilience, and waterproof properties of the boot. In some embodiments, the western boot further comprises a boot lining formed inside the shaft, the lining having elongate lining openings that run parallel to and generally match the size and shape of the elongate medial and lateral openings in the durable material of the shaft, the elongate lining openings also spanned by resilient material such that two layers of resilient material act together, one on the medial side of the shaft and one on the lateral side of the shaft, to allow temporary widening of the shaft and lining openings during foot entry and exit. In some embodiments, the western boot further comprises medial and lateral pull tabs formed from durable material that are secured to the shaft and configured to wrap around the rim at the shaft top, thereby obscuring the opening in the rim. In some embodiments, the western boot further comprises medial and lateral pivot fasteners that secure the pull tabs to the shaft while allowing the pull tabs to pivot slightly frontward and backward along the boot rim.

In some embodiments, the western boot disclosed two paragraphs above further comprises a dual shank system comprising a generally straight and elongate shank and a separate closed U-shaped shank, the closed U-shaped shank located in a cushion midsole of the boot such that at least a portion thereof is externally visible.

Embodiments of a method of manufacturing a boot having resilient features are disclosed, the method comprising: providing durable and resilient materials for a boot shaft; cutting out rear and front portions of durable material for the boot shaft; cutting out medial and lateral resilient materials for the boot shaft; molding a moldable material onto each of the medial and lateral resilient materials using a mold template such that the moldable material protrudes from a surface of the resilient material to establish an edge configured to seat against a corresponding edge in the durable material; using the edge of the moldable material to position the resilient material with respect to the medial or lateral opening prior to seam stitching; and stitching a seam along the edge of the durable material while the moldable material is helping to hold the position of the resilient material with respect to the durable material.

In some embodiments, the method described in the paragraph above further comprises: molding the moldable material such that it forms a flatter, less protruding portion along the full edge of the resilient portion to provide a flatter ledge portion configured to receive the edges of the durable material; positioning durable material on the ledge portion; and sewing a robust seam through the durable material and through the moldable material and through the resilient material, thereby further securing all three materials together along a seam at the edge of the medial and lateral openings.

The above features can be included in a product referred to as Dominator, for example. The features described in groups above (e.g., Hawx and/or Dominator features) can of course be interchanged and/or grouped differently. For example, topcover materials can be swapped, etc. Additional benefits also apply from the combination of materials, in addition to the individual component benefits provided.

Conditional language used herein, such as, among others, "can," "might," "may," "for example," and the like, unless specifically stated otherwise, or otherwise understood within the context as used, is generally intended to convey that certain embodiments include, while some embodiments do not include certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. In addition, the articles "a" and "an" are to be construed to mean "one or more" or "at least one" unless specified otherwise.

Conjunctive language such as the phrase "at least one of X, Y and Z," unless specifically stated otherwise, is otherwise understood with the context as used in general to convey that an item, term, etc. may be either X, Y or Z. Thus, such conjunctive language is not generally intended to imply that certain embodiments require at least one of X, at least one of Y and at least one of Z to each be present.

While the above detailed description has shown, described, and pointed out novel features as applied to various embodiments, it will be understood that various omissions, substitutions, and changes in the form and details of the devices or algorithms illustrated can be made without departing from the spirit of the disclosure. Thus, nothing in the foregoing description is intended to imply that any particular feature, characteristic, step, module, or block is necessary or indispensable. As will be recognized, the processes described herein can be embodied within a form that does not provide all of the features and benefits set forth herein, as some features can be used or practiced separately from others. The scope of protection is defined by the appended claims rather than by the foregoing description.

Reference throughout this specification to "some embodiments" or "an embodiment" means that a particular feature, structure or characteristic described in connection with the embodiment is included in at least some embodiments. Thus, appearances of the phrases "in some embodiments" or "in an embodiment" in various places throughout this specification are not necessarily all referring to the same embodiment and may refer to one or more of the same or different embodiments. Furthermore, the particular features, structures or characteristics may be combined in any suitable manner, as would be apparent to one of ordinary skill in the art from this disclosure, in one or more embodiments.

As used in this application, the terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Similarly, it should be appreciated that in the above description of embodiments, various features are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, inventive aspects lie in a combination of fewer than all features of any single foregoing disclosed embodiment. Accordingly, no feature or group of features is necessary or indispensable to each embodiment.

A number of applications, publications, and external documents may be incorporated by reference herein. Any conflict or contradiction between a statement in the body text of this specification and a statement in any of the incorporated documents is to be resolved in favor of the statement in the body text.

Although described in the illustrative context of certain preferred embodiments and examples, it will be understood by those skilled in the art that the disclosure extends beyond the specifically described embodiments to other alternative embodiments and/or uses and obvious modifications and equivalents. An artisan of ordinary skill will recognize from the disclosure herein a wide number of alternatives. Thus, it is intended that the scope of the claims which follow should not be limited by the particular embodiments described above.

What is claimed is:

1. A boot comprising:

a sole;

above and connected to the sole, a shoebox formed primarily from a durable material; and a shaft rising along a vertical axis from the shoebox to terminate at a shaft top defining a rim, the shaft top open to receive a wearer's foot through the rim, the shaft also formed primarily from a durable material and incorporating resilient features such that:

a shaft front portion generally faces forward, a shaft back portion generally faces backward, elongate medial and lateral openings in the durable material of the shaft that form two openings less than one centimeter wide in the rim at the shaft top when the shaft is relaxed, each opening extending down from the shaft top, separating the shaft front portion from the shaft back portion, and two portions of resilient material form the resilient features, one medial and one lateral, each spanning one of the elongate medial and lateral openings to resiliently connect the shaft front and back portions, and each of the resilient features form a vertex toward a back of the shaft wherein each of the resilient features are shaped to provide a widest separation between the shaft front portion and the shaft back portion at a vertical level below the shaft top that eases a tightest transition point for foot entry when the shaft is stretched, wherein the resilient features each comprise an upper and a lower angled linear panel that converge at the vertex, and wherein each of the upper and the lower angled linear panels extend forward from the vertex.

2. The boot of claim 1, wherein the vertical level comprises a donning point, the donning point occurring in the shaft back portion where the wearer's heel most forcefully contacts the shaft interior during foot entry, while the same foot is simultaneously contacting the interior of the shaft front portion with a top foot surface at a doffing point where the shoebox transitions to the shaft.

3. The boot of claim 2, wherein each of the lower angled linear panels terminate at the shoebox.

4. The boot of claim 3, wherein a width of each of the medial and lateral openings between the front and back shaft portions is greatest at the vertical level of the vertex even when the shaft is relaxed.

5. The boot of claim 1, wherein the elongate medial and lateral openings each terminate above an upper limit of the shoebox at a waterproof line, thereby maintaining a waterproof aspect of the boot.

6. The boot of claim 1, wherein the two portions of resilient material are formed from waterproof elastic, thereby enhancing waterproof performance of the boot.

7. The boot of claim 1 further comprising medial and lateral pull tabs formed from durable material that are secured to the shaft and configured to wrap around the rim at the shaft top, wherein the medial and lateral pull tabs obscure the elongate medial and lateral openings in the rim.

8. The boot of claim 1, further comprising a dual shank system comprising a generally straight and elongate shank and a separate U-shaped shank, the U-shaped shank located in a cushion midsole of the boot such that at least a portion thereof is externally visible.

9. A boot comprising:

a sole;

above and connected to the sole, a shoebox formed primarily from a durable material; and a shaft rising from the shoebox to terminate at a shaft top defining a rim, the shaft top open to initially receive a wearer's foot through the rim, the shaft also formed primarily from a durable material and incorporating resilient features such that:

a shaft front portion generally faces forward, a shaft back portion generally faces backward, elongate medial and lateral openings in the durable material of the shaft that form two openings less than one centimeter wide in the rim at the shaft top when the shaft is relaxed, each opening extending down from the shaft top, separating the shaft front portion from the shaft back portion, and two portions of resilient material form the resilient features, one medial and one lateral, each spanning one of the medial and lateral openings to resiliently connect the shaft front and back portions wherein the resilient features form a vertex toward a back of the shaft and each comprise an upper and a lower angled linear panel that converge at the vertex, each of the upper and the lower angled linear panels extending forward from the vertex, the resilient features shaped and configured to provide a widest separation between the shaft front portion and the shaft back portion at a vertical level below the shaft top that eases a tightest transition point for foot entry when the shaft is stretched, further comprising a boot lining formed inside the shaft, the lining having elongate lining openings that run parallel to and generally match the size and shape of the elongate medial and lateral openings in the durable material of the shaft, the elongate lining openings spanned by two portions of resilient material forming inner resilient features, the inner resilient features overlapping with the resilient features of the shaft on the medial side of the shaft and on the lateral side of the shaft to allow temporary widening of the elongate medial and lateral openings and the elongate lining openings when the shaft is stretched.

10. A boot comprising:

a sole;

a shoebox formed primarily from a durable material extending upwards from the sole in a vertical direction; and a shaft rising from the shoebox to terminate at a shaft rim, the shaft rim open to receive a wearer's foot, the shaft also formed primarily from a durable material and incorporating resilient features such that:

a shaft front portion generally faces forward, a shaft back portion generally faces backward, elongate medial and lateral openings in the durable material of the shaft that form two openings in the shaft rim, each opening extending down from the shaft rim, separating the shaft front portion from the shaft back portion, and two portions of resilient material form one medial and one lateral resilient feature, each spanning one of the medial and lateral openings to resiliently connect the shaft front and back portions, wherein the resilient features form a vertex toward a back of the shaft and each comprise an upper and a lower angled linear panel that converge at the vertex, each of the upper and the lower angled linear panels extending forward from the vertex, further comprising medial and lateral pull tabs formed from durable material with lower ends that are secured to the shaft below the shaft rim and loops that extend above the shaft rim, wherein the medial and lateral pull tabs obscure the elongate medial and lateral openings in the rim.

11. The boot of claim 10, wherein each of the medial and lateral pull tabs are attached to the shaft and wrap around a top edge of the shaft to form the loops.

12. A boot comprising:

a sole;

above and connected to the sole, a shoebox formed primarily from a durable material; and a shaft rising from the shoebox to terminate at a shaft rim, the shaft rim open to receive a wearer's foot through the rim, the shaft also formed primarily from a durable material and incorporating resilient features such that:

a shaft front portion faces forward, a shaft back portion faces rearward, elongate medial and lateral openings in the durable material of the shaft that form two openings in the shaft rim when the shaft is in a relaxed position, each opening separating the shaft front portion from the shaft back portion, the elongate lateral opening including an upper portion extending downwardly and rearwardly from the shaft rim to a lower portion of the elongate lateral opening at a donning point of the shaft, and the lower portion extending downwardly and forwardly from the donning point towards the shoebox at a front of the shaft;

wherein the resilient features comprise two portions of resilient material, one medial and one lateral, each spanning one of the medial and lateral openings to resiliently connect the shaft front and back portions wherein each of the resilient features form a vertex toward a back of the shaft and each comprise an upper and a lower angled linear panel that converge at the vertex, each of the upper and the lower angled linear panels extending forward from the vertex, wherein the resilient features provide a widest separation between the shaft front portion and the shaft back portion at a vertical level of a donning point;

wherein the shaft front portion includes an edge extending along the lateral elongate opening, the edge including a top portion at the shaft rim a mid portion at the donning point, and a lower portion at the shoebox, the lower portion being forward of the top portion and the mid portion being rearward of the top portion.

13. The boot of claim 12, wherein the upper portion includes the upper angled linear portion, the lower portion includes the lower angled linear portion, and the vertex is at the vertical level of the donning point.

* * * * *